US009174474B2

(12) United States Patent
Herbert et al.

(10) Patent No.: US 9,174,474 B2
(45) Date of Patent: Nov. 3, 2015

(54) TEMPERATURE CONTROL ASSEMBLY FOR CONTROLLING THE TEMPERATURE OF FUNCTIONAL PARTS OF A PRINTING MACHINE, PRINTING SYSTEM WITH A PRINTING MACHINE AND A TEMPERATURE CONTROL ASSEMBLY, AND SET OF MODULES FOR FORMING A TEMPERATURE CONTROL ASSEMBLY

(71) Applicant: KOENIG & BAUER Aktiengesellschaft, Würzburg (DE)

(72) Inventors: Burkard Otto Herbert, Würzburg (DE); Daniela Müller, Veitshöchheim (DE); Klaus Georg Matthias Müller, Remlingen (DE); Roland Pfister, Gössenheim-Sachsenheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 14/396,616

(22) PCT Filed: Apr. 3, 2013

(86) PCT No.: PCT/EP2013/057016

§ 371 (c)(1),
(2) Date: Oct. 23, 2014

(87) PCT Pub. No.: WO2013/160074

PCT Pub. Date: Oct. 31, 2013

(65) Prior Publication Data

US 2015/0145918 A1 May 28, 2015

(30) Foreign Application Priority Data

Apr. 25, 2012 (DE) ..... 10 2012 206 844

(51) Int. Cl.
*B41F 23/04* (2006.01)
*B41J 29/377* (2006.01)

(Continued)

(52) U.S. Cl.
CPC ..... *B41J 29/377* (2013.01); *B41F 13/22* (2013.01); *B41F 31/002* (2013.01)

(58) Field of Classification Search
CPC ..... B41F 13/22; B41F 31/002; B41F 31/005; B41M 1/00; B41M 1/06
See application file for complete search history.

(56) References Cited

U.S. PATENT DOCUMENTS 7,523,706 B2 4/2009 Schneider et al.
8,272,324 B2 9/2012 Müller et al.

(Continued)

FOREIGN PATENT DOCUMENTS

DE 100 08 210 A1 8/2001
DE 100 08 210 B4 3/2006

(Continued)

*Primary Examiner* — Matthew G Marini
(74) *Attorney, Agent, or Firm* — Mattingly & Malur, PC

(57) ABSTRACT

A temperature control assembly controls the temperature of parts of a printing machine. A plurality of assembly-side sub-circuits, the temperature of which is to be individually controlled, each comprises a temperature control fluid outlet and a temperature control fluid inlet. An external temperature control sub-circuit, can be connected to each assembly-side sub-circuit to form a respective temperature control circuit. The assembly-side sub-circuits are coupled to a common feed line, which conducts temperature control fluid, in a thermal and/or fluidic manner on the feed side to control the temperature of the assembly-side sub-circuits and to a common return line on the return side. The feed line is connected to a fluid store, which provides temperature control fluid to supply the feed line. The temperature control assembly comprises the common feed line, the fluid store, and an assembly which controls the temperature of the temperature control fluid of the fluid store.

26 Claims, 25 Drawing Sheets

(51) Int. Cl.
*B41F 31/00* (2006.01)
*B41F 13/22* (2006.01)

(56) References Cited

U.S. PATENT DOCUMENTS

| | | | |
|---|---|---|---|
| 8,328,194 | B2 | 12/2012 | Reinhard et al. |
| 8,783,685 | B2 | 7/2014 | Reinhard et al. |
| 2006/0208412 | A1 | 9/2006 | Reinhard et al. |
| 2008/0017061 | A1 | 1/2008 | Müller et al. |
| 2008/0041258 | A1 | 2/2008 | Schneider et al. |
| 2013/0176356 | A1 | 7/2013 | Reinhard et al. |

FOREIGN PATENT DOCUMENTS

| | | | |
|---|---|---|---|
| DE | 102007003619 | A1 | 8/2007 |
| DE | 102009001597 | A1 | 9/2010 |
| EP | 1 644 901 | A | 4/2006 |
| EP | 1 862 310 | A2 | 12/2007 |
| WO | 2005/008606 | A1 | 1/2005 |
| WO | 2006/072558 | A1 | 7/2006 |

001

001

001

TEMPERATURE CONTROL ASSEMBLY FOR CONTROLLING THE TEMPERATURE OF FUNCTIONAL PARTS OF A PRINTING MACHINE, PRINTING SYSTEM WITH A PRINTING MACHINE AND A TEMPERATURE CONTROL ASSEMBLY, AND SET OF MODULES FOR FORMING A TEMPERATURE CONTROL ASSEMBLY

CROSS-REFERENCE TO RELATED APPLICATIONS

This application is the U.S. national phase, under 35 U.S.C. 371, of PCT/EP2013/057016, filed Apr. 3, 2013, published as WO2013/160074 A1 on Oct. 31, 2013 and claiming priority to DE 10 2012 206 844.9 filed Apr. 25, 2012, the disclosures of which are expressly incorporated herein, in their entireties, by reference.

FIELD OF INVENTION

The invention relates to a temperature control assembly for controlling the temperature of functional parts of a printing machine, a printing system comprising a printing machine and a temperature control assembly, and a set of modules for forming a temperature control assembly. The temperature control assembly comprises a plurality of assembly-side temperature control sub-circuits arranged side by side, the temperature of which is to be individually controlled. Each comprises a temperature control fluid outlet and a temperature control fluid inlet. An external temperature control sub-circuit, which controls the temperature of one or more functional parts, can be connected by releasable connections to each assembly-side sub-circuit in order to form a respective temperature control circuit. The assembly-side sub-circuits can be, or are coupled, either thermally or fluidically to a common feed line for conducting temperature control fluid for controlling the temperature of the sub-circuits on the feed side and to a common return line on the return side. The feed line is line-connected to a fluid store which holds temperature control fluid that is temperature controlled in reserve, to be fed to the feed line. The printing system as at least one printing machine with a temperature control assembly for controlling the temperature of functional parts of the printing machine. A set of modules form the temperature control assembly. At least one of these modules is a base module any at least one is a connecting module. These modules can be combined with each other to form, in combination, at least part of the temperature control system and having a plurality of interface pairs which form outlets and inlets for coupling a plurality of temperature control circuits that are to be temperature controlled.

BACKGROUND OF THE INVENTION

DE 10 2007 003 619 A1 discloses a sheet-fed printing machine having a temperature control device, wherein a primary circuit which is cooled by a central temperature control device is provided, to which primary circuit individual temperature control circuits are thermally coupled in the printing couples in such a way that fluid is exchanged with the primary circuit via a valve in order to control the temperature of the individual temperature control circuits.

EP 1 862 310 A2 discloses a printing machine comprising a plurality of printing couples, to which a peripheral device, embodied substantially in the form of an equipment cabinet with front doors, is allocated for the purpose of providing wetting agent and controlling temperature. The peripheral device can be used both to process wetting agent conducted within the circuit and to control the temperature of temperature control medium in a temperature control medium circuit for collectively controlling the temperature of forme rollers.

WO 2006/072558 A1 discloses a printing machine with printing towers, wherein one printing tower is assigned a supply device for supplying temperature control fluid to temperature control circuits of the printing tower, wherein primary circuit fluid from said circuits can be metered in alternately from two primary circuits for the purpose of cooling or preheating.

From EP 1 644 901 B1, a machine for processing sheets and comprising a plurality of modules is known.

DE 100 08 210 B4 discloses an oil temperature control device, wherein the temperature-controlled oil is first used in the printing couple for controlling the temperature of distribution rollers, and is then fed as lubricant to lubricating points in the printing couple. In this case, the oil temperature control device is integrated into a modular body, and is connected to the printing couple via a supply line and a return line. A plurality of modular devices can be connected to one another, in which case the coolant lines can be connected via interfaces. A cooling medium circuit and an oil circuit, which is temperature controlled by the cooling circuit via a heat exchanger, is provided for each modular device. Each cooling circuit is configured to be connected to a cooling system, which is in turn configured for connection via the cooling medium lines, in a manner not described in detail, to a central cooling device, which is not described in detail.

DE 10 2009 001 597 A1 relates to a temperature control concept, wherein modular secondary circuits are provided in a printing tower, one above the other at the end face of said printing tower. These temperature control circuits are coupled or can be coupled to a primary circuit, from which primary circuit fluid can be metered into the secondary circuits. In the simplest embodiment, the primary circuit can be formed by an end face circuit, in which a cooling assembly is provided. However, the end face circuit can also represent a primary circuit branch of a primary circuit which supplies one of a plurality of printing towers, and in which the cooling assembly is provided.

SUMMARY OF THE INVENTION

The object of the invention is to devise a temperature control assembly for controlling the temperature of functional parts of a printing machine, a printing system comprising a printing machine and a temperature control assembly, and a set of modules for forming a temperature control assembly.

The object is attained according to the invention by the provision of the temperature control assembly which comprises, as components, the common feed line, the fluid store and a temperature control device that controls the temperature of the temperature control fluid of the fluid store. The at least one printed machine has a temperature.

The advantages to be achieved by the invention entail, in particular, the provision of a particularly space-saving and easily installable device for controlling temperature. To accomplish this, the temperature control device, also called a temperature control assembly, comprises a plurality of independently controllable and/or adjustable temperature control sub-circuits, to which components that are to be temperature controlled can be coupled, and which can be coupled to a common feed line and return line for conducting temperature control fluid.

The temperature control assembly further comprises a temperature control agent reservoir for storing temperature control fluid that is temperature controlled, from which the common feed line proceeds. Return line and feed line can be connected and/or connectable in the end region located opposite the reservoir by means of a bypass, so that, along with the reservoir, a true primary circuit in which temperature control fluid circulates is formed. However, in another, e.g. advantageous embodiment, a bypass of this type may be omitted. Although in this case the feed and return lines do not form a circuit that is different from the temperature control circuits, in the following, in the interest of simplicity, —unless explicitly distinguished as such—the line system that serves as a common supply line to the temperature control circuits, that is, the common feed line and return line, along with the reservoir, is nevertheless referred to as the "primary circuit". In this second case, this "primary circuit" is divided into a multiplicity of parallel primary circuit branches, which are then recombined in the return. In principle, a plurality of these—"true" or "pseudo"—primary circuits, each of which feeds a multiplicity of temperature control circuits, can be provided. The temperature control fluid held in reserve is preferably fluidically uncoupled from external fluid circuits. The common feed line, the fluid store and an assembly for controlling the temperature of the temperature control fluid of the fluid store, as components of the temperature control assembly, are encompassed by said assembly, in particular by a common single-part or multi-part frame.

In a particular embodiment, the device for controlling temperature is transportable in at least partially preassembled form, e.g., as a single-part or multi-part temperature control cabinet, and can be installed at least partially preassembled in a printing system.

In a first advantageous embodiment, the device and/or the temperature control assembly is implemented for this purpose as a multi-row configuration of temperature control circuits in the smallest amount of space and with reduced installation length. In one advantageous embodiment, parts of the temperature control sub-circuits can be embodied as modular, e.g. as temperature control modules and/or plug-in units. These temperature control modules and/or plug-in units each comprise, e.g., at least means for thermally coupling the relevant temperature control circuit and, e.g., a drive means for pumping the fluid in the temperature control circuit, and interfaces for coupling line sections of the relevant temperature control module to at least the feed line and the return line. In a further development, the temperature control device can comprise a multiplicity of prepared coupling sites, e.g. in the manner of plug-in spaces, not all of which must be occupied by plug-in units.

In a second advantageous embodiment, the temperature control device and/or the temperature control assembly can be configured to meet specific requirements without substantial added expenditure using a modular construction. In this case, essential components, for example line sections and/or units for fluid temperature control, and/or independently controllable and/or adjustable temperature control devices or coupling sites for accommodating such temperature control devices, are already pre-installed in the module. This allows the size of the container that must be transported when a multiplicity of temperature control circuits are required to be held within certain limits. Of particular advantage in this case is that a set of modules of various types are provided, which can be combined as required in different numbers and/or types. Ultimately, a temperature control assembly that has been formed from modules according to requirements is assigned to a machine, preferably embodied as a printing machine. A greater total number of temperature control circuits may be provided in the modules than will ultimately be coupled to temperature control circuits to be supplied.

Each temperature control circuit is preferably embodied as a temperature control loop in which temperature control fluid circulating for the purpose of temperature control is replaced with fluid from the primary circuit—designated as "true" or "pseudo"—, i.e. from at least the common feed line. In an advantageous further development, a second temperature control fluid at a second temperature is provided in a base module or a base section. This can again be carried out in a "true" or "pseudo" second primary circuit. The temperature of at least one temperature control circuit of the temperature control assembly, in particular a temperature control circuit located in the base module or base section, can be controlled by means of fluid from this second primary circuit. The energy required to control the temperature to close to ambient temperature can thereby be saved. For at least one temperature control circuit, it can also be provided that the temperature control of said circuit can be switched between the first and second primary circuits.

Finally, it is particularly advantageous to provide a system of this type in a printing machine that is used in security printing, in particular, in banknote printing, e.g. an intaglio printing press, in particular, a printing machine that uses die stamping, and/or a multicolor printing machine, in particular for double-sided multicolor offset printing.

BRIEF DESCRIPTION OF THE DRAWINGS

Embodiment examples of the invention are illustrated in the drawings, and will be described in greater detail in the following.

The drawings show.

DESCRIPTION OF PREFERRED EMBODIMENTS

Figure 1:
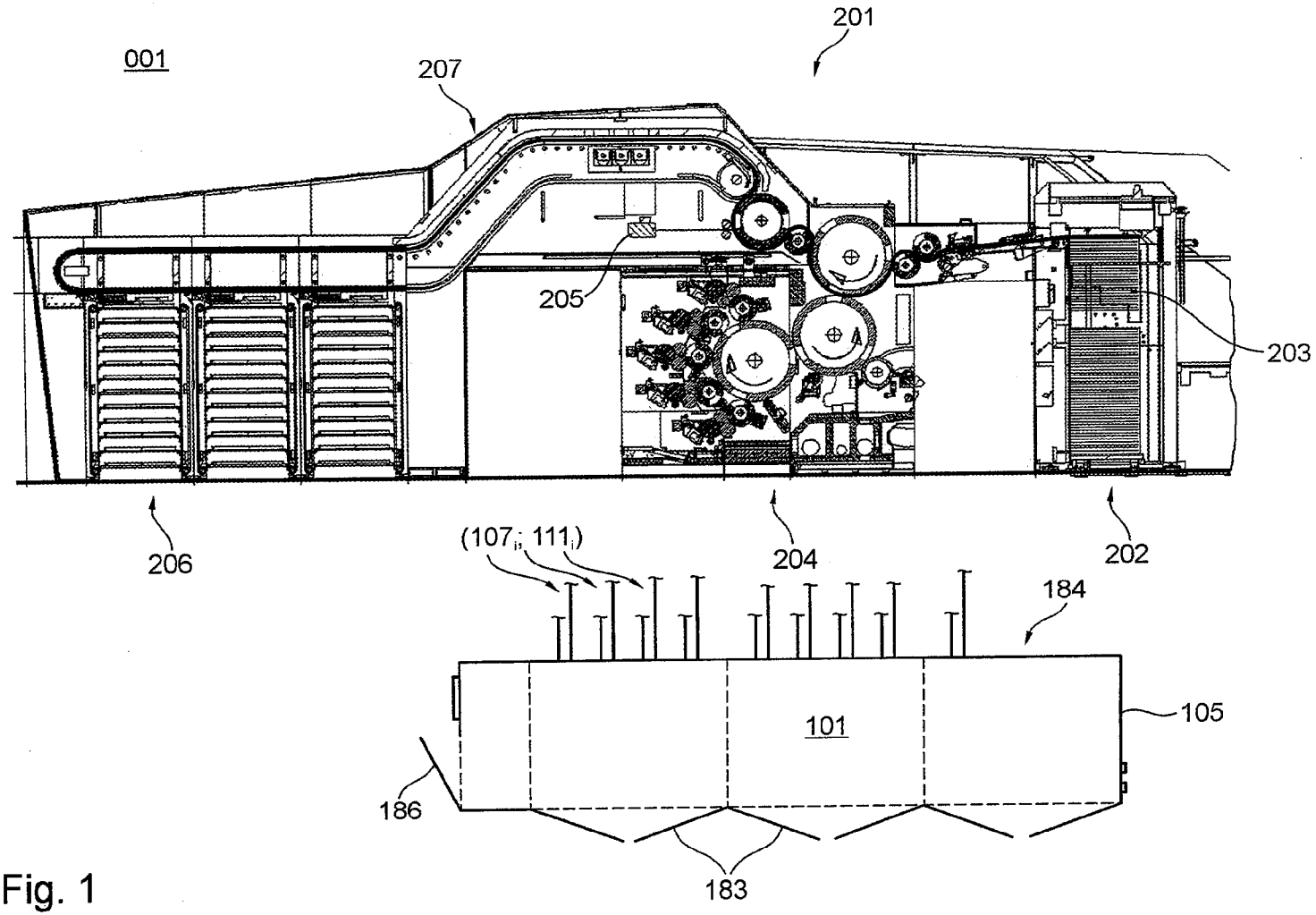
FIG. 1 a first embodiment example of a system comprising a machine configured as a printing machine and a temperature control assembly.

A system 001 for treating and/or processing material, e.g. a printing system 001, comprises, for example, one or more material treating and/or processing machines 201, e.g. one or more printing machines 201, and at least one device for controlling temperature 101, e.g. referred to and/or embodied as a temperature control assembly 101, for supplying temperature control fluid for controlling the temperature of a plurality of functional parts (205; 208; 209; 211; 217; 221; $\mathbf{222}_{d'}$; $\mathbf{222}_{d''}$; 238; 239; 231; 232; 235; 241; 242; $\mathbf{213}_d$; $\mathbf{216}_d$; $\mathbf{227}_{d'}$; $\mathbf{227}_{d''}$) and/or groups of functional parts (205; 208; 209; 211; 217; 221; $\mathbf{222}_{d'}$; $\mathbf{222}_{d''}$; 238; 239; 231; 232; 235; 241; 242; $\mathbf{213}_d$; $\mathbf{216}_d$; $\mathbf{227}_{d'}$; $\mathbf{227}_{d''}$), described in greater detail below, of one or more machines 201 of the system 001, in particular of one or more printing machines 201 (see, for example, a printing machine 201 in FIG. 1).

Figure 2:
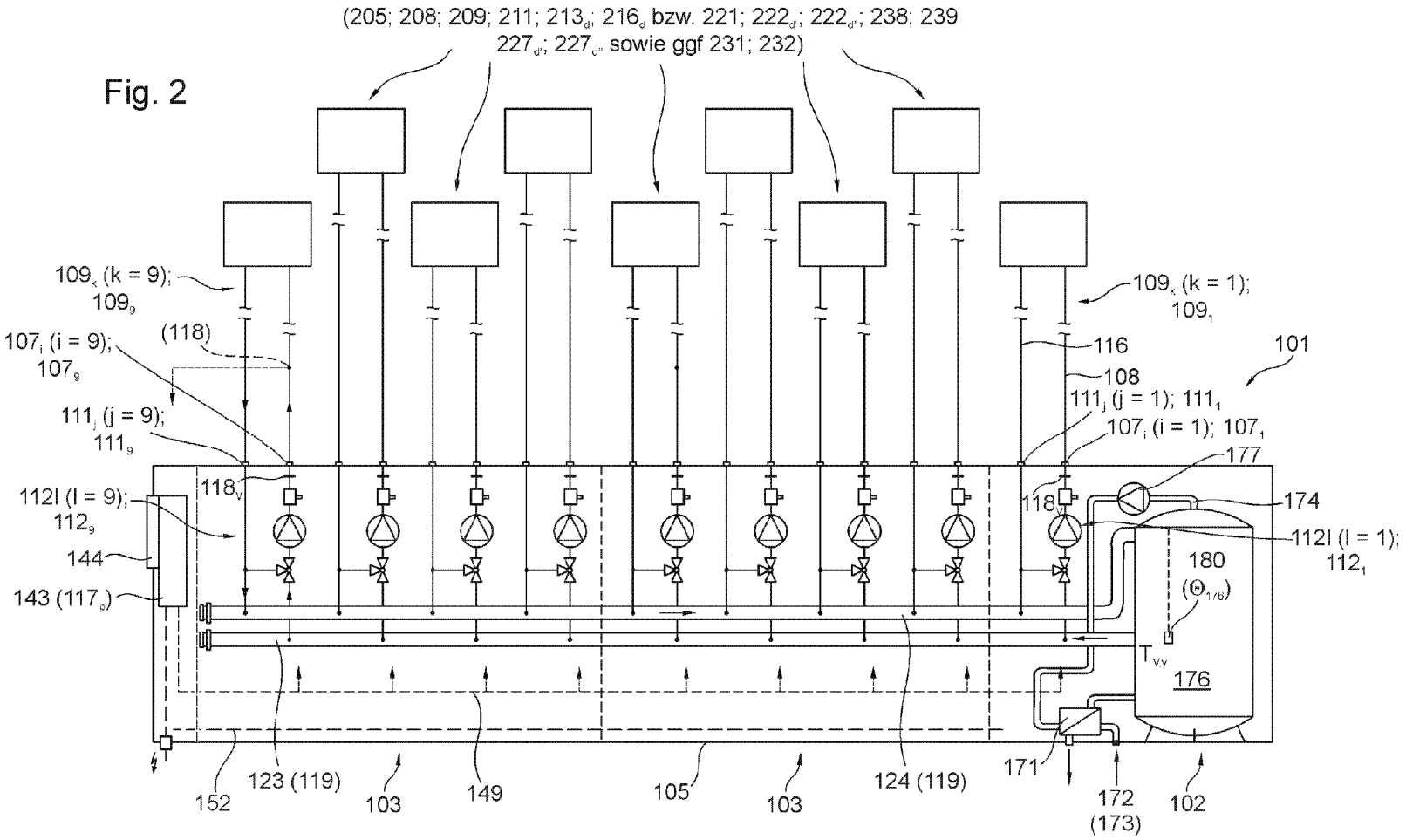
FIG. 2 an embodiment example of a temperature control assembly with supply line and fluid store.
Figure 3:
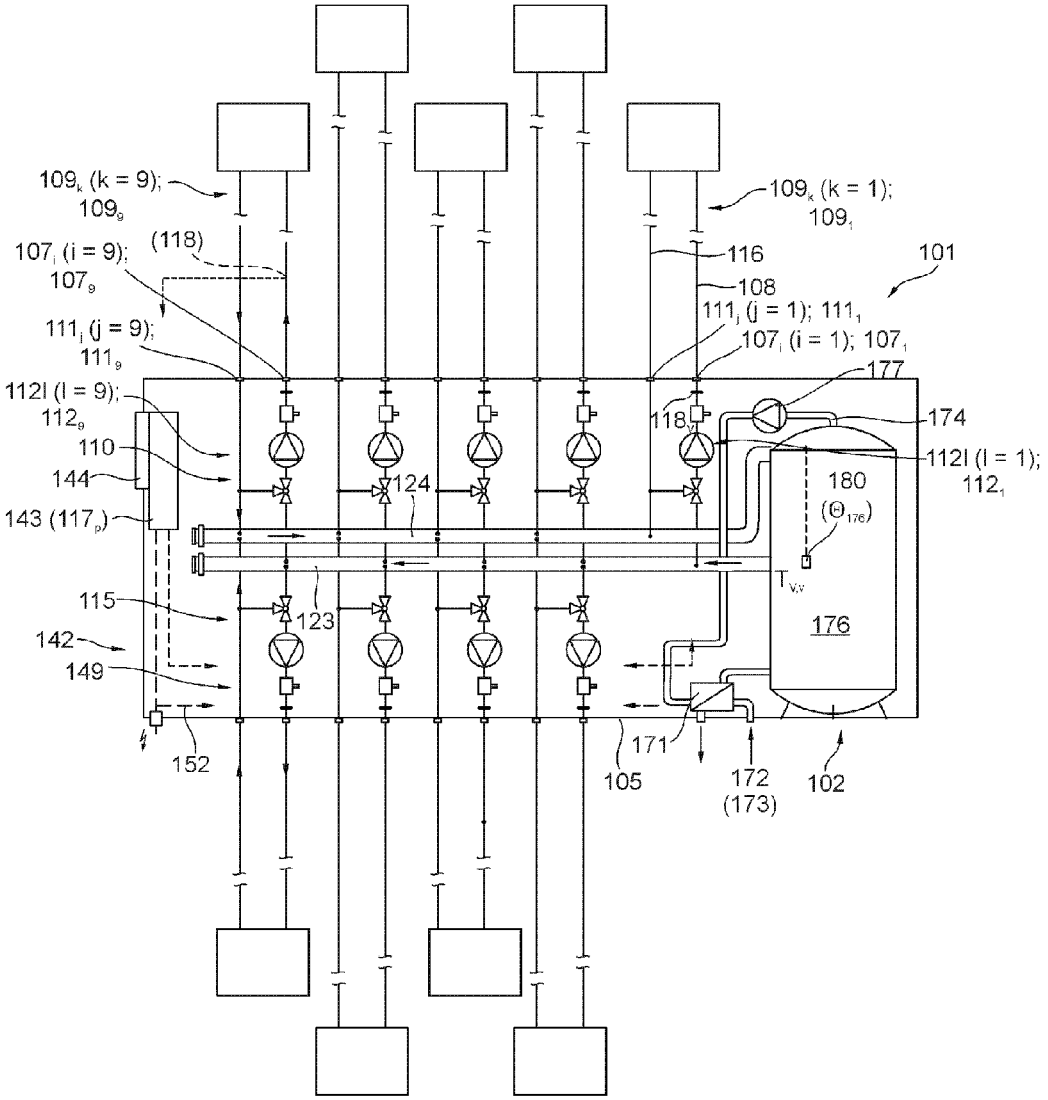
FIG. 3 an embodiment example of a multi-row temperature control assembly for controlling the temperature of components of a machine.
Figure 23:
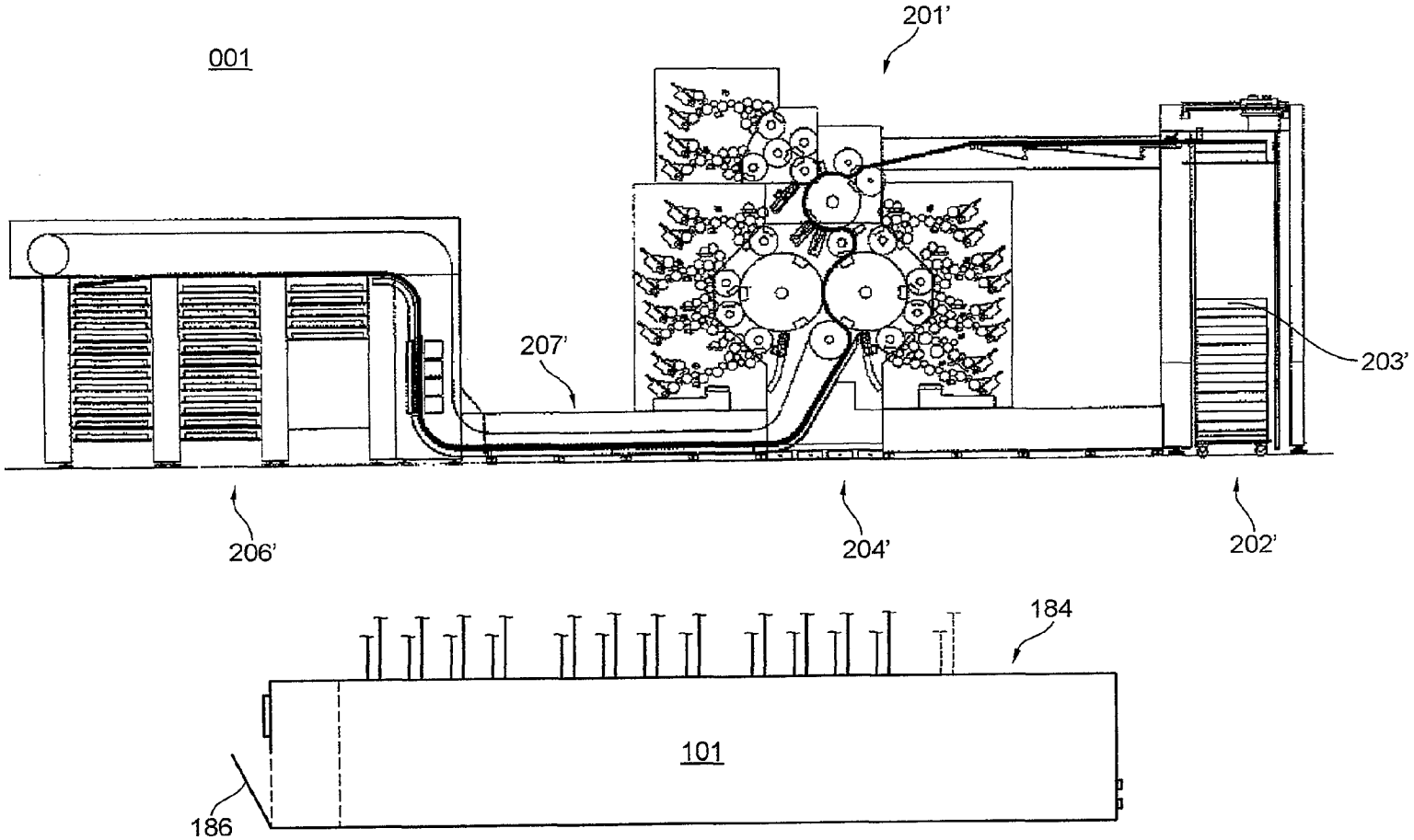
FIG. 23 a second embodiment example of a system having a printing machine that comprises a second type of printing unit, and a temperature control assembly.

The temperature control assembly 101 described in the following is advantageous particularly in an embodiment involving a printing machine 201 as described below, but can also offer particular advantages in terms of ease of installation and/or variability and/or modularity, on its own, apart from the specific application. By way of example, FIG. 1 shows a printing machine 201 comprising a feeding device 202, e.g. a sheet feeder 202, for feeding in a print substrate 203, a printing unit 204, a product delivery unit 206, e.g. a sheet delivery unit 206, and a conveyor path 207 between printing unit 204 and product delivery unit 206. In the following, unless otherwise or additionally specified, functional parts (205; 208; 209; 211; 217; 221; $\mathbf{222}_{d'}$; $\mathbf{222}_{d''}$; 238; 239; 231; 232; 235; 241; 242; $\mathbf{213}_d$; $\mathbf{216}_d$; $\mathbf{227}_{d'}$; $\mathbf{227}_{d''}$) to be temperature controlled are understood by way of example as one or more cylinders 208; 209; 211; 217 (e.g. FIG. 19) and/or cylinders 221; $\mathbf{222}_{d'}$; $\mathbf{222}_{d''}$; 238; 239 (e.g. FIG. 23) and/or rollers $\mathbf{213}_d$; $\mathbf{216}_d$ or rollers $\mathbf{227}_{d'}$; $\mathbf{227}_{d''}$ and/or frame parts 231; 232 and/or one or more measurement systems 205, e.g. inspection system 205, for monitoring and inspecting the printed product, e.g. to be temperature controlled individually or in groups, without limiting the general features thereto. In FIG. 2, such functional parts (205; 208; 209; 211; 217; 221; $\mathbf{222}_{d'}$; $\mathbf{222}_{d''}$; 238; 239; 231; 232; 235; 241; 242; $\mathbf{213}_d$; $\mathbf{216}_d$; $\mathbf{227}_{d'}$; $\mathbf{227}_{d''}$) and/or groups of parts are indicated in generalized form merely by a rectangle, and can be configured, e.g., as indicated by the reference signs shown above said rectangles. Said reference signs also apply similarly to the functional parts (consumers) indicated by rectangles in FIG. 3, although they are not listed as such therein.

Figure 4:
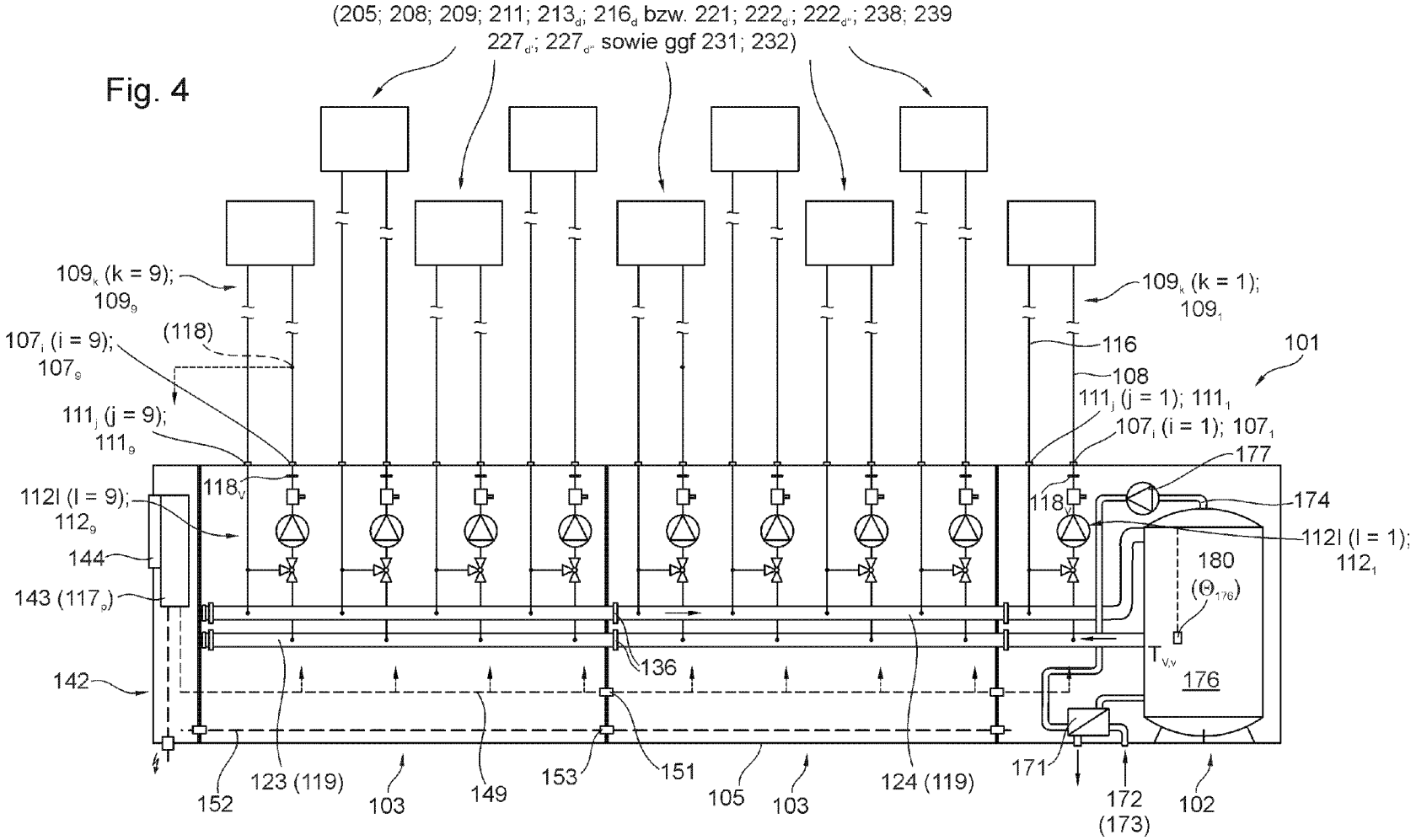
FIG. 4 an embodiment example of a modular temperature control assembly for controlling the temperature of components of a machine.
Figure 5:
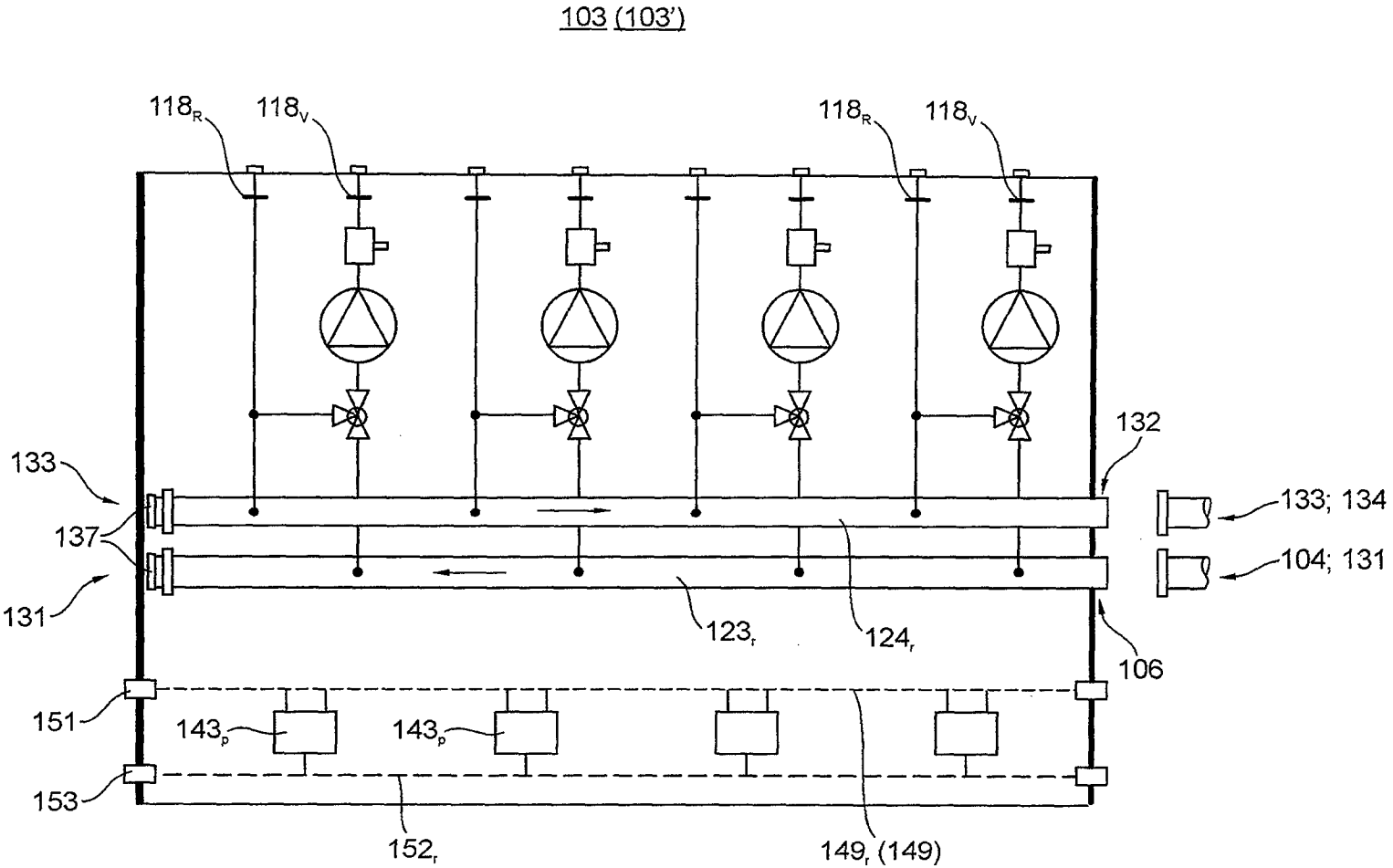
FIG. 5 a detailed representation of a connecting module.

The temperature control assembly 101 comprises a plurality of assembly-side temperature control sub-circuits $\mathbf{126}_q$ to be individually temperature controlled, each having a temperature control fluid outlet $\mathbf{107}_i$ and a temperature control fluid inlet $\mathbf{111}_j$, to which an external temperature control sub-circuit $\mathbf{109}_k$, each of which controls the temperature of one or more functional parts 208; 209; 211; 217; 221; $\mathbf{222}_{d'}$; $\mathbf{222}_{d''}$; 238; 239; 231; 232; 235; 241; 242; $\mathbf{213}_d$; $\mathbf{216}_d$; $\mathbf{227}_{d'}$; $\mathbf{227}_{d''}$, can be connected via releasable connections, in order to form a respective temperature control circuit $\mathbf{127}_q$. The temperature control sub-circuits $\mathbf{126}_q$ are thermally and/or fluidically coupleable and/or coupled on the feed side to a common supply feed line 123, or feed line 123, which conducts temperature control fluid for controlling the temperature of said sub-circuits, and on the return side to a common supply return line 124, or return line 124. The feed line 123 is line-connected to a fluid store 176, which holds temperature control fluid that is temperature controlled in reserve, for supplying the feed line. The common feed line 123, the fluid store 176, and a temperature control device 171 which controls the temperature of the temperature control fluid in the fluid store 176, as components of the temperature control assembly 101, are encompassed by said assembly, e.g. are arranged on a single-part or multi-part frame 105 of the temperature control assembly 101 (see, e.g. FIG. 1, FIG. 2, FIG. 3 and/or FIG. 4). The temperature of each of the temperature control circuits $\mathbf{127}_q$ is controlled via individually controllable and/or adjustable temperature control units $\mathbf{112}_l$.

In a first, multi-row embodiment (see, e.g. FIG. 3, FIG. 9, FIG. 15, FIG. 19, FIG. 22, FIG. 25 and/or FIG. 27), at least two parallel rows 110; 115, extending in the longitudinal direction of feed line 123 and each containing a plurality of individually controllable and/or adjustable temperature control units $\mathbf{112}_l$, are provided and/or can be provided for controlling the temperature of the temperature control circuits $\mathbf{127}_q$ in the temperature control assembly 101. In a further development which can be easily scaled, two rows 110; 115 are provided, each having a plurality of prepared coupling sites 125 for receiving and for the feed-side and return-side coupling of individually controllable and/or adjustable temperature control units (112$_l$), embodied as temperature control modules 112$_l$ (see below). In the finished temperature control assembly 101, it is not necessary for all coupling sites 125 to actually be occupied. Arrangement in a row 110; 115 is understood as the arrangement of a plurality of temperature control units 112$_l$ and/or coupling sites 125 in an alignment, in particular in a horizontal alignment, parallel to the longitudinal direction of the temperature control assembly 101. The arrangement of two or more rows 110; 115 is understood as the arrangement of a plurality of temperature control units 112$_l$ and/or coupling sites 125 in two spaced alignments, preferably parallel to one another and/or to the longitudinal direction, wherein in each alignment, two or more temperature control units 112$_l$ and/or coupling sites 125 are provided and/or arranged. In the advantageous embodiment example of the multi-row embodiment represented, two rows 110; 115 of temperature control units 112$_l$ and/or coupling sites 125 are provided, one above the other, extending parallel to the horizontal longitudinal direction of the temperature control assembly 101 and/or to feed line 123 and spaced horizontally from one another. The components of the temperature control assembly 101 may be provided in sections 102; 102'; 103; 103'; 141; 141' of the temperature control assembly 101 which are formed, for example, by a grid of cabinet sections produced by doors and/or braces, and/or by an arrangement in rows of individual cabinets or cabinet sections, e.g. connected to one another.

In a second, modular embodiment (see, e.g. FIG. 4, FIG. 10, FIG. 18, FIG. 20, FIG. 21, FIG. 24 and/or FIG. 26), the temperature control assembly 101 comprises at least two sections 102; 102'; 103; 103'; 141; 141', embodied as modules 102; 102'; 103; 103'; 141; 141', namely at least one base module 102; 102', which has the fluid store 176 and the temperature control device 171 that controls the temperature of the fluid in the fluid store 176, and a connecting module 103; 103'; 141; 141' which is or can be coupled to said base module 102; 102' and which has a plurality of individually controllable and/or adjustable temperature control units 112$_l$ for controlling the temperature of the temperature control circuits 127$_q$. Line sections 123$_r$; 124$_r$ are assigned to the base module and to the connecting module 102; 102'; 103; 103'; 141; 141', and are releasably connected or connectable to one another to form feed line 123 and return line 124. A module 102; 103, 102'; 103' in this case is preferably understood as a structural unit 102; 103, 102'; 103' which can be or is particularly preassembled, and which comprises the essential functional means and prepared interfaces for coupling to one or more additional modules 102; 103, 102'; 103'. This allows the temperature control assembly 101 to be expanded and/or reduced in size, e.g. without additional significant structural modifications, merely by adding or removing individual connecting modules 103; 103'. In a further development, the connecting module 103; 103'; 141; 141' can likewise comprise a plurality of prepared coupling sites 125. In a further development, a plurality of rows 110; 115 (as understood above) can also be provided in the connecting module 103; 103'; 141; 141'.

In the following, the preferred embodiments for, e.g., the multi-row variant, the modular variant, the embodiment of the temperature control units 112$_l$ and/or the embodiment of the coupling sites 125, and the integration into and combination with a printing machine 201; 201'; 201" will be described within the context of detailed embodiment examples 112$_l$.

The temperature control assembly 101, or in the case of the modular embodiment, preferably the base module 102; 102', comprises at least one device, not specified in greater detail at this point, for supplying temperature control fluid at a specific temperature $T_{V,v}$ that lies at least within a permissible temperature range, e.g. a temperature $T_{V,v}$ different from the ambient temperature, in particular lower than the ambient temperature, and an outlet 104, e.g. supply outlet 104, at which temperature control fluid supplied by the device can be delivered to an inlet 106, e.g. a feed-side supply inlet 106, of the feed line 123, e.g. in the case of the modular embodiment, of a feed-side line section 123$_r$ of the connecting module 103; 103' to be coupled. The temperature $T_{V,v}$ of the temperature control fluid that is and/or can be fed into the feed line 123 is, e.g., 7° to 15° C., preferably 8° to 12° C.

In the interest of simplicity, the (supply) feed line 123, in combination with the (supply) return line 124 and the fluid store 176, are referred to here as the primary circuit 119, regardless of whether said circuit is self-contained (i.e. feed line 123 and return line 124 are connected at the end opposite the fluid store) or is divided in parallel into the connected temperature control circuits 127$_q$, e.g. secondary circuits 127$_q$, without direct connection. If a connection is also provided, a "true" primary circuit 119 is formed, in which fluid circulates.

The temperature control assembly 101, or in the case of the modular embodiment preferably the connecting module 103; 103', is embodied with at least one outlet 107$_i$, e.g. temperature control fluid outlet 107$_i$, but preferably with a plurality, e.g. a number n ($n \in \mathbb{N}$, preferably $n \geq 2$), of outlets 107$_i$, e.g. fluid outlets 107$_i$ (with $l \in \mathbb{N}$, $l=1, 2 \ldots n$). The at least one temperature control fluid outlet 107$_i$ forms, or the respective temperature control fluid outlets 107$_i$ form, interfaces 107$_i$, each of which can be coupled to the inlet side of external temperature control components 109$_k$, for example to feed lines 108 of external temperature control components 109$_k$, to form temperature control circuits 127$_q$ (with $k \in \mathbb{N}$, $k=1, 2 \ldots n$). In particular, feed lines 108 of external temperature control components 109$_k$ preferably can be or are releasably connected to the outlets 107$_i$ of the connecting module 103; 103'. Temperature control fluid at a temperature $T_{T,v}$ that is different from the ambient temperature can be delivered to the respective temperature control component 109$_k$ that will be or is coupled, at the respective temperature control fluid outlet 107$_i$ or the respective temperature control fluid outlets 107$_i$. Each of the external temperature control components 109$_k$ or the temperature control circuits 127$_q$ formed thereby can control the temperature, e.g., of a functional part (208; 209; 211; 217; 221; 222$_{d'}$; 222$_{d''}$; 238; 239; 231; 232; 235; 241; 242; 213$_d$; 216$_d$; 227$_{d'}$; 227$_{d''}$) or of a plurality of functional parts as a group (208; 209; 211; 217; 221; 222$_{d'}$; 222$_{d''}$; 238; 239; 231; 232; 235; 241; 242; 213$_d$; 216$_d$; 227$_{d'}$; 227$_{d''}$), of the machine(s) 201, and/or temperature control means provided therein can be supplied with temperature control fluid. A plurality of external temperature control components 109$_k$ can be connected in parallel to the temperature control assembly 101 and/or to the connecting module 103; 103', and/or a plurality of functional parts (208; 209; 211; 217; 221; 222$_{d'}$; 222$_{d''}$; 238; 239; 231; 232; 235; 241; 242; 213$_d$; 216$_d$; 227$_{d'}$; 227$_{d''}$) and/or groups of such functional parts (208; 209; 211; 217; 221; 222$_{d'}$; 222$_{d''}$; 238; 239; 231; 232; 235; 241; 242; 213$_d$; 216$_d$; 227$_{d'}$; 227$_{d''}$) of the machine(s) 201 can be temperature controlled in parallel, and/or temperature control means provided therein can be supplied in parallel with temperature control fluid. A plurality, preferably all, of the parallel temperature control components 109$_k$ can preferably be supplied, independently of one another, with temperature control fluid at a different temperature $T_{T,v}$, at the temperature control fluid outlets 107$_i$ of the temperature control assembly 101 or of the connecting module 103; 103'. In the system 001 embodied with the temperature control assembly 101, it is not necessary for all the outlets $\mathbf{107}_i$ to be occupied, i.e. coupled to temperature control components $\mathbf{109}_k$.

Moreover, the temperature control assembly 101, or in the modular embodiment, a module 102; 103, 102'; 103', is configured with at least one inlet $\mathbf{111}_j$, e.g. temperature control fluid inlet $\mathbf{111}_j$, for the return of temperature control fluid. The temperature control assembly 101, and in the case of a modular embodiment preferably at least the connecting module 103; 103', is configured with a plurality, e.g. a number m ($m \in \mathbb{N}$, preferably $m \geq 2$), of additional interfaces $\mathbf{111}_j$ for the return of temperature control medium, in particular, temperature control fluid inlets $\mathbf{111}_j$ ($j \in \mathbb{N}$, j=1, 2 . . . n), which can be coupled to return lines 116 of external temperature control components $\mathbf{109}_k$ at the return side thereof, more particularly, with which return lines 116 of external temperature control components $\mathbf{109}_k$ can be connected or are connected, preferably releasably. An interface $\mathbf{111}_j$ embodied as a fluid inlet $\mathbf{111}_j$ for fluid return is preferably assigned to each interface $\mathbf{107}_i$ that is embodied as a temperature control fluid outlet $\mathbf{107}_i$ on the temperature control assembly 101 and/or on the same module 103; 103' (102; 102'), in which case, e.g., n=m. The inlets and outlets $\mathbf{107}_i$; $\mathbf{111}_j$ thus assigned to one another are also referred to in the following as interface pairs $\mathbf{107}_i$; $\mathbf{111}_j$, using the same index i.

Although the fluid does not need to circulate, or does not need to circulate fully, in a narrow sense, solely in the relevant "circuit", the fluid paths composed of the temperature control sub-circuits $\mathbf{109}_k$; $\mathbf{126}_q$ are nevertheless referred to here as temperature control circuits $\mathbf{127}_q$ or as secondary circuits $\mathbf{127}_q$.

For each interface pair $\mathbf{107}_i$, $\mathbf{111}_j$, or at least for each individually temperature controllable group of interface pairs $\mathbf{107}_i$, $\mathbf{111}_j$ (or for each temperature control circuit $\mathbf{127}_q$ to be formed and individually temperature controlled), one temperature control unit $\mathbf{112}_l$ (with $l \in \mathbb{N}$, preferably $l \leq n$, e.g. l=1, 2, . . . n) having at least one control element 113; 114 is preferably provided in the temperature control assembly 101 or, in the modular embodiment, in the module 102; 103, 102'; 103', wherein the temperature $T_{T,v}$ and/or the volume flow of the temperature control fluid to be delivered to the temperature control component $\mathbf{109}_k$ at the temperature control fluid outlet $\mathbf{107}_i$ can be changed by said control element or control elements, more particularly, can be controlled or adjusted in conjunction with a control and/or adjustment device that acts on the at least one control element 113; 114. The control and/or adjustment device that acts on the respective control element 113; 114 comprises analog or digital control and/or adjustment means $\mathbf{117}_p$ (with $p \in \mathbb{N}$, preferably $p \geq l$, e.g. p=l) for executing a control command or a control strategy for each temperature control component $\mathbf{109}_k$ or temperature control circuit $\mathbf{127}_q$ to be independently temperature controlled, and can then comprise one or more measuring means $\mathbf{118}_{V,1}$; $\mathbf{118}_{V,2}$; $\mathbf{118}_R$; 120 for detecting an actual value for the control and/or adjustment variable, e.g. at least one temperature control sensor $\mathbf{118}_{V,1}$; $\mathbf{118}_{V,2}$; $\mathbf{118}_R$ for detecting a temperature $\Theta_V$, $\Theta_R$ and/or at least one flow meter 120 for detecting a volume flow $\Theta_1$, for each temperature control fluid outlet $\mathbf{107}_i$ or temperature control component $\mathbf{109}_k$ or temperature control circuit $\mathbf{127}_q$ to be temperature controlled. A greater number of analog or digital control and/or adjustment means $\mathbf{117}_p$ can be prepared and/or provided in the control and/or adjustment device for the modular expansion of the system 101 than actually will be or are activated in a given implemented expansion stage. The at least one measuring means $\mathbf{118}_{V,1}$; $\mathbf{118}_{V,2}$ embodied as a temperature sensor $\mathbf{118}_{V,1}$; $\mathbf{118}_{V,2}$ can be provided on the temperature control assembly side or on the module side, or on the component side e.g. in the feed to the temperature control component $\mathbf{109}_k$ and/or to the temperature control circuit $\mathbf{127}_q$, and can emit a signal for the temperature $\Theta_{V,1}$ in the feed. A plurality of temperature sensors $\mathbf{118}_{V1}$; $\mathbf{118}_{V,2}$, $\mathbf{118}_R$, e.g. one temperature sensor $\mathbf{118}_V$; $\mathbf{118}_R$ on the assembly side or the module side or at least close to the assembly or the module, and one temperature sensor close to the functional part (not shown) can also be provided in the feed, or, preferably in addition to one or more feed-side temperature sensors $\mathbf{118}_{V1}$; $\mathbf{118}_{V,2}$, one temperature sensor $\mathbf{118}_R$ can be provided in the return of the temperature control circuit $\mathbf{127}_q$, e.g. of the external temperature control sub-circuit $\mathbf{109}_k$, or sub-circuit $\mathbf{109}_k$, and/or of the assembly-side temperature control sub-circuit $\mathbf{126}_q$, or sub-circuit $\mathbf{126}_q$. Preferably (for the remaining figures, see the example e.g. in FIG. 6), in addition to at least one feed-side temperature sensor $\mathbf{118}_{V1}$; $\mathbf{118}_{V,2}$, a return-side temperature sensor $\mathbf{118}_R$ for detecting a temperature $\Theta_R$ is provided on the module side, with the measured value from said sensor being fed, like that of the at least one feed-side temperature sensor $\mathbf{118}_{V1}$; $\mathbf{118}_{V,2}$, to the control and/or adjustment means $\mathbf{117}_p$, where it is taken into account. In a further development, two feed-side temperature sensors $\mathbf{118}_{V1}$; $\mathbf{118}_{V,2}$ can be provided, wherein, e.g., a first temperature sensor $\mathbf{118}_{V1}$ is provided downstream of the control element 113 that effects cooling, e.g. between a valve 113 or an eddy chamber 135 that is located downstream of valve 113 and pump 129, and a second temperature sensor downstream of the control element 114 that effects heating, e.g. between heating unit 114 and outlet $\mathbf{107}_i$.

In addition, or e.g. in an embodiment of the temperature control unit $\mathbf{112}_l$ in which the volume flow circulating in the temperature control circuit $\mathbf{127}_q$ is varied for the purpose of temperature control, the measuring means 120, embodied as a flow meter 120, can be provided in the feed line or the return line, wherein said flow meter 120 can be provided on the module side or the component side, in the feed or the return of temperature control circuit $\mathbf{127}_q$. In the described variant of the temperature control unit $\mathbf{112}_l$ which is temperature controlled by exchange with the primary circuit 119—"true" or "pseudo" as defined above—, i.e. by exchange with at least the common feed line 123 and the common return line 124, in addition to the temperature sensor or sensors $\mathbf{118}_{V1}$; $\mathbf{118}_{V,2}$, $\mathbf{118}_R$, a measuring means 120 embodied as a flow meter 120 can be provided in the feed line or the return line of sub-circuit $\mathbf{126}_q$, wherein said flow meter 120 is preferably provided on the module side in the feed line or the return line of temperature control component $\mathbf{109}_k$ or sub-circuit $\mathbf{126}_q$.

The signals from the measuring element or elements $\mathbf{118}_{V,1}$; $\mathbf{118}_{V,2}$; $\mathbf{118}_R$; 120 are fed, e.g. to the relevant control and/or adjustment means $\mathbf{117}_p$, where they are processed on the basis of target values and algorithms to obtain control signals that act on the control element 113; 114. In the case in which a temperature control circuit $\mathbf{127}_q$ comprises both a measuring element $\mathbf{118}_{V,1}$; $\mathbf{118}_{V,2}$ located downstream of the first control element 113 for cooling and a measuring element located downstream of the heating unit 114, the measured value from the first temperature sensor $\mathbf{118}_{V1}$ is used and processed for the control circuit that controls the first control element 113, and the measured value from the second temperature sensor $\mathbf{118}_{V2}$ is used and processed for the control circuit that controls the second control element 113.

A plurality, particularly all, of the temperature control circuits $\mathbf{109}_k$ of the e.g. single-row or multi-row temperature control assembly 101, or in the case of the modular variant of the connecting module 103; 103', a plurality, preferably all, of the modules 102; 103, 102'; 103' of the temperature control assembly 101, are coupled or can be coupled to the same feed line 123, through which temperature control fluid can flow, of a true or pseudo primary circuit 119 as described above, e.g. primary circuit 119, and can be temperature controlled via the relevant temperature control unit $\mathbf{112}_l$. In principle, the coupling can have any configuration that will allow thermal energy to be exchanged between primary circuit 119, i.e. at least feed line and return line 123; 124, and the coupled temperature control circuits and/or secondary circuits $\mathbf{109}_k$.

In one embodiment—for example involving a full fluid exchange—this can be achieved in that each coupled secondary circuit $\mathbf{109}_k$ is configured as a loop of the primary circuit 119, i.e. as a connection between feed line and return line 123; 124, via corresponding connecting lines 121; 122, e.g. line sections 121; 122, provided in the module 102; 103; 102'; 103', with temperature control fluid flowing through said secondary circuit, all of said fluid being withdrawn from the feed line 123 of the—true or pseudo—primary circuit 119, and after flowing through the secondary circuit $\mathbf{109}_k$, being returned in full to the return line 124 of the primary circuit 119. In this case, the volume flow circulating in secondary circuit $\mathbf{109}_k$, i.e. the relevant primary circuit loop, is embodied as variable and/or is varied, for example by means of control element 113, e.g. an adjustable or controllable valve 113. Said valve 113 is then preferably arranged on the module side, e.g. in one of the connecting lines 121; 122 between primary circuit feed (e.g. feed line 123) and fluid outlet $\mathbf{107}_i$ or between temperature control fluid inlet $\mathbf{111}_j$ and primary circuit return (return line 116). In this case, the module-side line sections $\mathbf{123}_r$; $\mathbf{124}_r$ between the respective branch of the primary circuit 119, i.e. at feed line and return line 123; 124, and outlet or inlet 104; 106, i.e., connecting lines 121; 122, for example in the current sense, represent an inner and/or module-side sub-circuit $\mathbf{126}_q$ ($q \in \mathbb{N}$, preferably $q \geq n$, e.g. $q=1, 2 \ldots n$) of secondary circuit $\mathbf{127}_q$ ($q \in \mathbb{N}$, preferably $q \geq n$, e.g. $q=1, 2 \ldots n$), which is formed by coupling to a temperature control component $\mathbf{109}_k$. The connecting pieces 121; 122 between primary circuit 119 and inlet and/or outlet 106; 104 and, if applicable, control element 113 together represent thermal coupling means (113, 121, 122).

In an embodiment that is completely separate fluidically, thermal coupling can be accomplished solely via heat exchange, e.g. via a heat exchanger assigned to the module 102; 103, 102'; 103', with fluid flowing through said heat exchanger on the primary circuit side, e.g. from a primary circuit loop, i.e. a connection between feed line and return line 123; 124. On the secondary circuit side, temperature control fluid circulating through the secondary circuit $\mathbf{109}_k$ flows through the heat exchanger, wherein on the secondary circuit side, a connecting piece can be provided between temperature control fluid outlet $\mathbf{107}_i$ and heat exchanger, and another provided between temperature control fluid inlet $\mathbf{111}_j$ and heat exchanger. This module-side line path between temperature control fluid inlet $\mathbf{111}_j$ and temperature control fluid outlet $\mathbf{107}_i$ then represents, e.g., the inner and/or module-side sub-circuit $\mathbf{126}_q$. The flow of heat to be transferred in this case is embodied as variable and/or is varied, for example by means of a control element 113, e.g. an adjustable or controllable valve 113, which is arranged in this module-side sub-circuit $\mathbf{126}_q$ (e.g. in one of the connecting pieces) or preferably on the primary circuit side in the flow path of the primary circuit loop, and which influences the volume flow. The connecting pieces on the primary circuit side and on the secondary circuit side, the heat exchanger and, if applicable, control element 113 represent thermal coupling means (113, 121, 122).

In a preferred embodiment, described in the following, temperature control fluid outlet $\mathbf{107}_i$ and the assigned temperature control fluid inlet $\mathbf{111}_j$ (with i=j) are fluidically connected to one another on the module side. This module-side connection (via at least one line section 128), as a module-side sub-circuit $\mathbf{126}_q$, together with the external temperature control component $\mathbf{109}_k$ coupled thereto as a second sub-circuit $\mathbf{109}_k$, forms a secondary circuit $\mathbf{127}_q$, in which the temperature control fluid, or at least part of the temperature control fluid, circulates or can circulate. To control the temperature of this secondary circuit $\mathbf{127}_q$ and/or of the temperature control fluid passing out of sub-circuit $\mathbf{109}_k$, part of the circulating fluid volume flow can be replaced as needed with fluid from the primary circuit 119, i.e. at least feed line 123, while at the same time, a corresponding volume of temperature control fluid is delivered from the temperature control circuit to return line 124. This is accomplished via a connection 121; 122, e.g. connecting line 121; 122, of secondary circuit $\mathbf{127}_q$ to the primary circuit feed, e.g. feed line 123 or line section $\mathbf{123}_r$ thereof, and to the primary circuit return, e.g. return line 124 or line section $\mathbf{124}_r$ thereof, to be assigned to the module 102; 103; 102'; 103'. In this case, in the temperature control assembly and/or in the modular variant, in each module 102, 103; 102'; 103', a temperature control fluid outlet $\mathbf{107}_i$ and a temperature control fluid inlet $\mathbf{111}_j$ are assigned to one another in such a way that, on the assembly side and/or the module side, i.e. in the temperature control assembly 101 and/or in the respective module 102; 103, 102'; 103', e.g. connecting module 103; 103' (and, if applicable, also in base module 102; 102'), said outlet and inlet are line-connected to one another—if applicable, such that said connection can be interrupted and/or terminated. The volume of fluid to be exchanged with the primary circuit 119 and/or the feed line and return line 123; 124 for the purpose of temperature control is controlled and/or adjusted, e.g., via at least one adjustable or controllable valve 113 as a control means 113, which can be actuated via control and/or adjustment means $\mathbf{117}_p$. Based on the pressure conditions in the primary and secondary circuits 119 and/or in secondary loop $\mathbf{127}_p$, the adjustable or controllable valve 113 can be provided merely as a two-way valve in one of the two connections 121; 122 to the primary circuit 119, or in a line section 128 that is located in the module-side sub-circuit $\mathbf{126}_q$ between the two branches to the primary circuit feed and return. In an advantageous embodiment—e.g. less susceptible to pressure fluctuations—, the adjustable or controllable valve 113 is embodied as a multi-way mixing valve 113, e.g. as a three-way mixing valve 113 or even a four-way mixing valve, whereby a mixing ratio of circulating fluid to primary circuit fluid to be fed in can be directly controlled and/or adjusted. The connecting pieces 121; 122 between primary circuit 119 or feed line and return line 123; 124 and secondary loop $\mathbf{127}_q$ and optionally control element 113 in this case each represent thermal coupling means 113, 121, 122. In one advantageous embodiment in which a bypass flow between feed line and return line in the opposite direction is prevented, for at least one, but preferably for all temperature control units $\mathbf{112}_l$, a component 130 that restricts flow to a predefined flow direction, in particular, a flow check valve 130, is provided in one of the connecting pieces 121; 122 or optionally in line section 128, for example.

In principle, regardless of the aforementioned nature of the thermal energy exchange, a drive means 129, e.g. a pump 129 or turbine 129, which pumps the fluid is provided on the module side in secondary circuit $\mathbf{109}_k$ or in secondary circuit $\mathbf{127}_q$ embodied as a loop.

In the case of the modular variant, line sections $\mathbf{123}_r$; $\mathbf{124}_r$ for forming the feed line and return line 123; 124 are preferably provided in the connecting module 103; 103' or in each connecting module 103; 103' of the temperature control assembly 101 and in the base module 102; 102'. Said line sections $\mathbf{123}_r$; $\mathbf{124}_r$ can be coupled to corresponding line sections $\mathbf{123}_r$; $\mathbf{124}_r$ of another connecting module 103; 103' or to the base module 102; 102', depending on the size of the system. The line section $\mathbf{123}_r$ that forms the feed is coupled in this case on the inlet side, i.e. at inlet 106, to an outlet 131 of the relevant line section $\mathbf{123}_r$ of a connecting module 103; 103' arranged upstream in the fluid path, or to the supply outlet 104 of the base module 102; 102'. The line section $\mathbf{124}_r$ that forms the return is coupled on the outlet side, i.e. at an outlet 132, to an inlet 133 of line section $\mathbf{124}_r$, which is related to the return of a connecting module 103; 103' arranged upstream in the fluid path, or to an inlet 134 for the return into the base module 102; 102'. The line sections $\mathbf{123}_r$; $\mathbf{124}_r$ to be connected are each coupled, e.g., via releasable connections 136, e.g. flange connections 136, which form interfaces 136, for example, and are merely schematically indicated.

The connecting module 103; 103', which is embodied as a component 103; 103' that can be preassembled or is preassembled, therefore comprises, e.g., a plurality of interface pairs $\mathbf{107}_i$, $\mathbf{111}_j$, e.g. prepared connection ports $\mathbf{107}_i$, $\mathbf{111}_j$, for a plurality of coupleable external temperature control circuits $\mathbf{109}_k$, the at least one control element 113; 114 and the drive means 129 for each interface pair $\mathbf{107}_i$, $\mathbf{111}_j$, line sections $\mathbf{123}_r$; $\mathbf{124}_r$ provided for feed and for return, respectively, and either—in the case of purely thermal energy exchange—a heat exchanger or—for the advantageous embodiment having at least a partial fluid exchange—connections 121; 122 to the respective line section $\mathbf{123}_r$; $\mathbf{124}_r$ of the primary circuit 119 to be formed.

In a simple embodiment of the modular temperature control assembly 101, the connecting module 103; 103' that is located opposite the base module 102; 102' can form the end with respect to the primary circuit 119, in that, e.g., the end of the respective line section $\mathbf{123}_r$; $\mathbf{124}_r$ located farthest from the base module is sealable or sealed by a preferably detachable end piece 137, e.g. a detachable cap 137. This applies similarly to the end of the feed line and return line 123; 124 located opposite the base module in a non-modular, e.g. single-row or multi-row variant of the temperature control assembly, however in that case the ends can be closed or tightly sealed prior to delivery.

In one variant, feed line and return line 123; 124 of temperature control assembly 101 or of the connecting module 103; 103' that is located the farthest from base module 102; 102' have a bypass 138, e.g. a bypass line 138, between feed line 123 or line section $\mathbf{123}_r$ downstream of the last withdrawal point and return line 124 or line section $\mathbf{124}_r$ upstream of the first return point, to ensure a minimal flow through feed line and return line 123; 124, as needed. This is advantageous, for example, prior to start-up, or in cases in which fluid consumption is low. To force a flow through the bypass 138 as needed, according to an embodiment not shown, a pump 139 that pumps the fluid in the desired direction of flow in the primary circuit 119, for example in a line section $\mathbf{123}_r$; $\mathbf{124}_r$ of base module 102; 102', can be provided.

In a preferred embodiment, a pump 139 of this type for inducing a forced flow is provided or can be provided in the bypass line 138 arranged between the ends of the feed line and return line 123; 124 that are opposite the fluid store.

In one variant of the modular temperature control assembly 101, bypass line 138 and pump 139 can be installed or are installed and/or configured for installation after market, e.g. on-site, e.g. in place of cap 137 in a connecting module 103; 103' that is otherwise configured in the standard manner. In this case, the part of the temperature control assembly 101 that forms the end with respect to the primary circuit 119 is formed by modifying and/or adding to an end module 103 that is otherwise configured in the standard manner. However, in another variant, an end section 141; 141'; 142, e.g. a module 141; 141'; 142 embodied as an end module 141; 141'; 142, can be provided for temperature control assembly 101, which end section, as a component which can be preassembled or is preassembled 141; 141'; 142, already comprises bypass 138 and pump 139 as fixed components. In this case, e.g. a connecting module 141 modified in the aforementioned manner prior to delivery can be provided as an end module 141; 141', for example. However, an end module 142 may also be provided which in fluidic terms provides only the end of the primary circuit 119, e.g. bypass line 138 and pump 139, and is configured, e.g. without interfaces $\mathbf{107}_i$, $\mathbf{111}_j$ for temperature control circuits $\mathbf{109}_k$ and/or without temperature control units $\mathbf{112}_l$. An end module 142 of this type can also comprise, for example, an adjustment and/or control device 143 assigned, as a unit if applicable, to the implemented temperature control assembly 101 (see below), and/or can comprise an operator interface 144, e.g. with an input option and/or display.

For the non-modular variant of temperature control assembly 101, an end section 142 can also be provided, which comprises an adjustment and/or control device 143 that is assigned to and/or superposed over the implemented temperature control assembly 101, if applicable as a unit (see below), and/or an operator interface 144, e.g. with an input option and/or display. In this case, this end section 142 can also be embodied as modular, as connectable or connected to the remaining components of the temperature control assembly and if necessary as a detachable equipment cabinet 142.

At least one temperature control unit, more particularly, at least temperature control unit $\mathbf{112}_l$ of temperature control assembly 101 that lies closest to fluid store 176, or in the modular case, at least one temperature control unit $\mathbf{112}_l$ of module 102; 103, 102'; 103' or of at least one of a plurality of modules 102; 103, 102'; 103', in particular of the or of each connecting module 103; 103', comprises a control element 114 embodied as a heating unit 114, by which temperature control fluid to be delivered into temperature control circuit $\mathbf{109}_k$ can be heated. In one advantageous embodiment of temperature control assembly 101 and/or of connecting module 103; 103', each temperature control unit $\mathbf{112}_l$ of temperature control assembly 101 and/or of module 103 is embodied as fittable or fitted with a heating unit 114. For this purpose, a heating unit 114 is provided or at least can be provided in an assembly-side or module-side fluid-conducting line of the temperature control circuit $\mathbf{127}_q$, particularly in a line section 128; 146; 147 of inner sub-circuit $\mathbf{126}_q$, preferably in line section 146 of sub-circuit $\mathbf{126}_q$, which lies between pump 129 and temperature control fluid outlet $\mathbf{107}_i$. In an embodiment of temperature control assembly 101 that is modular in terms of heating power, an interface 148 is already provided, for example, in the relevant line section 128; 146; 147 of temperature control unit $\mathbf{112}_l$, to which interface a heating unit 114 can be connected and/or which can be fitted with a heating unit 114. In an advantageous further development, interface 148 is embodied, for example, to be fitted with a plurality of heating units 114, e.g. with a plurality of units 114 embodied as heating rods 114. The heating power can thereby be optimally adjusted to the heating power requirements of the temperature control circuit $\mathbf{127}_q$ in question. If a temperature control circuit $\mathbf{127}_q$ or the functional part (205; 208; 209; 211; 217; 221; $\mathbf{222}_{d'}$; $\mathbf{222}_{d''}$; 238; 239; 231; 232; 235; 241; 242; $\mathbf{213}_d$; $\mathbf{216}_d$; $\mathbf{227}_{d'}$; $\mathbf{227}_{d''}$) to be temperature controlled therewith does not require heating, fitting the assigned sub-circuit $\mathbf{126}_q$ with a heating unit 114 can be dispensed with, and in one embodiment, an interface that is open as a result can be closed, for example, or in another embodiment, a bypass or dummy tube can be provided.

In a preferred first embodiment specified in greater detail below (e.g. in reference to FIG. 12), the aforementioned control and/or adjustment means $\mathbf{117}_p$, e.g., electronic circuits $\mathbf{117}_p$ and/or algorithms $\mathbf{117}_p$, which are assigned to the temperature control fluid outlets $\mathbf{107}_i$ and/or temperature control components $\mathbf{109}_k$ and/or sub-circuits $\mathbf{126}_q$ or to temperature control unit $\mathbf{112}_l$, can each be provided structurally and/or spatially separately from one another in separate adjustment and/or control devices $\mathbf{143}_p$ ($p \in \mathbb{N}$, preferably $p \geq n$, e.g. q=1, 2, . . . n), hereinafter referred to as control device $\mathbf{143}_p$, or in a second embodiment, the control and/or adjustment means $\mathbf{117}_p$ assigned to a respective section 102; 102'; 103; 103'; 141; 141' or module 102; 102'; 103; 103'; 141; 141' of temperature control assembly 101 can be provided together in an adjustment and/or control device 143 or in a combined group of control devices $\mathbf{143}_p$ assigned to the respective section 102; 102'; 103; 103'; 141; 141' or module 102; 102'; 103; 103'; 141; 141', or in a third embodiment, the control and/or adjustment means $\mathbf{117}_p$ of all the temperature control units $\mathbf{112}_l$ or sections or modules 102; 102'; 103; 103'; 141; 141' can be provided in a common adjustment and/or control device 143 and can span the entire temperature control unit $\mathbf{112}_l$ or all the modules 102; 102'; 103; 103'; 141; 141'; 142 provided for temperature control assembly 101.

For controlling and/or adjusting the sub-circuits $\mathbf{126}_q$ of temperature control assembly 101, a signal connection 149 that spans all of temperature control units $\mathbf{112}_l$, or in the modular variant, e.g. a line system 149 that spans all the modules 102; 102'; 103; 103'; 141; 141'; 142, for example a bus system 149 or network system 149, preferably a profibus system 149, can preferably be provided, wherein in the modular variant, sub-sections $\mathbf{149}_r$, e.g. signal line sections $\mathbf{149}_r$, that are assigned to the modules 102; 102'; 103; 103'; 141; 141'; 142 are preferably releasably connected and/or connectable between the modules 102; 102'; 103; 103'; 141; 141'; 142 via interfaces 151.

In the case of the third embodiment, the control elements 113; 114 and/or the measuring means $\mathbf{118}_v$; $\mathbf{118}_R$; 120 of all the temperature control units $\mathbf{112}_l$ or modules 102; 102'; 103; 103'; 141; 141' are signal-connected to line system 149 or to the sub-section $\mathbf{149}_r$ of line system 149 that spans all the modules, or are "looped into" said line system 149, embodied for example as a bus system or network system 149, so that signals processing and/or control and/or adjustment can be carried out by the higher level adjustment and/or control device 143, e.g. control device 143, that comprises control and/or adjustment means $\mathbf{117}_p$. In addition to executing the processes that are run in control and/or adjustment means $\mathbf{117}_p$, higher level control device 143 can perform, e.g., a higher level monitoring of measured values from the sub-circuits $\mathbf{126}_q$ and/or can predefine target values for control and/or process parameters, and/or can act as a master for operation of the bus system or network system 149 and/or for receiving and processing process variables $P_M$ (e.g. predefined or measured status parameters, such as the current machine speed, for example) and/or commands obtained from the printing machine 201; 201'; 201" or from the control center thereof.

In the case of the second embodiment, the control elements 113; 114 and/or the measuring means $\mathbf{118}_v$; $\mathbf{118}_R$; 120 of each section 102; 102'; 103; 103'; 141; 141'; 142 or of each module 102; 102'; 103; 103'; 141; 141'; 142 are signal-connected in groups in the respective section 102; 102'; 103; 103'; 141; 141'; 142 or module 102; 102'; 103; 103'; 141; 141'; 142 to the control device $\mathbf{143}_p$ or group of control devices $\mathbf{143}_p$ that relate to said section or are assigned to said module, and said control devices are in turn signal-connected to the line system 149 or to the sub-section $\mathbf{149}_r$ of line system 149 that spans all the modules, or are "looped into" said system or sub-section, and are thereby signal-connected, if applicable, to an additional higher level control device 143. Higher level control device 143 serves in this case e.g. to monitor measured values from the temperature control units $\mathbf{112}_l$ and/or sub-circuits $\mathbf{126}_q$ and/or to predefine target values for adjustment and/or process parameters and/or as masters for operation of the bus system or network system 149 and/or for the higher level receiving and processing of process variables and/or commands obtained from the printing machine 201; 201'; 201" or from the control center thereof.

In the preferred case of the third embodiment, the control elements 113; 114 and/or the measuring means $\mathbf{118}_V$; $\mathbf{118}_R$; 120 of all temperature control units $\mathbf{112}_l$ or temperature control circuits $\mathbf{127}_q$ of temperature control assembly 101 and/or of the respective module 102; 102'; 103; 103'; 141; 141' are signal-connected to a separate allocated adjustment and/or control device $\mathbf{143}_p$, or control device $\mathbf{143}_p$, for each sub-circuit $\mathbf{126}_p$ to be adjusted and/or controlled, with said control device in turn being signal-connected to the line system 149 or to the relevant sub-section $\mathbf{149}_r$, or preferably "looped into" said line system or sub-section, and optionally signal-connected thereby to, e.g., an additional, higher level control device 143. In this case, the higher level control device 143 can in turn be used for performing e.g. higher level monitoring of measured values from the sub-circuits $\mathbf{126}_q$ and/or for predefining target values for control and/or process parameters and/or as masters for operating the bus system or network system 149 and/or for the higher level receiving and processing of process variables and/or commands obtained from the printing machine 201; 201'; 201" or from the control center thereof, which impact the operation of the electronic circuits $\mathbf{117}_p$ and/or algorithms $\mathbf{117}_p$ (for the remaining representations, see the examples, e.g. in FIG. 3 and FIG. 4, and the description below referring to FIG. 12 by way of example).

In a manner similar to signal connection 149, which spans all the temperature control circuits and/or all the modules, electric power can be supplied via a common supply line 152, wherein in the modular variant, sub-sections $\mathbf{149}_r$; $\mathbf{152}_r$ assigned to the modules 102; 102'; 103; 103'; 141; 141'; 142 are preferably releasably connected or connectable between the modules 102; 102'; 103; 103'; 141; 141'; 142 via interfaces 153.

As mentioned above, base module 102; 102' comprises a temperature control device for supplying temperature control fluid to primary circuit 119. In principle, a temperature control device 171 for controlling the temperature of the fluid can have any embodiment that will enable it to exchange thermal energy with the primary circuit fluid, in particular for cooling the primary circuit fluid. Temperature control device 171 for cooling the fluid is preferably embodied as a temperature control device 171 based solely on thermal contact, that is, without fluid exchange. Said device can be, for example, a cold source 171 (or a heat sink), e.g. a unit, e.g. a refrigerator, provided in temperature control assembly 101 or in base module 102; 102' and assigned to temperature control assembly 101 or base module 102; 102', with said refrigerator controlling the temperature of the primary circuit fluid, in particularly cooling it, in the manner of a heat exchanger by means of thermal contact therewith. In an advantageous embodiment, device 101 comprises a heat exchanger 171 as a temperature control device 171 for controlling the temperature of the fluid, in particular cooling it, via which, on one side, e.g. the side of primary circuit 119 in the sense described above, temperature control fluid, e.g. primary circuit fluid, to be temperature controlled flows or will flow, and on the other side, a temperature control medium 173 flows or will flow, said temperature control medium coming, e.g., from an external source 172, e.g. a heat source or cold source, not assigned directly to temperature control assembly 101. This source 172 can be, for example, a cooling device 172, e.g. a refrigerator 172, arranged in a different location and also provided for other purposes, for example, by which a cooling fluid, for example, as temperature control medium 173, is supplied at a temperature below the ambient temperature, e.g. below 15° C., particularly below 12°.

Irrespective of the embodiment of the temperature control device 171, said device can in principle be arranged in the feed line or the return line 123; 124 or in fluid store 176, i.e. in the flow that flows through primary circuit 119 for the purpose of controlling temperature. In one advantageous embodiment, however, the temperature control device 171 is not arranged directly in the flow path of the primary circuit flow that controls the temperature of the temperature control circuits $\mathbf{127}_q$, and is instead arranged in a bypass 174, also referred to as a charging pump circuit 174, of a conditioning circuit, which bypass extends parallel to the feed line 123 from a fluid reservoir, e.g. fluid store 176, and leads back into said reservoir. Fluid store 176 serves as a reservoir for temperature controlled primary circuit fluid, which can be continuously or discontinuously temperature controlled via the bypass flow by means of temperature control device 171. A pump 177, also referred to as a charging pump 177, is provided for this purpose in the bypass flow. The temperature control fluid for the bypass flow is preferably withdrawn from an upper region of fluid store 176 and returned to a region located at a lower point. Conversely, the temperature control fluid for primary circuit 119 or for feed line 123 is withdrawn from a region located at a lower point and returned to fluid store 176 at a higher point. The temperature $\Theta_{176}$ of the fluid present in the withdrawal region of fluid store 176 corresponds substantially to the temperature $T_{V,v}$ of the temperature control fluid fed into or to be fed into primary circuit 119, and is, e.g., 7° to 15° C., preferably 8° to 12° C.

In this case, components that are installed in the modular base module 102; 102' prior to delivery are, e.g., at least line sections $\mathbf{123}_r$; $\mathbf{124}_r$ for the feed line and return line 123; $\mathbf{126}_q$ and at least temperature control device 171, which is in indirect or direct active connection with the primary circuit fluid for controlling the temperature thereof. Prior to delivery, module 102 preferably also already comprises fluid store 176 and bypass 174 with pump 177, and in the variant comprising a temperature control device 171 that is embodied as a heat exchanger 171, said module comprises line sections proceeding from the heat exchanger 171, for example, with ports for connection to lines leading to an external source 172.

In an advantageous further development of temperature control assembly 101 or of the respective module 102'; 103'; 141', e.g. of base module 102' and/or of one or more connecting modules 103', in addition to the temperature control fluid at the first temperature level, a temperature control fluid at a second temperature level is supplied, with which the temperature of at least one temperature control circuit $\mathbf{127}_q$ or one temperature control unit $\mathbf{112}_l$ of temperature control assembly 101 or of at least one module 102; 103; 141 can be controlled, and can preferably be fluidically coupled in the manner described above via a valve 113. In this case, the temperature of the fluid can be controlled by means of a second temperature control device 178. A second supply feed line 156, or feed line 156, and a second supply return line 157, or return line 157, leads to this at least one temperature control circuit $\mathbf{127}_q$. Said lines can be connected via a bypass as described above, forming a "true" circuit, or can each be sealed at the end, forming a "pseudo" circuit. Independently thereof, the line path on the supply side of temperature control circuit $\mathbf{127}_q$—as already in the case of the first temperature control fluid flow—is referred to as the second primary circuit 154. Only one or two temperature control circuits $\mathbf{127}_q$, e.g. temperature control circuits $\mathbf{127}_q$ of components which have higher permissible operating temperatures, can be coupled to this second primary circuit 154, for example (see below).

In the case of the modular configuration, the temperature control fluid of the second primary circuit 154 is preferably likewise provided by the correspondingly configured base module 102', or in the other case, e.g. in a base section 102' or base cabinet. For this purpose, said configuration comprises a second device, not specified in greater detail here, for supplying temperature control fluid at a second temperature $T_{V2,v}$ that lies at least within a permitted temperature range, e.g. a temperature $T_{V2,v}$ that is different from the temperature $T_{V,v}$ of the fluid supplied for the first primary circuit 119, e.g. a temperature $T_{V2,v}$ that is closer to the ambient temperature. In the case of a modular construction—comparable to the conditions of first primary circuit 119—the fluid can be delivered at an outlet, not specified in greater detail, to an inlet not specified in greater detail, e.g. to a feed side supply inlet, of a connecting module 103' to be coupled. A line section $\mathbf{156}_t$; $\mathbf{157}_t$ is then assigned, e.g. to each module 102'; 103' which is embodied with at least one temperature control circuit $\mathbf{127}_q$ or sub-circuit $\mathbf{126}_q$ that can be coupled to the second primary circuit 154, with said line sections, optionally together with one or more line sections $\mathbf{156}_t$ of one or more additional modules 102'; 103', together forming the feed line 156 of the second primary circuit 154. A line section $\mathbf{157}_t$ is likewise assigned to each of these modules 102'; 103', with said line sections, optionally together with one or more line sections $\mathbf{157}_t$ of one or more additional modules 102'; 103', together forming the return line 157 of the second primary circuit 154.

In one embodiment, one or more temperature control circuits $\mathbf{127}_q$ or sub-circuits $\mathbf{126}_q$ of temperature control assembly 101, or of a line section $\mathbf{156}_t$; $\mathbf{157}_t$ of the module comprising the second primary circuit 154, are coupleable or coupled, in particular fluidically connectable or connected, solely to the second primary circuit 154, wherein the other temperature control circuit or circuits $\mathbf{109}_k$ and/or sub-circuits $\mathbf{126}_q$ can be coupleable or coupled, in particular fluidically connectable or connected, solely to the first primary circuit 119, for example.

Figure 11:
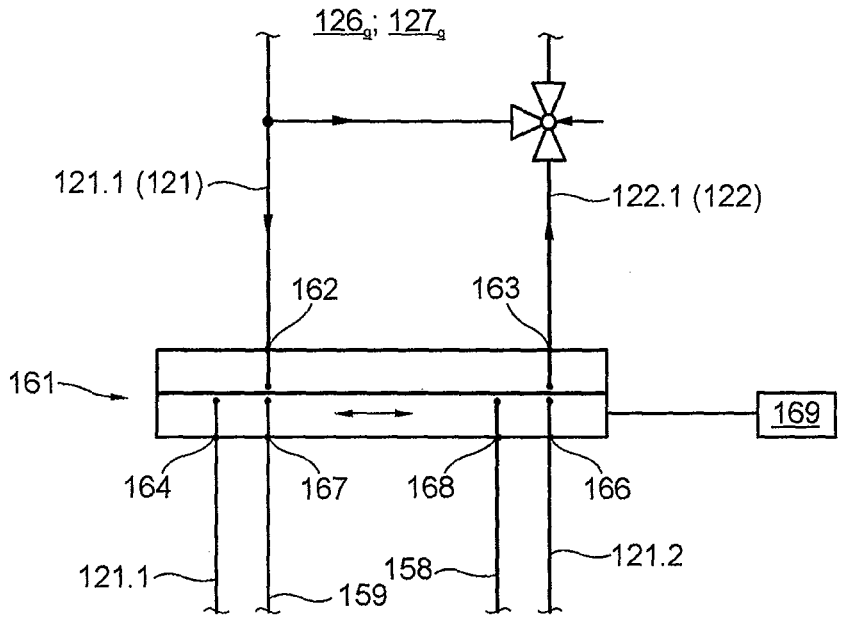
FIG. 11 a detailed representation of a valve block for switching between coupling to a first and to a second primary circuit.

In a further development, however, at least one of the temperature control circuits $\mathbf{127}_q$ or sub-circuits $\mathbf{126}_q$ of temperature control assembly 101 or of module 102'; 103' that comprises the line section $\mathbf{156}_t$; $\mathbf{157}_t$ of the second primary circuit 154 can alternatively be coupleable or coupled, in particular fluidically connectable or connected, to the first and the second primary circuits 119; 154. For this purpose, e.g. a connection 158; 159, e.g. via a connecting line 158; 159, of the relevant secondary circuit $\mathbf{127}_q$, each is connected to the feed of the second primary circuit 154, e.g. feed line 156 or line section $\mathbf{156}_6$ and to the return of the second primary circuit 154, e.g. return line 157 or line section $\mathbf{157}_t$. A switch between supplying temperature control circuit $\mathbf{127}_q$ or sub-circuit $\mathbf{126}_q$ with fluid from the first or the second primary circuit 119; 154, or a switch between fluid exchange with fluid from the first or the second primary circuit 119; 154 can be accomplished, in principle, using any controllable valves and/or flaps in the connecting lines 121; 122; 158; 159. In an advantageous variant in which a safe and correlated, e.g.

positively coupled switch between the two primary circuits 119; 154 is ensured, the two line sections 121.1; 122.1 of connecting lines 121; 122, which lead as feed line and return line into temperature control circuit $\mathbf{109}_k$ or sub-circuit $\mathbf{126}_q$, are connected at two connections 162; 163 of the same valve block 161, which are in turn alternatively fluidically connected at two connections 164; 166 within the valve block 161, depending on the switching state of the valve block 161, to line sections 121.2; 122.2 that lead to the feed and the return of the first primary circuit 119, and at two additional connections 167; 168 to connecting lines 158; 159, which lead to the feed and the return of the second primary circuit 154 (see, e.g., FIG. 11). Valve block 161 is embodied in the manner of two Y-switches, which are mechanically positively coupled by, e.g., a cylindrical slide valve rod, with the dead-center position thereof being monitored, for example. The flow through the two Y-switches is antiparallel in this case. Valve block 161, in particular a movable block part of the two cooperating block parts, can be connected by a control element 169, e.g. an actuator 169 that is based on magnetic forces.

The statements in this description that relate to first primary circuit 119, to the configuration of the temperature control circuits $\mathbf{127}_q$, to the nature of the thermal coupling to primary circuit 119, to control and/or adjustment, and to the coupling of the machine 001 to individual or grouped functional parts (205; 208; 209; 211; 217; 221; $\mathbf{222}_{d'}$; $\mathbf{222}_{d''}$; 238; 239; 231; 232; 235; 241; 242; $\mathbf{213}_d$; $\mathbf{216}_d$; $\mathbf{227}_{d'}$; $\mathbf{227}_{d''}$), along with the statements that relate to the second temperature control circuit 154, apply similarly to the embodiment of temperature control assembly 101 or of module 102'; 103'; 141' which comprises two primary circuits 119; 154. Conversely, for embodiments having a temperature control assembly 101 that comprises two primary circuits 119; 154, or having modules 102'; 103'; 141' that comprise two primary circuits 119; 154, the statements made by way of example in reference to the embodiment having a first primary circuit 119 apply—unless said statements are specific to the variant. In the figures, in some cases, the reference signs followed by apostrophes and placed between parentheses are indicated as alternatives for the section 102'; 103'; 141' and/or for the module 102'; 103'; 141', and in FIG. 6, the transferability is indicated by connecting sections 121.1 and 122.1.

In the embodiment of temperature control assembly 101 or of module 102'; 103'; 141' which has a second primary circuit 154, base module 102' has a second device for supplying temperature control fluid to the second primary circuit 154. In principle, the temperature control device 178 for controlling the temperature of the fluid in the second primary circuit 154 can have any embodiment that will allow it to exchange thermal energy with the primary circuit fluid of the second primary circuit 154, in particular to cool the primary circuit fluid. Said device can be, for example, a cold source 178, e.g. a refrigerator provided in base module 102', and assigned specifically to base module 102', which cold source controls the temperature of the primary circuit fluid in the second primary circuit 154, in particular cooling it, in the manner of a heat exchanger, by thermal contact therewith.

In one advantageous embodiment, however, the device 101 comprises a heat exchanger 178 as a temperature control device 178 for controlling the temperature of the fluid in the second primary circuit 154, particularly cooling said fluid, wherein the primary circuit fluid to be temperature controlled flows or will flow through said heat exchanger on the primary circuit 154 side, and a temperature control medium 179 flows or will flow through said heat exchanger on the other side, said temperature control medium coming, e.g., from an external source 181 that is not assigned specifically to temperature control assembly 101. In principle, this source 181 can be a heat source and/or particularly a cold source. However, in a particularly advantageous embodiment, source 181 is provided by a connection 181 to a mains system for water, e.g. a fresh water or process water system, through which tap water, for example, as the temperature control medium 179, is supplied at a temperature within the range that is customary for tap water.

In cases in which some of the consumers, that is, some of the units and/or functional components to be connected to temperature control assembly 101 for the purpose of temperature control, e.g. a unit and/or a functional component that is at an operating temperature above the ambient temperature, must be cooled from a higher temperature to a lower temperature that is still above the ambient temperature, the second primary circuit 154 and at least one temperature control circuit $\mathbf{127}_q$ or sub-circuit $\mathbf{126}_q$ having an aforementioned coupling to said second primary circuit 154 can be provided in temperature control assembly 101 or in at least one of modules 102'; 103'. A coupling of this temperature control circuit $\mathbf{109}_k$ or sub-circuit $\mathbf{126}_q$ or of these temperature control circuits $\mathbf{109}_k$ or sub-circuits $\mathbf{126}_q$ to the first primary circuit 119 can either be dispensed with for cost reasons or additionally provided in order to increase the variability of module 102'. In addition to being coupled to the second primary circuit 154, in order to rapidly achieve operational readiness the temperature control circuit $\mathbf{127}_q$ or sub-circuit $\mathbf{126}_q$ of a consumer of this type which has a high operating temperature can comprise a heating unit 114, e.g. a heating unit 114 that is embodied as sturdier than other temperature control circuits $\mathbf{127}_q$ or sub-circuits $\mathbf{126}_q$, or is provided in multiples (see above).

In a modular temperature control assembly 101 that is provided for use in a system 001 or in a machine 201; 201', for example, one base module and one connecting module 102'; 103' may be provided for the two primary circuits 119; 154, and connected thereto, along with one or more connecting modules 103; 141 provided solely for the first primary circuit 119, and optionally a specifically designated end module 141; 142.

Using temperature control fluid to control the temperature of a consumer which has a high operating temperature and which is coupled thermally and particularly fluidically to the primary circuit fluid of the second primary circuit 154 allows a savings of cooling power, which would otherwise be required for cooling the fluid circulating in the first primary circuit 119, at least on the feed side, to the temperature level below the ambient temperature.

Figure 12:
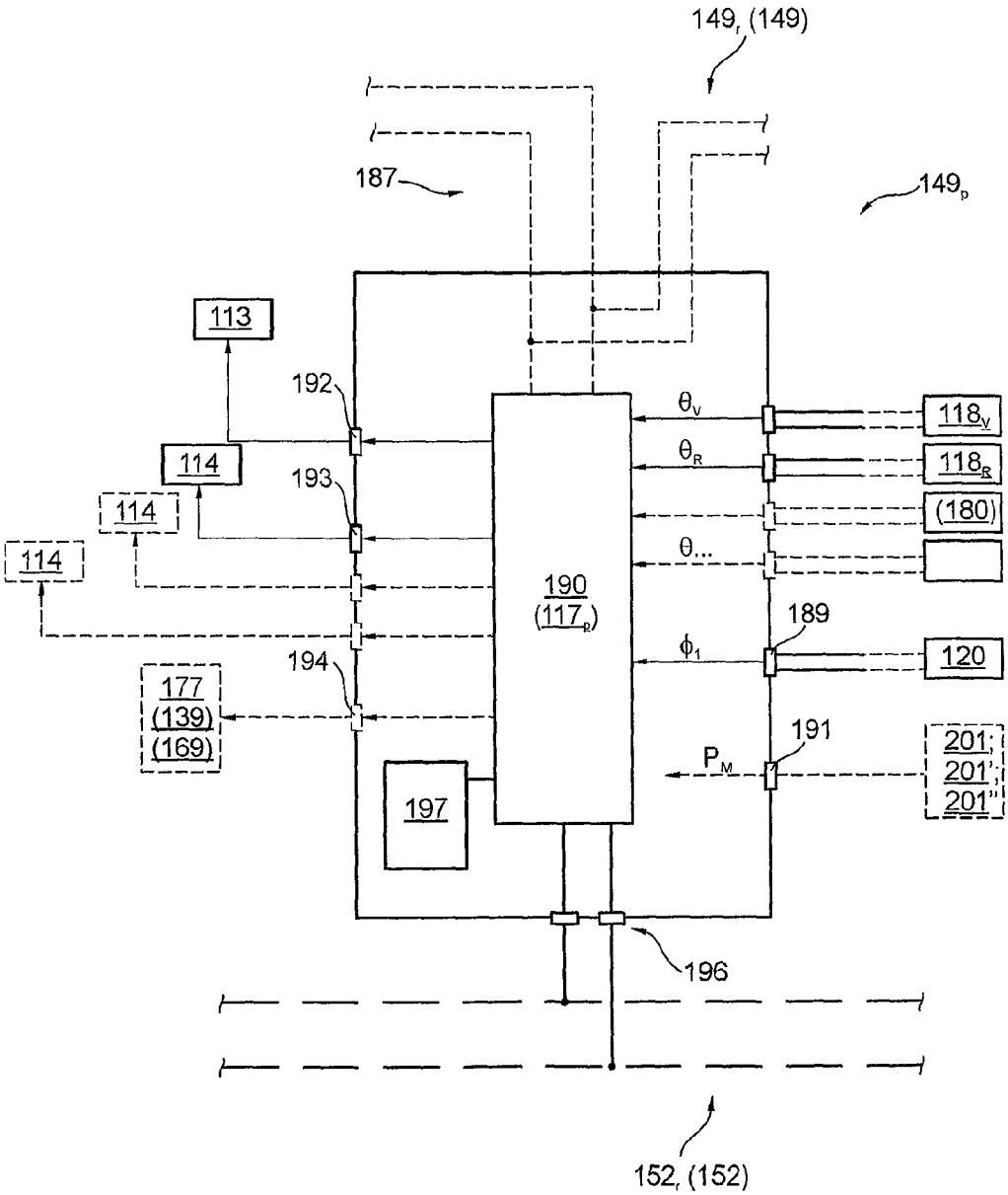
FIG. 12 a schematic representation of the embodiment of an adjustment and/or control device embodied as an adjustment and/or control module.

As described above, in a preferred first embodiment of the device for controlling and/or adjusting the sub-circuits $\mathbf{126}_q$, the control and/or adjustment means $\mathbf{117}_p$ assigned to the temperature control fluid outlets $\mathbf{107}_i$ or temperature control circuits $\mathbf{127}_q$ or sub-circuits $\mathbf{126}_q$ are each provided structurally and/or spatially separate from one another in separate control devices $\mathbf{143}_p$ (see, e.g. FIG. 12). In a preferred embodiment of these control devices $\mathbf{143}_p$, said devices are embodied, regardless of different stages of expansion—e.g. in terms of the number of temperature signals to be considered and/or in terms of the embodiment of the temperature control unit $\mathbf{112}_i$ with or without (partial) fluid exchange and/or the use of a flow meter, and/or in terms of the variable to be adjusted, —as standard integrated adjustment and/or control modules $\mathbf{143}_p$, or control modules $\mathbf{143}_p$, with all the algorithms $\mathbf{117}_p$ already provided and/or with all used or non-used interfaces 188; 189; 191; 192; 193; 194. The control module $\mathbf{143}_p$ that is provided or will be provided in or for at least each sub-circuit $\mathbf{126}_q$ of the respective module 102; 102';

103; 103'; 141; 141'; 142 has a logic unit 190, e.g. a microprocessor 190 or microcontroller 190, which contains, e.g., the control and/or adjustment means $117_p$ embodied as circuit $117_p$ or algorithm $117_p$. It additionally comprises an interface 187, e.g. a bus and/or network connection 187, in particular a bus coupler 187, via which it can be coupled to, e.g., looped into, sub-section $149_r$ of the signal connection that spans all the modules. It further comprises an interface 196, via which it can be or is connected, e.g., to a power supply that spans all the modules.

For receiving measured variables that are relevant to control and/or adjustment, the standard control module $143_p$ has a series of interfaces 188; 189; 191 which are not necessarily required to be occupied, or are not all occupied, in some applications. For example: at least two interfaces 188, in particular at least four, preferably four, interfaces 188 are provided for supplying signals relating to measured values from temperature sensors $118_V$; $118_R$; (180). In one configuration provided for controlling and/or adjusting a sub-circuit $126_q$, for example, two of these interfaces 188, e.g. formed by terminals, are occupied, and each forms a signal input 188 for the temperature signal received on the feed side and the return side temperature sensor $118_V$; $118_R$; (180). In addition, in an advantageous further development of the control module $143_p$, it is standard for at least one interface 189 to be provided for supplying signals relating to measured values from a flow meter 120. This interface 189 is provided, for example, in a further developed configuration, provided for controlling and/or adjusting a sub-circuit $126_q$, in which a flow meter 120 is additionally provided in the region of the temperature control unit $112_l$, for example, for detecting and/or evaluating energy flows (e.g. cold or thermal output). Alternatively, said interface 189 can be provided in a configuration of the control module $143_p$ for controlling and/or adjusting a sub-circuit $126_q$, which represents a primary circuit loop and which is temperature controlled via the through flow.

Finally, in one further development, a control module $143_p$ having at least two, preferably (at least) four interfaces 188 and optionally one interface 189 can generally comprise on the input side an additional interface 191 as signal input 191 for process variable(s) $P_m$, which generally represents, for example, the current machine speed of the printing machine 201; 201'; 201".

For acting on the control elements that are relevant to control and/or adjustment, control module $143_p$—e.g. in principle in conjunction with any combination of the aforementioned input-side variants—generally has a series of interfaces 192; 193; 194, e.g. output interfaces 192; 193; 194, which likewise are not necessarily required to be occupied or are not all occupied in some applications. For example, at least one interface 192 is provided for outputting signals, in particular analog signals, which act on the drive of valve 113, and by which a valve position can be continuously adjusted within an adjustment range. Said interface is preferably occupied in a configuration provided for controlling and/or adjusting a sub-circuit $126_q$, and is signal-connected to the relevant control element 113 and/or to the drive thereof. In an advantageous further development of control module $143_p$, it is further standard for at least one interface 193, e.g. at least three, and particularly three interfaces 193, for connecting a heating unit 114 to be provided. This at least one interface 193 is provided, for example, in a further developed configuration provided for controlling and/or adjusting a sub-circuit $126_q$, in which, for example, the coupled functional part (208; 209; 211; 217; 221; $222_{d'}$; $222_{d''}$; 238; 239; 231; 232; 235; 241; 242; $213_d$; $216_d$; $227_{d'}$; $227_{d''}$) is also to be subjected to heating by the temperature control circuit $127_q$ assigned to the sub-circuit $126_q$. In a variation of this configuration, a plurality of these interfaces 193 can be engaged, if—as stated above—increased heating power is to be provided.

Finally, in a further development of a control module $143_p$ having at least one interface 193 and, e.g., at least one interface 193, optionally a plurality of interfaces 193, at least one interface 194 for emitting an on/off signal (e.g. I/O port) can also generally be provided on the output side, with the signal therefrom causing a unit or control element of the temperature control assembly 101, e.g. a pump 177 and/or pump 139 provided on the primary circuit side and/or a control element 169 that induces a change between the primary circuits 119; 154, or the drive thereof, to switch between two operating states.

For example, (at least) two control modules $143_p$ of the same construction but configured differently in terms of their engagement can be provided at the same time in temperature control assembly 101. In a first variant, a first of these control modules $143_p$, which is provided for controlling and/or adjusting a sub-circuit $126_q$ in the relevant section 102; 102'; 103; 103'; 141; 141' of temperature control assembly 101 or in the relevant module 102; 102'; 103; 103'; 141; 141', is connected on the input side, e.g., at two of a total of four interfaces 188, to two temperature sensors $118_V$; $118_R$, and on the output side e.g. only to control element 113 or to the drive thereof, wherein the remaining interfaces 189; 191; 193; 194 are unoccupied. In another further developed variant of the first of these control modules $143_p$, on the input side the interface 189 (flow meter 120) is also occupied, and/or on the output side at least one interface 193 (heating unit 114) is occupied. The second of these control modules $143_p$, which are configured differently in terms of their assignment, is provided, e.g. for controlling and/or adjusting a sub-circuit $126_q$ arranged in the base module 102; 102' and at the same time for controlling pump 177, which effects circulation. For this purpose, with respect to the configuration of the first control module $143_p$, on the input side an additional interface 188 is occupied by the signal from the temperature sensor 180 for determining the temperature $\Theta_{176}$ of the fluid, e.g. near the output region of store 176, and on the output side, an interface 194 is assigned for switching pump 177 on and/or off. If no sub-circuit $126_q$ is provided in the base module 102; 102', a second control module $143_p$ which is different from the first control module $143_p$ can comprise only the assignment of the latter two interfaces 188; 194.

An operator interface 197 can additionally be provided on or in the respective control module $143_p$, via which an operator can input and/or adjust parameters, e.g. control parameters and/or predefined target values that impact the controller.

The standard embodiment of control module $143_p$ configured for use in temperature control assembly 101 therefore allows one and the same variant of control module $143_p$ to be maintained and installed for different expansion stages of temperature control assembly 101 and/or the modules 102; 102'; 103; 103'; 141; 141'; 142 thereof, and/or to be retrofitted with additional measuring and control technology and/or used for different control and/or adjustment tasks.

As described above, in the case of a modular variant, the temperature control assembly 101 to be used in a system 001 or in a machine 201; 201'; 201" can comprise two or more of the described modules 102; 102'; 103; 103'; 141; 141'; 142, depending on the specific application, wherein one of the modules 102; 102' is embodied as base module 102; 102', wherein base module 102; 102' can be embodied without a temperature control unit $112_l$, with one such unit, or with a plurality of such units for controlling the temperature of one or more temperature control circuits $109_k$ to be coupled. In an advantageous variant, however, at least one temperature control unit $112_l$ having corresponding interfaces $107_i$; $111_j$ for coupling a temperature control circuit $127_q$ is provided in base module 102; 102', which circuit can optionally be used independently, as the smallest unit, without additional modules 103; 103'; 141; 141' that comprise temperature control units $112_l$. In this smallest embodiment of the system 101, in addition to base module 102; 102', an end module 142 comprising control device 143 and/or operator interface 144 can optionally be provided. Said end module can then be embodied e.g. without or additionally with the aforementioned bypass 138.

A module 102; 102'; 103; 103'; 141; 141'; 142 or a section 102; 102'; 103; 103'; 141; 141'; 142 embodied as a module 102; 102'; 103; 103'; 141; 141'; 142 in this case is preferably understood as a component 102; 102'; 103; 103'; 141; 141'; 142 that can be preassembled or is preassembled, which comprises the essential functional elements of said component 102; 102'; 103; 103'; 141; 141'; 142, and prepared interfaces 136; 151; 153 for coupling to one or more additional modules 102; 102'; 103; 103'; 141; 141'; 142. For a specific embodiment of the system 101, for example, the necessary modules 102; 102'; 103; 103'; 141; 141'; 142 are placed, as separate components 102; 102'; 103; 103'; 141; 141'; 142 or as components already partially or fully coupled with one another, on or in the machine 201; 201'; 201" that is to be temperature controlled. In the case of individual modules 102; 102'; 103; 103'; 141; 141'; 142 or groups of modules 102; 102'; 103; 103'; 141; 141'; 142 that are not yet connected, the modules 102; 102'; 103; 103'; 141; 141'; 142 or groups thereof do not need to be constructed from their separate units on site, and instead need only to be coupled with one another at their interfaces 136; 151; 153, and the frames thereof that support the components optionally connected to one another and/or fastened to the floor, the temperature control components 109*k* connected, and a connection established for supplying electric power and optionally for supplying external temperature control medium 173; 179 for controlling the temperature of the first and/or second primary circuit 119; 154. The components of frames which can be preassembled or are preassembled and which support each respective module 102; 102'; 103; 103'; 141; 141'; 142 can each be embodied, in principle, as open support frames. In one advantageous embodiment, however, they are arranged in a substantially closed or closeable housing, which is embodied as supporting or as correspondingly fitted with supporting elements. In a preferred embodiment, at least base module 102; 102' and the at least one optionally modified connecting module 103; 103'; 141; 141' are each configured in the manner of a cabinet 102; 102'; 103; 103'; 141; 141', each having at least one door 183. This module 102; 102'; 103; 103'; 141; 141', configured as a cabinet 102; 102'; 103; 103'; 141; 141', comprises, e.g., in the region of the lateral interface 136; 151; 153 or interfaces 136; 151; 153, openings that correspond to another module 102; 102'; 103; 103'; 141; 141'; 142 or to other modules 102; 102'; 103; 103'; 141; 141'; 142; 142' and/or comprises the module-side part of the relevant interfaces 136; 151; 153 themselves. On one connection side 184, e.g. on the rear wall side, the interfaces $107_i$; $111_j$ for temperature control circuits $109_k$ can be provided. The functional parts (208; 209; 211; 217; 221; $222_{d'}$; $222_{d''}$; 238; 239; 231; 232; 235; 241; 242; $213_d$; $216_d$; $227_{d'}$; $227_{d''}$) of the module 102; 102'; 103; 103'; 141; 141' can be accessed for the purpose of maintenance and installation through the doors 183, preferably double doors 183, arranged at the front, for example. The end module 142, which comprises, e.g., control device 143 and/or operator interface 144, can also be configured as a closed or closeable housing 142, in particular as a cabinet 142, which has openings and/or the module-side part of the interfaces 151; 153 on the side that faces the next closest module 102; 102'; 103; 103'; 141; 141'. Through doors 186 optionally provided on the front side, e.g., installation or maintenance tasks can be performed on the relevant supply connections and signal connections. The base modules and connecting modules 102; 102'; 103; 103'; 141; 141' configured as cabinets 102; 102'; 103; 103'; 141; 141' preferably have the same width in terms of their dimensions in the longitudinal direction of the system and/or their front side, in particular a standard width that is routine for switching systems and/or equipment cabinets. They preferably also have the same depth and the same height.

Figure 13:
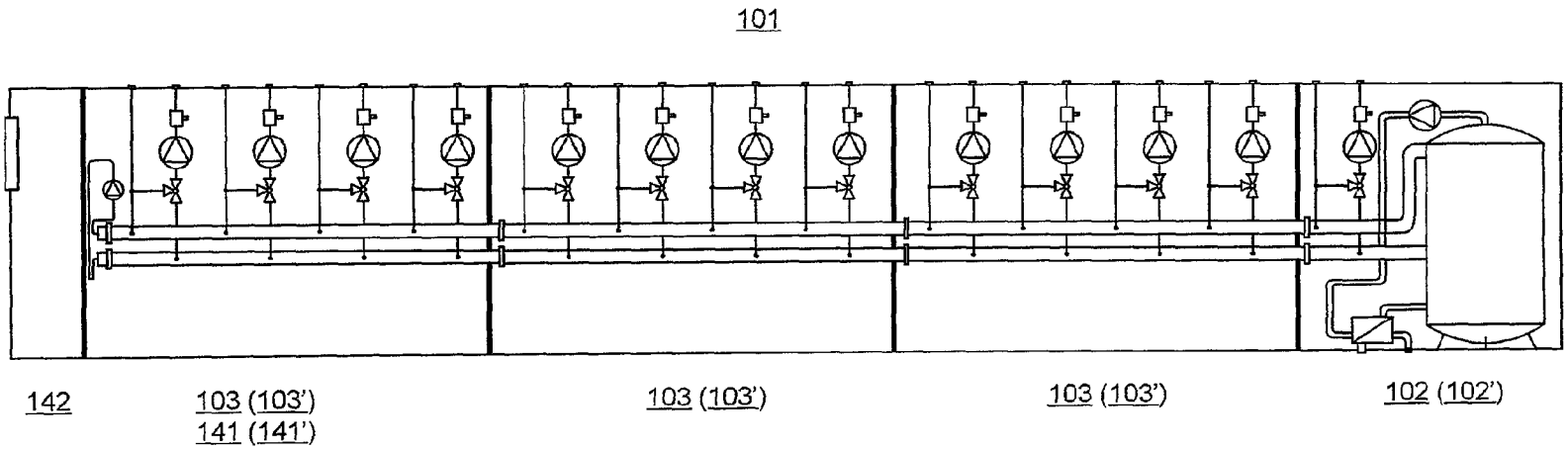
FIG. 13 an embodiment example of a temperature control assembly comprising a plurality of connecting modules.
Figure 14:
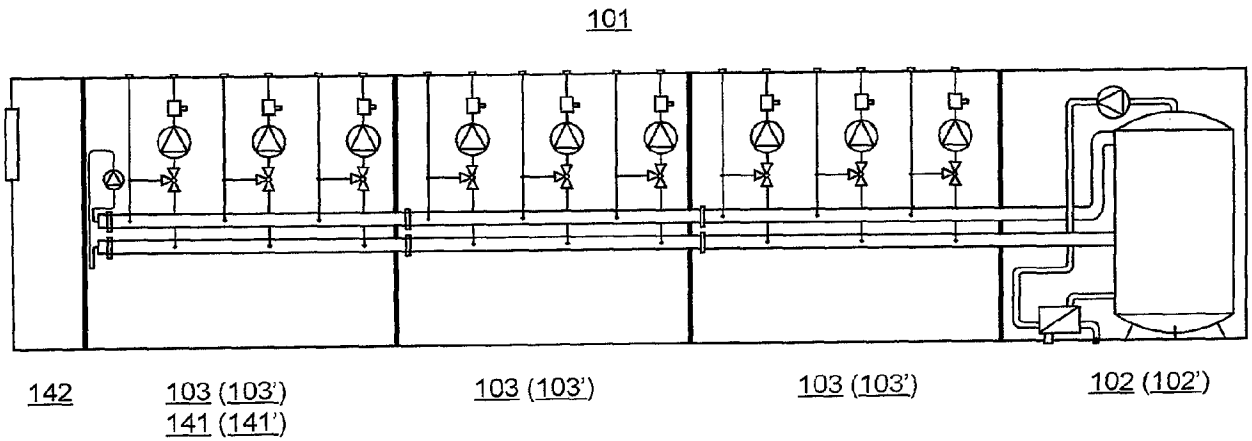
FIG. 14 an embodiment example of a temperature control assembly having a connecting module that comprises three temperature control units and/or that can be coupled to three external temperature control sub-circuits.

The temperature control assembly embodied as a set of modules or "building blocks" and/or the system comprising various modules 102; 102'; 103; 103'; 141; 141'; 142 can have advantages in terms of production costs and/or delivery times, regardless of the specific application in printing systems 001. For example, a set of fixedly defined and, e.g., prefabricated modules 102; 102'; 103; 103'; 141; 141'; 142 can be provided, which will or can be combined as needed to produce a temperature control assembly 101. Such a set comprises, for example, at least one base module 102; 102' and one connecting module 103; 103' for coupling a plurality, e.g. a number n, of temperature control circuits $109_k$. A plurality of connecting modules 103; 103' can then be combined as illustrated by way of example in FIG. 13, to form a system 101. In one advantageous embodiment, the set can also comprise an end module 142 having at least one control device 143 and/or operator interface 144. The connecting module 103; 103' preferably has a fixed number n of temperature control units $112_l$ or interface pairs $107_i$; $111_j$ for coupling temperature control circuits $109_k$. An advantageous number n, as presented above by way of example, can be n=4 or, e.g. as presented by way of example in FIG. 14, n=3, or as in FIG. 20 by way of example, can be n=5.

In a further development of the modular variant, two different types of base modules 102; 102', namely with and without a prepared second primary circuit 154, can be provided in the set, and can be selected as needed for the system 101 to be produced. In an advantageous further development of the set, connecting module 103; 103' can itself be configured in the form of a module or building block, which is expandable with respect to a prepared second primary circuit 154, wherein the housing of module 103; 103' is configured in the form of a cabinet, preferably already in the proper size for accommodating the components relating to the second primary circuit 154. A homogeneous layout of the system 101 can then be produced, regardless of the variant with or without primary circuit 154.

One of the variants of connecting module 103; 103'—with or without the prepared second primary circuit 154—can also be selectable here as required for the system 101 to be constructed. Independently of said selection, but advantageously in conjunction with an expandable and/or expanded connecting module 103; 103', in a further development, two different types of base modules 102; 102', namely with and without a prepared second primary circuit 154, may be provided in the set, one of which can be selected as needed for the system 101 to be constructed. Said system can also be configured in terms of the housing such that base module 102; 102' is configured in the form of a module or building block which is expandable with respect to a prepared second primary circuit 154. Accordingly,—irrespective of the building block embodiment thereof—two different types of connecting modules 103; 103', namely with and without a prepared second primary circuit 154, can be provided in the set, one of which can be selected as needed for the system 101 to be constructed.

Finally, in another further development, a modified connecting module 141; 141' can be alternatively or additionally provided, wherein said module already comprises an aforementioned bypass 138, and forms the connecting module 141; 141' that is the farthest removed from base module 102; 102' in the system 101.

In a further development of the specified variants, two different types of performance classes can be provided in the set, and can alternatively form the basis for a large or a smaller system 101. For all the variants of the set, base module 102; 102' can be embodied without or with one or more integral temperature control units $\mathbf{112}_l$ or interface pairs $\mathbf{107}_i$; $\mathbf{111}_j$ for coupling temperature control circuits $\mathbf{127}_q$. Optionally, one base module 102; 102' without an integral temperature control unit $\mathbf{112}_l$ and/or interface pair $\mathbf{107}_i$; $\mathbf{111}_j$ and one base module 102; 102' with one or more integral temperature control units $\mathbf{112}_l$ and/or interface pairs $\mathbf{107}_i$; $\mathbf{111}_j$ for coupling temperature control circuits $\mathbf{127}_q$ may be provided, and can be selectable as needed.

As presented above, in the case of a multi-row embodiment, the temperature control assembly 101 to be used in a system 001 or in a machine 201; 201'; 201" can have two or more parallel rows 110; 115 of temperature control units $\mathbf{112}_l$ and/or coupling sites 125.

Figure 15:
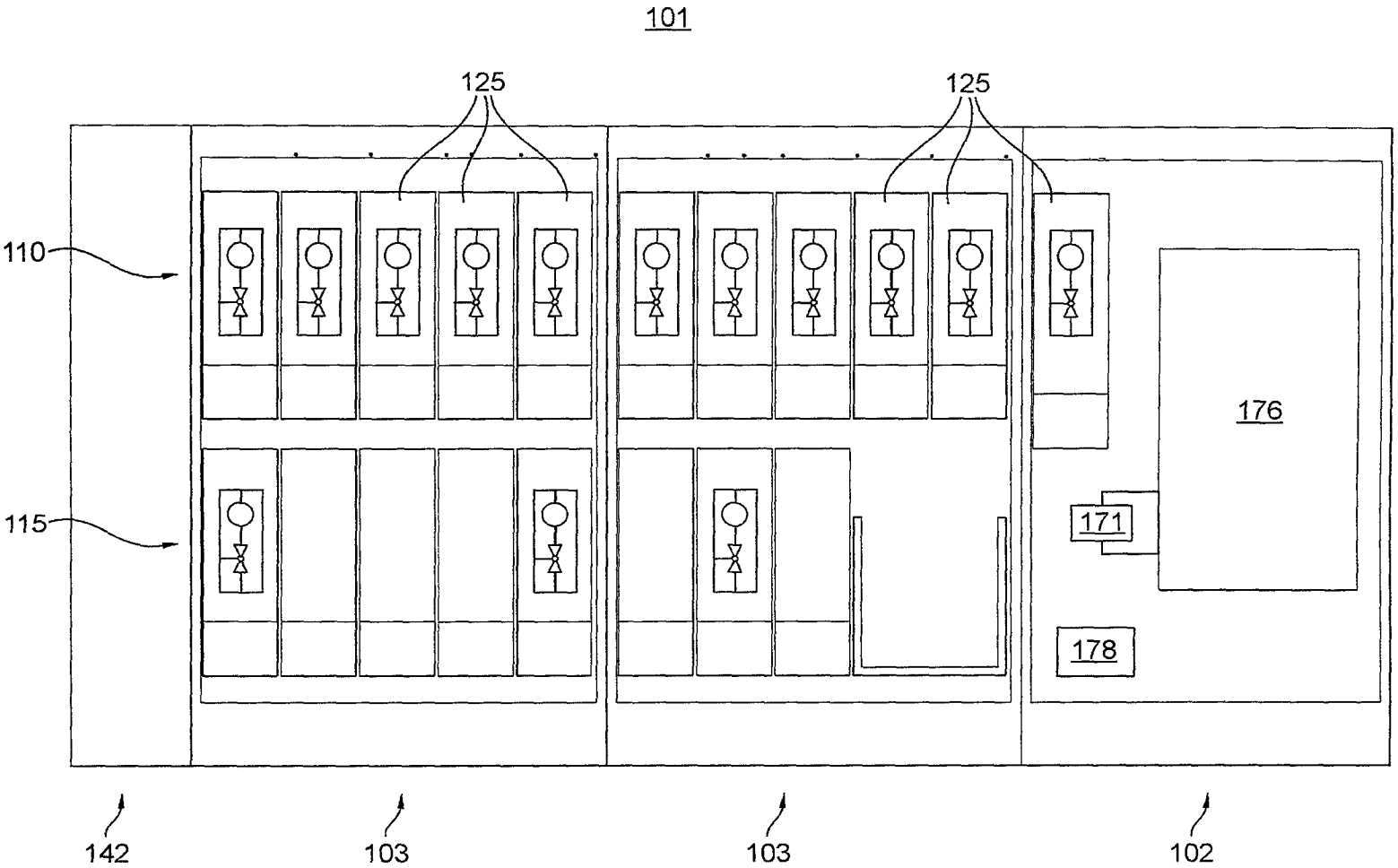
FIG. 15 a schematic representation of a multi-row temperature control assembly having coupling sites and temperature control units which are embodied as temperature control modules.

To achieve high variability, a plurality of coupling sites 125 are provided in temperature control assembly 101, with the number of sites corresponding at least to a maximum required number z (with $z \in \mathbb{N}$) of temperature control units $\mathbf{112}_l$ (see, e.g., the schematic representation in FIG. 15). For a use with a printing machine for security printing, the temperature control assembly is configured, for example, with a total number $z \geq 15$, e.g. $z \geq 18$, in this case advantageously $z=19$, temperature control units $\mathbf{112}_l$ and/or coupling sites 125.

Figure 6:
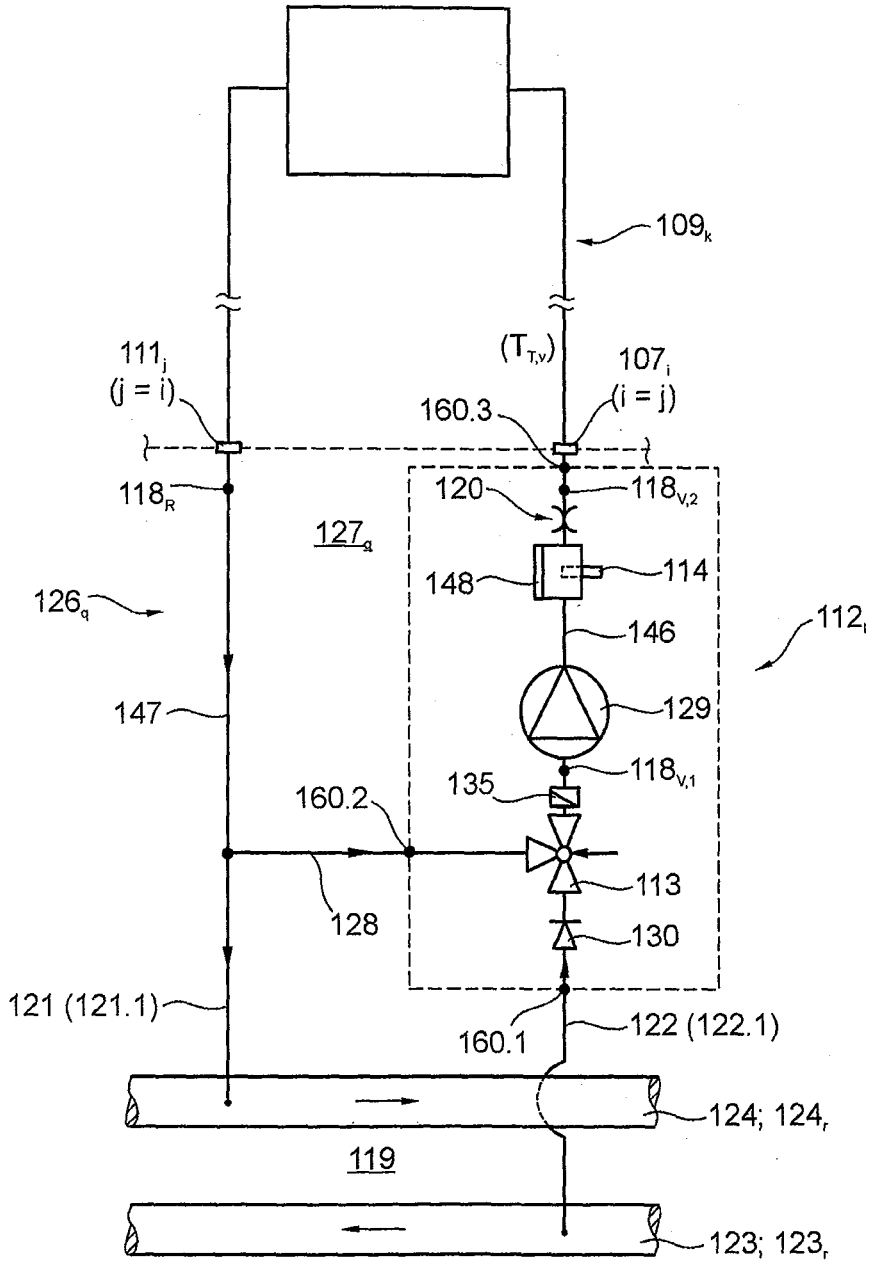
FIG. 6 a detailed representation of a temperature control circuit.
Figure 7:
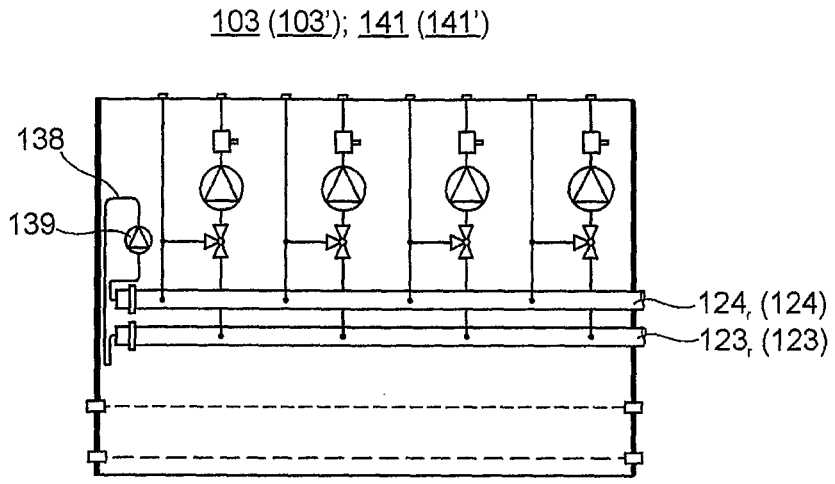
FIG. 7 an embodiment example of an end module as a modified connecting module.
Figure 8:
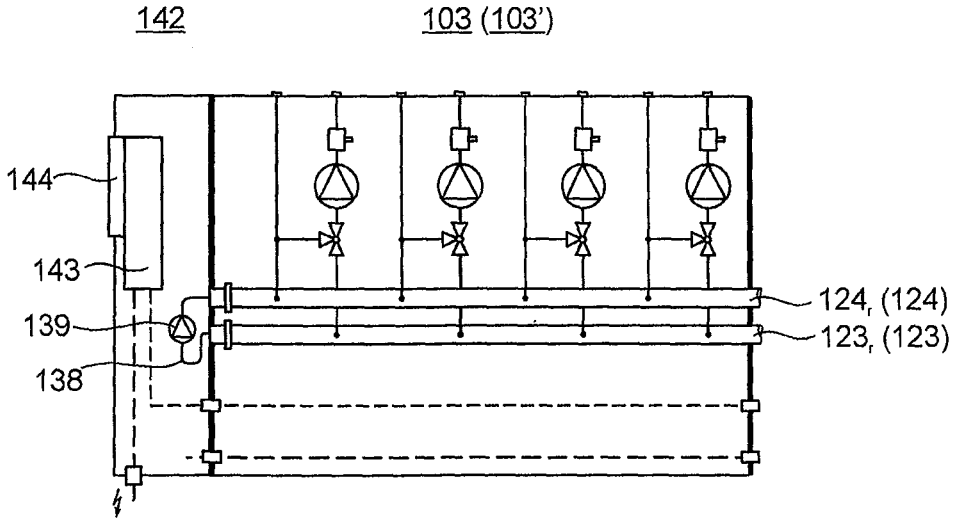
FIG. 8 an embodiment example of an end module having a control device and/or an operator interface.
Figure 9:
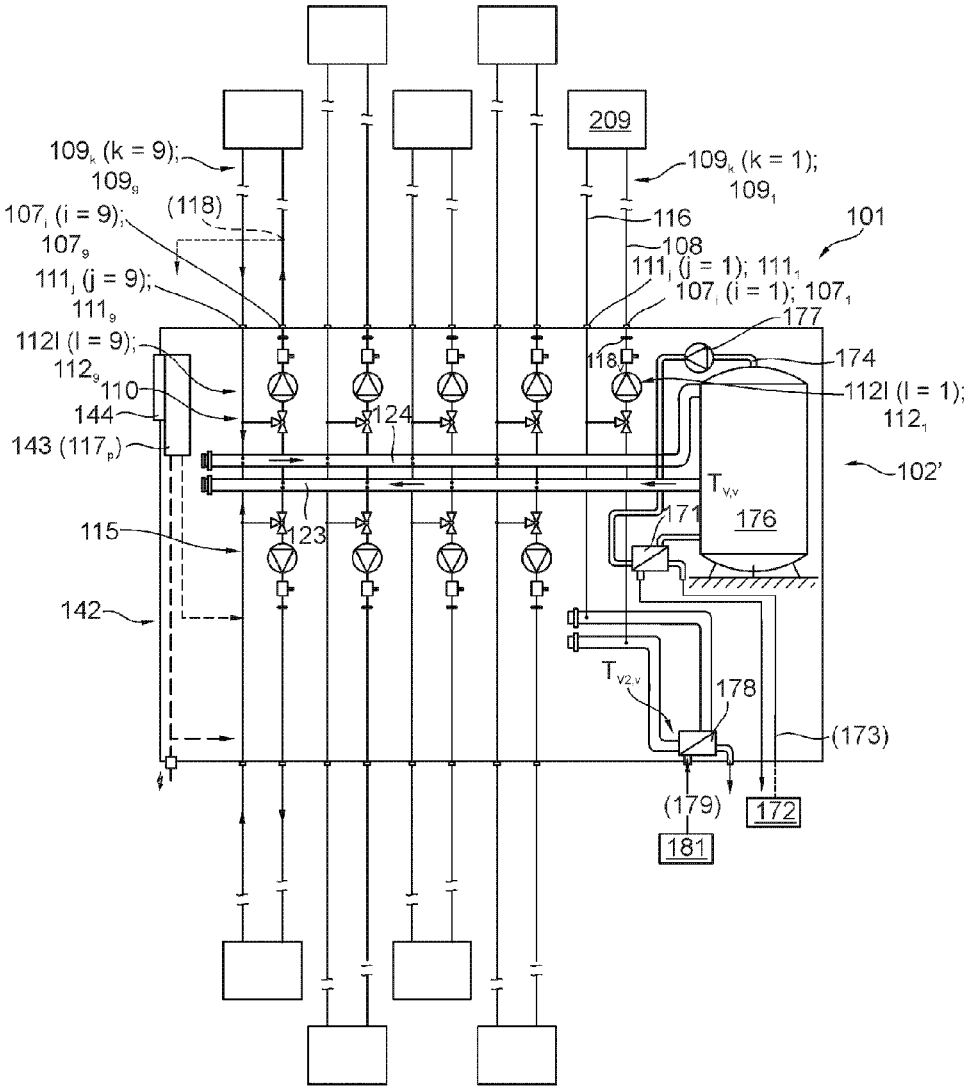
FIG. 9 an embodiment example of a multi-row temperature control assembly, expanded to include a second primary circuit, for controlling the temperature of components of a machine.
Figure 10:
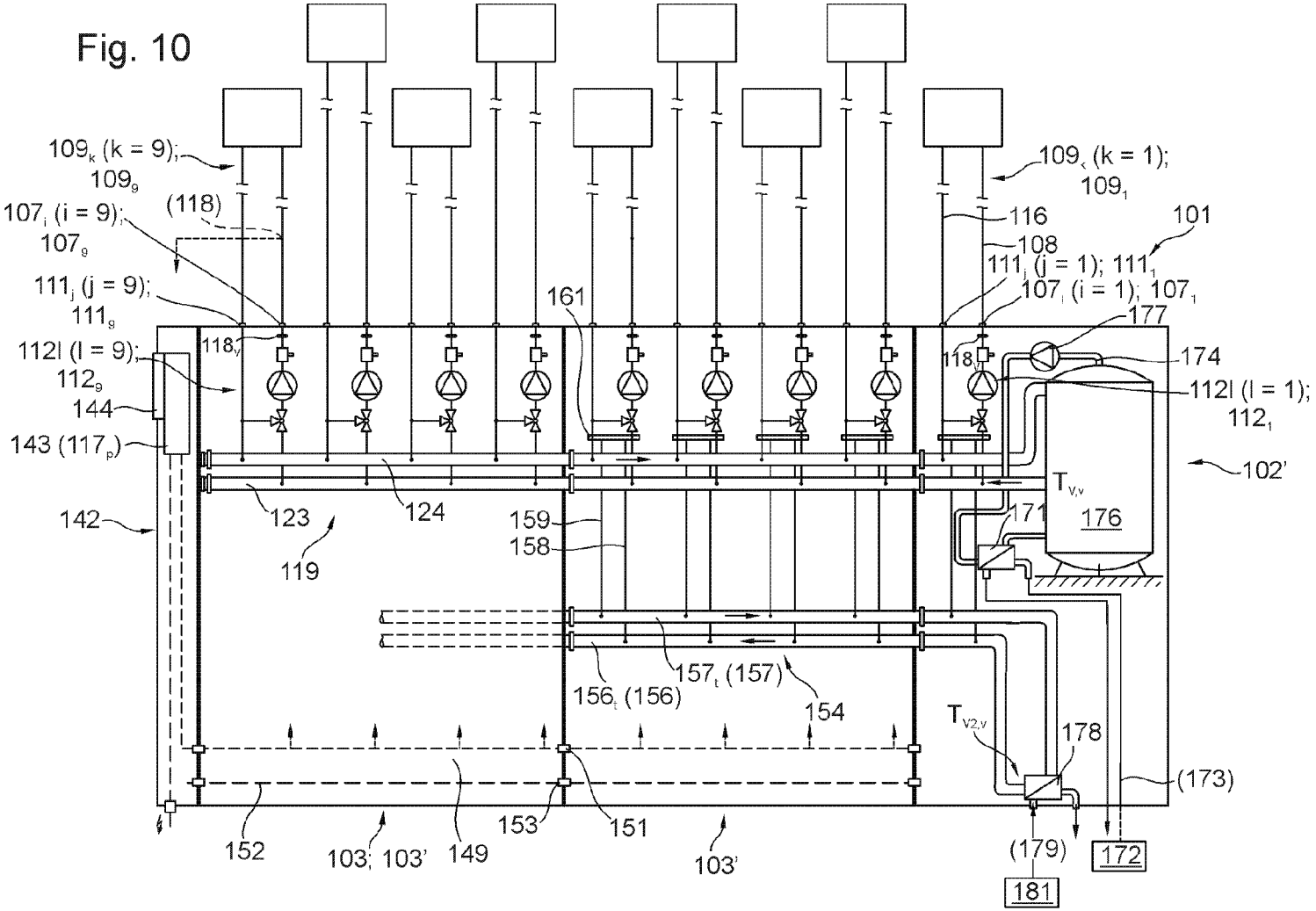
FIG. 10 an embodiment example of a modular temperature control assembly, expanded to include a second primary circuit, for controlling the temperature of components of a machine.

The embodiment of the temperature control assembly 101 with coupling sites 125 and temperature control modules $\mathbf{112}_l$ is particularly advantageous for both the modular and, in particular, the multi-row embodiment. In FIG. 6, one example of the assignment of components and line sections to form temperature control module $\mathbf{112}_l$ is indicated by a dashed rectangle.

Figure 16:
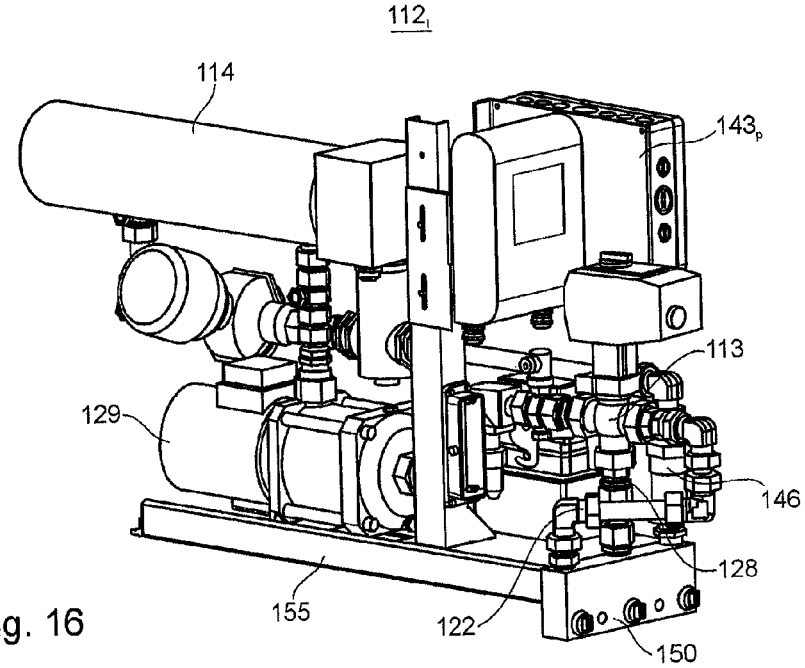
FIG. 16 a perspective representation of one example of a temperature control module.
Figure 17:
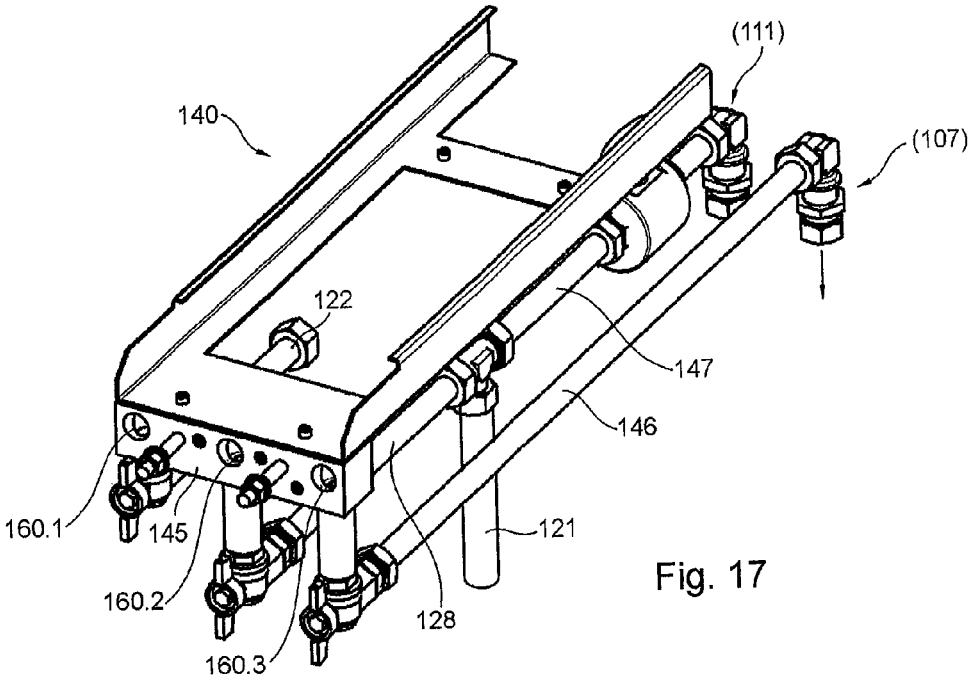
FIG. 17 a perspective representation of a coupling site.

In the frame 105 of temperature control assembly 101 or of relevant modules 102; 102'; 103; 103'; 141; 141', each coupling site 125 is provided with a support 140, which can accommodate a temperature control assembly $\mathbf{112}_l$, e.g. in the manner of a plug-in unit (see, e.g. FIG. 16 and/or FIG. 17). Each coupling site 125 is preferably assigned a prepared connecting plate 145, on which the parts of the line sections 121; 122; 128; 146; 147 prepared on the assembly side are releasably connectable or connected to the extensions of said line sections 121; 122; 128; 146; 147 on the temperature control module side. Said plate comprises a plurality of prepared line connections 160.1; 160.2; 160.3, which can be connected by coupling to the connection block 150 of temperature control module $\mathbf{112}_l$, which comprises the line sections that are fixed to the frame.

The temperature control module $\mathbf{112}_l$, which can be installed as a unit, comprises at least control means 113, in particular valve 113, and pump 129, on a supporting structure 155, in addition to the module-side parts of line sections 121; 122; 128; 146; 147. It preferably further comprises at least one heating unit 114 or at least one interface 148 for receiving one or more heating units 114 and/or a control and/or adjustment device $\mathbf{143}_p$, preferably embodied as a control and/or adjustment module $\mathbf{143}_p$, and/or a connection block 150, embodied as complementary to the assembly-side connecting plate 145, from which line sections 121; 122; 128; 146; 147 to be coupled on the temperature control module side extend. Temperature control assembly 101 can thus be fitted with a temperature control unit $\mathbf{112}_l$ in a simple manner by plugging and optionally fastening temperature control module $\mathbf{112}_l$, along with its supporting structure 155, into the corresponding support 140 and by coupling the parts of line sections 121; 122; 128; 146; 147 on the frame side and the temperature control module side by connecting connecting block 150 to connecting plate 145. In principle, line sections 121; 122; 128; 146; 147 can also be connected individually, without connecting block 150 and connecting plate 145.

Although the modular and/or multi-row embodiment as represented above has particular advantages, regardless of its specific application, the system 101 embodied in this manner is particularly advantageous for or in a printing system 001 comprising one or more printing machines 201; 201'; 201". In particular, the variety of different printing machine types and/or the various printing methods and/or printing technologies and/or different colors and/or the requirements with respect to expandability can be taken into account.

Figure 18:
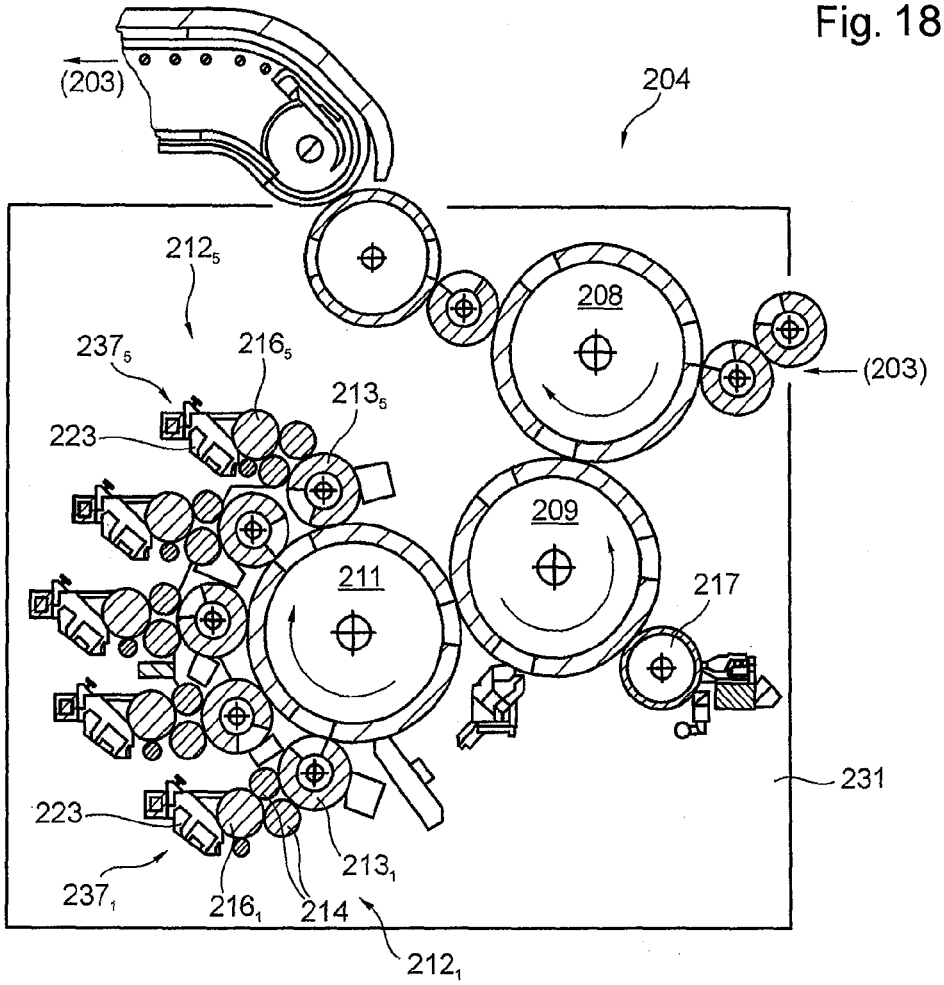
FIG. 18 a first example of an embodiment of a first printing unit having a modular temperature control assembly.
Figure 18:
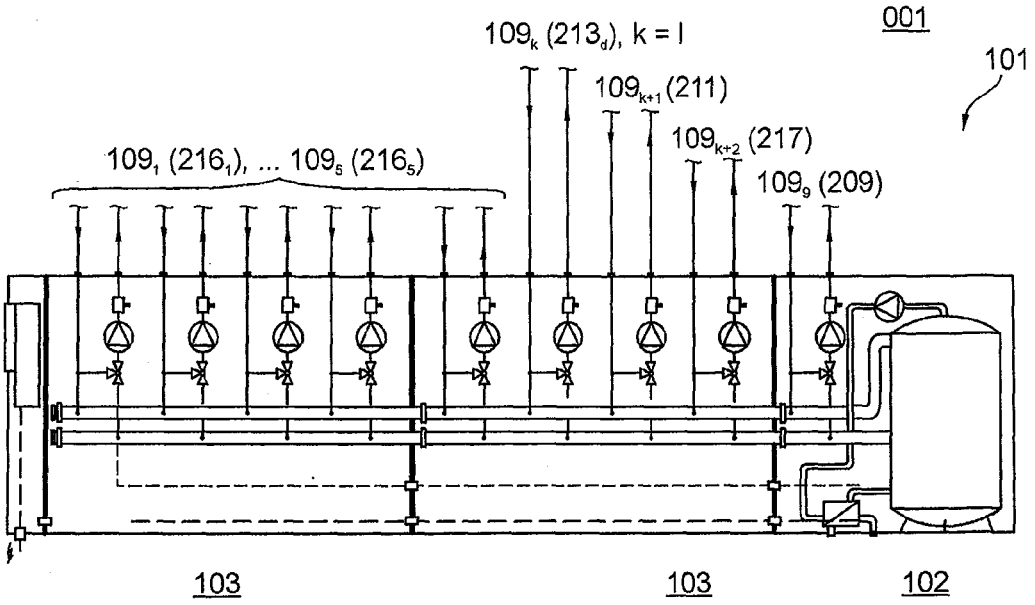
Figure 19:
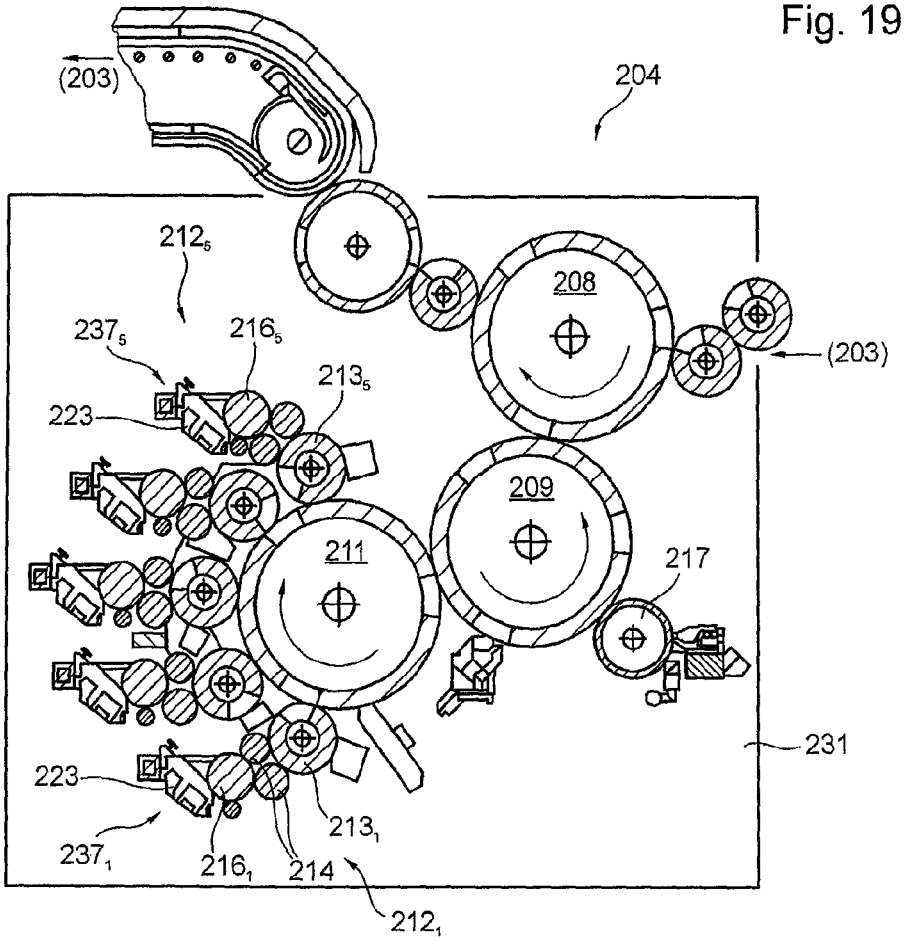
FIG. 19 a first example of an embodiment of a first printing unit having a multi-row device.
Figure 19:
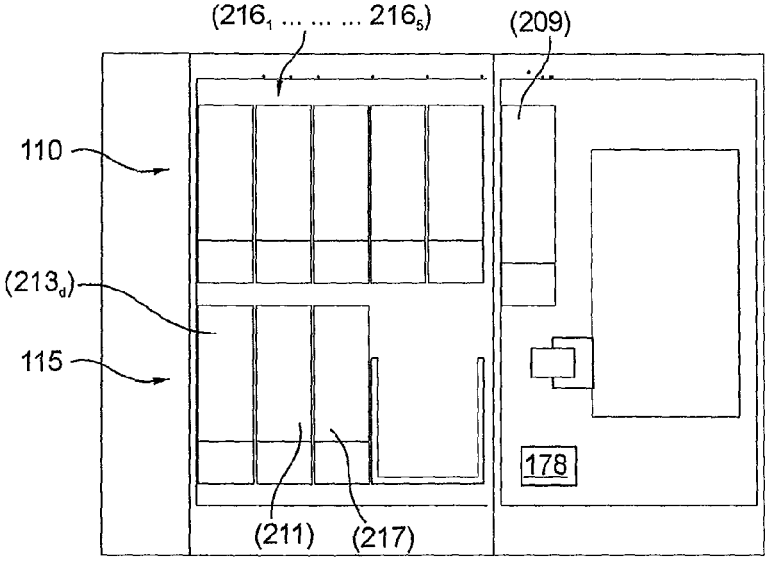
Figure 20:
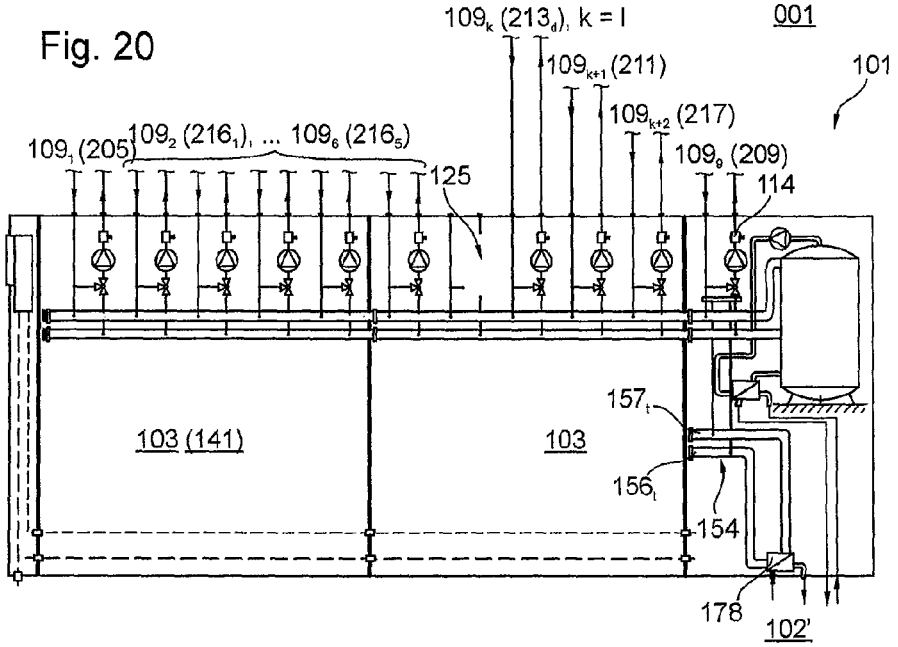
FIG. 20 a second example of the embodiment of the first printing unit having a modular temperature control assembly.

A first embodiment of a temperature control assembly 101 for or in a printing system 001 having (at least) one printing machine 201 for the temperature control thereof is shown, e.g., in FIG. 1, along with FIG. 18 or FIG. 19, with FIG. 18 and FIG. 19 each showing an enlarged representation of the printing unit 204 of said printing machine 201 and an embodiment of the temperature control assembly 101 assigned for controlling the temperature of printing machine 201 and/or of the printing unit 204 thereof. The represented embodiment example involves a printing machine 201 or a printing unit 204, the printing method of which is based on an intaglio printing process, in particular the die stamping process. In this case, printing unit 204 comprises two cylinders 208; 209, at the nip point of which there is formed a print position for the printing substrate 203, e.g. printing substrate sheet 203, to be imprinted and to be guided through the nip point. In the illustrated case involving single-sided printing, cylinder 208 arranged on the non-printing side of the nip point is embodied solely as an impression cylinder 208, also called an impresser 208. Cylinder 209 arranged on the printing side of the nip point, i.e., a cylinder that carries ink and forms the print position, is embodied as a forme cylinder 209, also called a gravure cylinder 209, and bears on its outer surface the printing image template in the form of a gravure. Forme cylinder 209 receives the ink upstream from a cylinder 211, embodied here as an ink collecting cylinder 211, which has a flexible and/or compressible surface, for example. Said ink collecting cylinder 211 cooperates upstream with a number of rollers $\mathbf{213}_d$, e.g. forme rollers $\mathbf{213}_d$, in particular screen rollers $\mathbf{213}_d$, which number corresponds to the number D of printing couples $\mathbf{212}_d$ ($d \in \mathbb{N}$, $i=1, 2 \ldots D$). Each of these screen rollers $\mathbf{213}_d$ inks the ink collecting cylinder 211 in succession with a printing ink, and is provided on its surface—e.g. in the manner of a letterpress forme—with a contour of the printed image section that corresponds to said ink. The screen rollers $\mathbf{213}_d$ are in turn inked upstream by rollers 214, e.g. forme rollers 214 of an inking unit $\mathbf{237}_d$, which receive the printing ink, via additional rollers or directly, from a roller $\mathbf{216}_d$, e.g. ductor roller $\mathbf{216}_d$, which introduces the printing ink into inking unit $\mathbf{237}_d$. Ductor roller $\mathbf{216}_d$ cooperates with an ink source 223, e.g. an ink fountain or a doctor blade device 223. In the case represented here of a short inking unit $\mathbf{237}_d$, the ink is supplied via doctor blade device 223 of ductor roller $\mathbf{216}_d$, and is applied, e.g., in parallel via two forme rollers 214 to screen rollers $\mathbf{213}_d$, in particular to the raised regions thereof.

An additional cylinder 217, e.g. printing couple cylinder 217, in particular dampening cylinder 217, preferably cooperates with the outer surface of ink collecting cylinder 211.

Printing machine 201 and/or printing unit 204 is then assigned a temperature control assembly 101, by which a plurality of units and/or functional components are and/or can be temperature controlled in parallel with one another. These may be a plurality of cylinders 208; 209; 211; 217 and/or rollers $\mathbf{213}_d$; 214; $\mathbf{216}_d$ of printing couples $\mathbf{212}_d$ of the printing unit 204 that are to be temperature controlled individually or in groups.

In one advantageous variant, e.g. represented in FIG. 18 and FIG. 19, a separate temperature control circuit $\mathbf{109}_k$ is provided for each of the ductor rollers $\mathbf{216}_d$, e.g. in the case of n=5 printing couples $\mathbf{212}_d$, for each of the ductor rollers $\mathbf{216}_d$ of the five printing couples $\mathbf{212}_d$, and in the system 101, an individual temperature control unit $\mathbf{112}_l$ that can be controlled and/or adjusted independently of the other temperature control units $\mathbf{112}_l$ is provided. Furthermore, in a less costly embodiment for the screen rollers $\mathbf{213}_d$ of printing couples $\mathbf{212}_d$, a common temperature control circuit $\mathbf{109}_k$ is provided, and in the system 101, an individual temperature control unit $\mathbf{112}_l$ that can be controlled and/or adjusted independently of the other temperature control units $\mathbf{112}_l$ is provided for this group. Finally, a temperature control circuit $\mathbf{109}_k$ is provided for each of form cylinder 209, ink collecting cylinder 211 and dampening cylinder 217, and in system 101, an individual temperature control unit $\mathbf{112}_l$ that can be controlled and/or adjusted independently of the other temperature control units $\mathbf{112}_l$ (in operation and/or provided for operation) is provided. In at least one temperature control unit $\mathbf{112}_l$, e.g. at least assigned to forme cylinder 209, but preferably in the temperature control units $\mathbf{112}_l$ of the latter three cylinders 209; 211; 217, a heating unit 114 is provided to allow the relevant cylinder 209; 211; 217 to be brought to the operating temperature prior to the start of printing. The operating point in this at least one cylinder 209, e.g. in all three cylinders 209; 211; 217, is preferably e.g. above 40° C., e.g. above 60° C., therefore preheating is expedient for minimizing wasted paper. The operating point for forme cylinder 209 can even be 75°-85° C., to enable a conversion of the printing ink (particularly in the die stamping process) that first takes place within this range, and results in the setting thereof. Heating units 114 can also be provided for other or even for all of the temperature control units $\mathbf{112}_l$ in system 101, wherein the temperature control unit $\mathbf{112}_l$ that relates to the at least one cylinder, and/or said units that relate to the three cylinders 209; 211; 217, may be embodied e.g. with a more powerful heating unit 114 than the others.

In the embodiment example of FIG. 18, temperature control assembly 101 is embodied as modular, and in the embodiment example of FIG. 19 said assembly is embodied as having multiple rows, wherein a combined embodiment, not shown, involving a multi-row modular variant is also possible. The temperature control units $\mathbf{112}_l$ in this case can be embodied and installed as fixed, or in an advantageous embodiment as temperature control modules $\mathbf{112}_l$ in the manner described above.

In an advantageous further development, temperature control assembly 101, and in a modular variant at least base module 102; 102' of the modular temperature control assembly 101 that cooperates with printing machine 201 for controlling the temperature thereof is embodied with the second device (e.g. comprising temperature control device 178 and line sections $\mathbf{156}_t$; $\mathbf{157}_t$) for supplying temperature control fluid at a second temperature $T_{V2,v}$, which lies at least within a permissible temperature range and is especially closer to the ambient temperature (see, e.g. FIG. 19, FIG. 20, FIG. 21, FIG. 22, FIG. 25 and/or FIG. 27). At least one temperature control unit $\mathbf{112}_l$ provided in temperature control assembly 101, e.g. in a first section 102' or in base module 102', and optionally at least one temperature control unit provided in the connecting module 103' downstream, is coupled and/or can be coupled in the aforementioned manner to the second primary circuit 154. For example, a first section 102' or base module 102' of temperature control assembly 101 is embodied as having the second device for supplying temperature control fluid and as having a temperature control unit $\mathbf{112}_l$ coupled to the second primary circuit 154. If a temperature control unit $\mathbf{112}_l$ that can be coupled in this manner is provided only in the first section 102' or in base module 102', temperature control circuit $\mathbf{109}_k$ of forme cylinder 209, for example, can be coupled or is coupled thereto.

Figure 21:
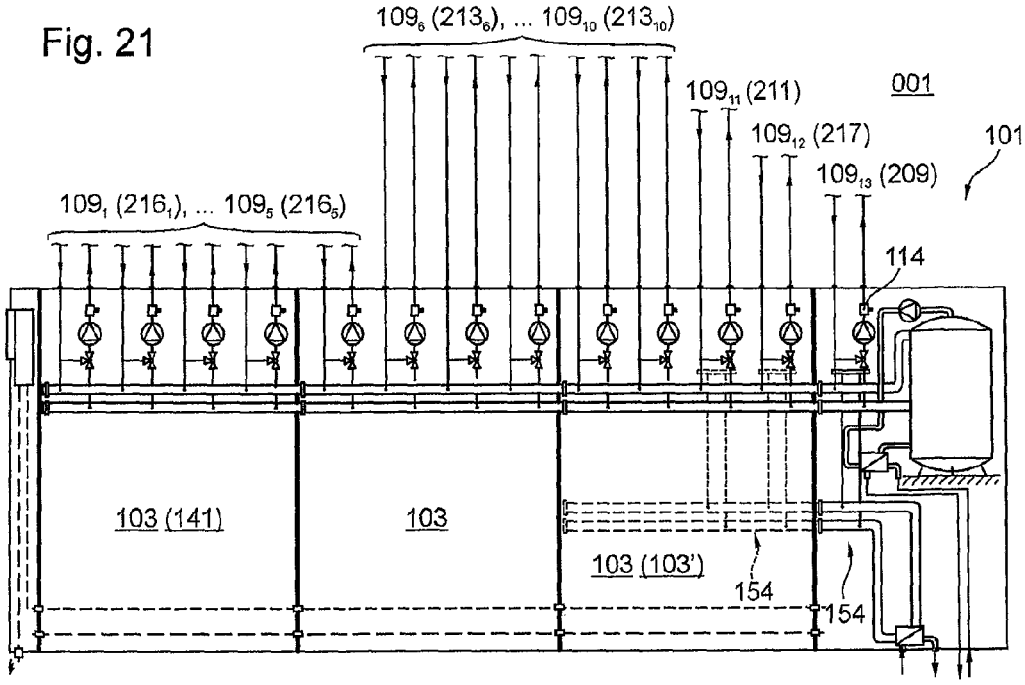
FIG. 21 a third example of the embodiment of the first printing unit having a modular temperature control assembly.

In the examples of FIG. 18, FIG. 19 and FIG. 21, all of temperature control units $\mathbf{112}_l$ are connected and occupied for temperature control, by way of example, and/or in the case of the embodiment as temperature control modules $\mathbf{112}_l$, all of coupling sites 125 are occupied.

In FIG. 20, FIG. 22, FIG. 25 and FIG. 27, in the case of the embodiment as temperature control modules $\mathbf{112}_l$, not all the coupling sites 125 are occupied.

In one advantageous embodiment indicated by way of example in FIG. 20, FIG. 22, FIG. 24, FIG. 25 and FIG. 27, one of temperature control units $\mathbf{112}_l$ is connected to measuring system 205, e.g. inspection system 205, in particular to the light of inspection system 205, for the temperature control thereof.

Figure 22:
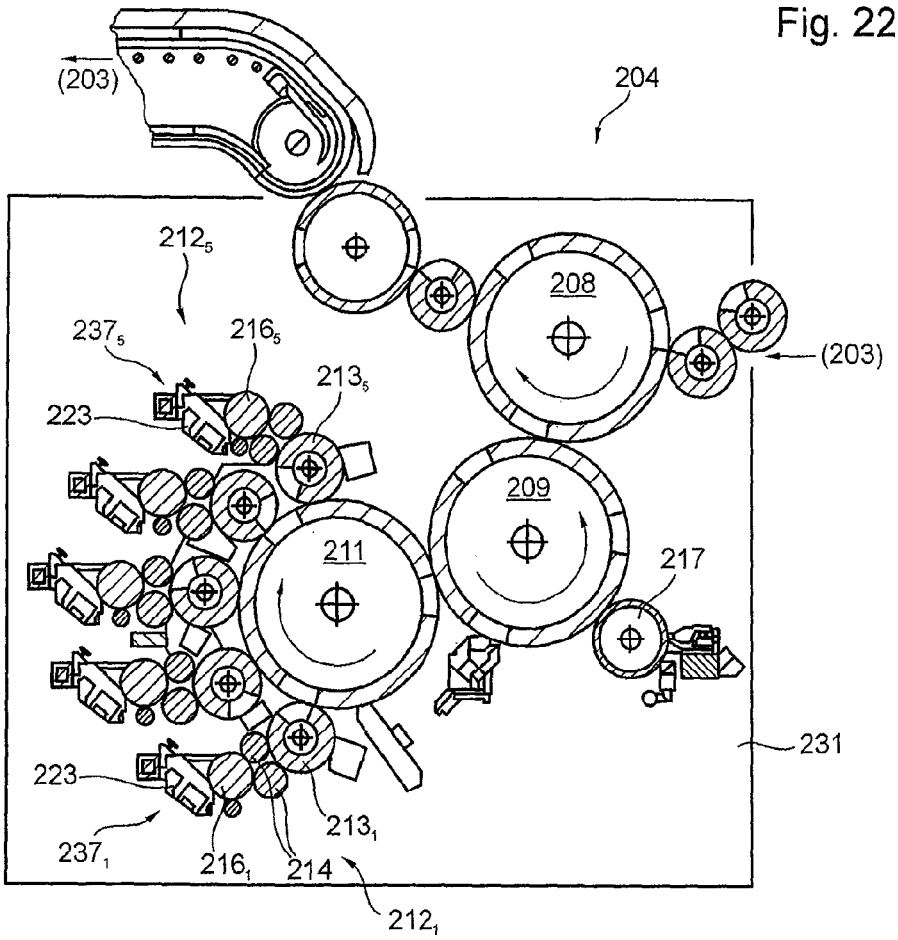
FIG. 22 a second example of an embodiment of the first printing unit having a multi-row temperature control assembly.
Figure 22:
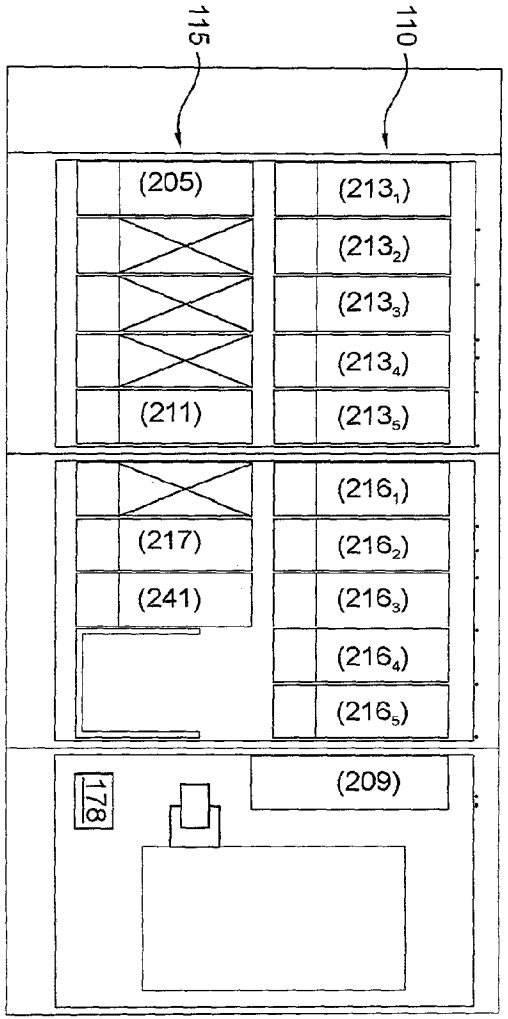

As is represented by way of example, e.g. in FIG. 21 and FIG. 22, the temperature of the screen rollers $\mathbf{213}_d$ of all of printing couples $\mathbf{212}_d$ in printing machine 201 and/or in printing unit 204 can be controllable or controlled by specifically designated temperature control circuits $\mathbf{109}_k$. For this purpose, in a modular embodiment for example, an additional connecting module 103; 103' is provided in the system. This can be taken into account even during the planning of machine 201. However, the modular construction and/or the construction comprising a plurality of prepared coupling sites 125 are also advantageous for cases of retrofitting, in which, for example in a printing unit 204, individual temperature control rather than a common temperature control in the group is desired. In this example, this would involve an individual control of the temperature of screen rollers $\mathbf{213}_d$ rather than the previous common and/or group temperature control.

In addition to a plurality of the aforementioned temperature control circuits $\mathbf{109}_k$ and/or temperature control modules $\mathbf{112}_l$, a temperature control circuit $\mathbf{109}_k$ and/or temperature control module $\mathbf{112}_l$ for controlling the temperature of a drive 241, e.g. one or more drive motors 241, in particular a primary drive motor 241, can be provided as a functional part 235 of printing unit 204, as represented by way of example in FIG. 22. This also applies similarly to embodiments of printing unit 204'; 204" as described below. In a preferred embodiment, drive 241 is embodied as a primary drive motor 241 for driving the positively driven cylinders and rollers of printing unit 204; 204'; 204" together, wherein said drive is preferably embodied as fluid-cooled, particularly water-cooled, and then temperature controlled and/or temperature controllable via the relevant temperature control circuit $\mathbf{109}_k$. A plurality of drive motors 241 may also be configured accordingly and may be temperature controllable and/or temperature controlled together—in series and/or in parallel—by the relevant temperature control circuit $\mathbf{109}_k$. A temperature control circuit $\mathbf{109}_k$ and/or temperature control module $\mathbf{112}_l$ for controlling the temperature of the single-motor or multiple-motor drive 241 is preferably embodied as not having a heating unit and/or as not fitted with such a unit.

Particularly in connection with a printing unit 204, the printing method of which involves an intaglio printing process, in addition to the plurality of aforementioned temperature control circuits $\mathbf{109}_k$ and/or temperature control modules $\mathbf{112}_l$, a temperature control circuit $\mathbf{109}_k$ and/or temperature control module $\mathbf{112}_l$, not shown, for controlling the temperature of the fluid in a washing fluid reservoir, not shown here, e.g., also referred to as "fresh solution" in a fresh solution tank, may also be provided. This fresh solution is used for cleaning a cylinder 217, preferably dampening cylinder 217. The temperature of said solution can be controlled, for example, via the temperature control circuits $\mathbf{109}_k$ by means of a heat exchanger.

Figure 24:
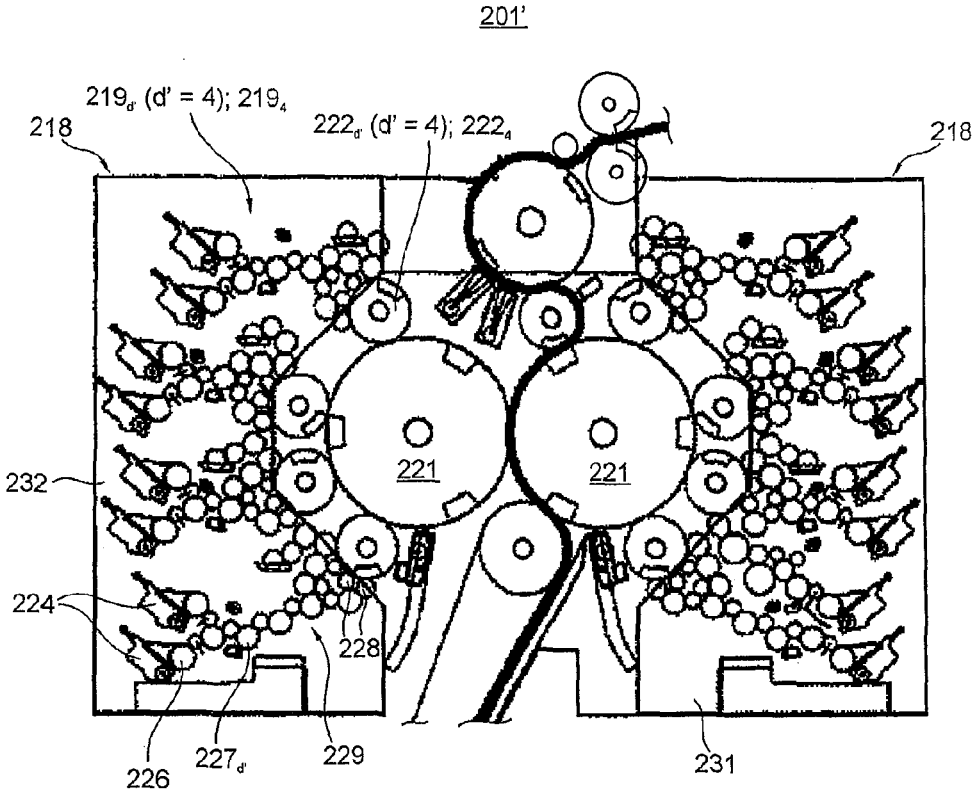
FIG. 24 a first example of the execution of temperature control of the second type of printing unit having a modular temperature control assembly.
Figure 24:
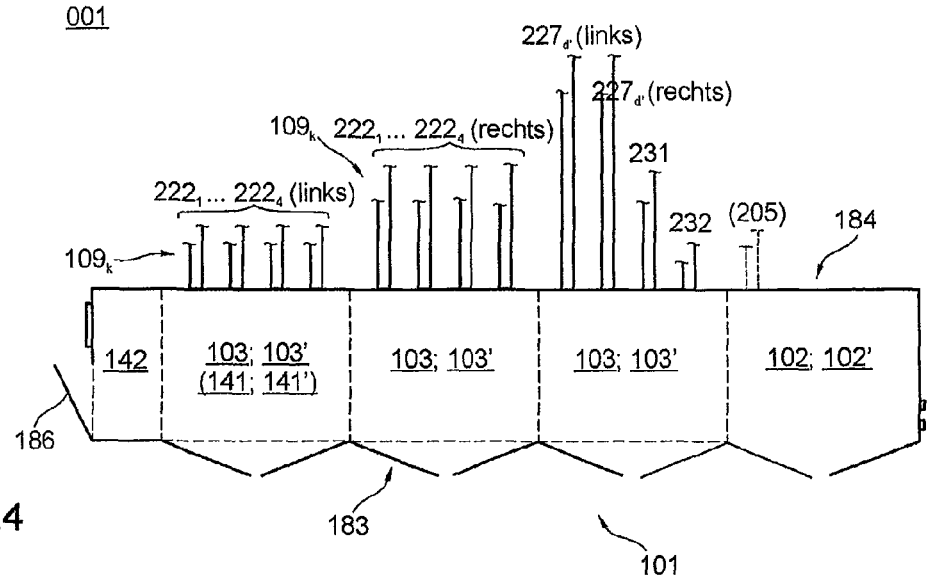
Figure 25:
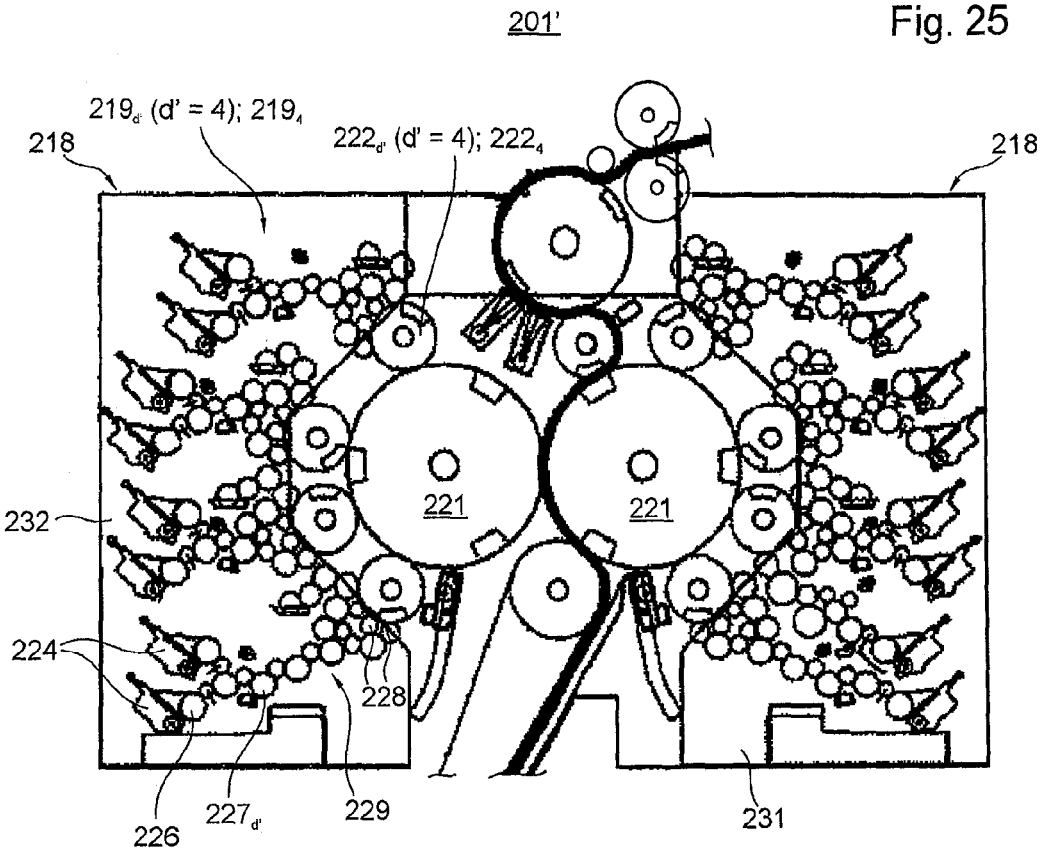
FIG. 25 a first example of the execution of temperature control of the second type of printing unit having a multi-row temperature control assembly.
Figure 25:
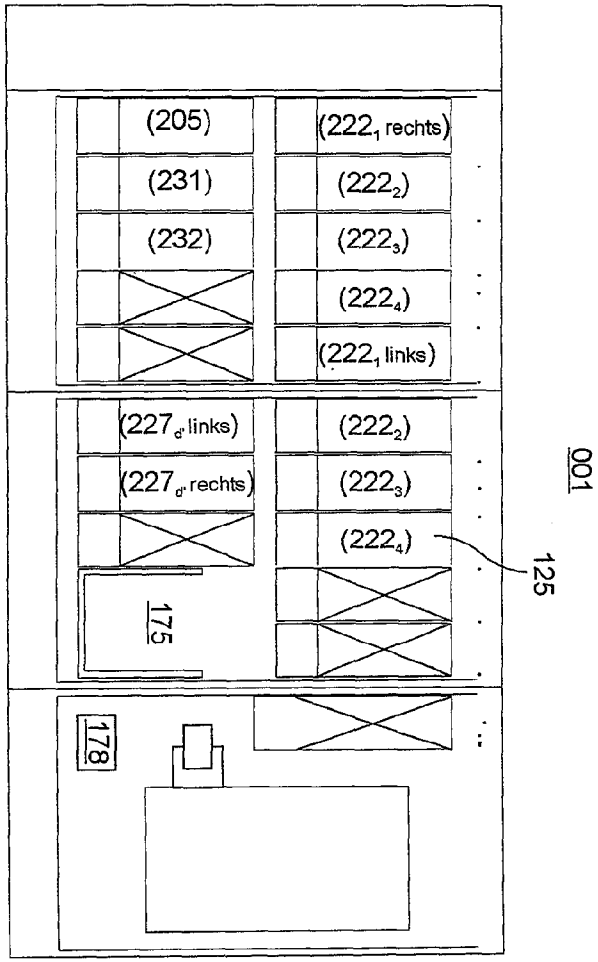
Figure 26:
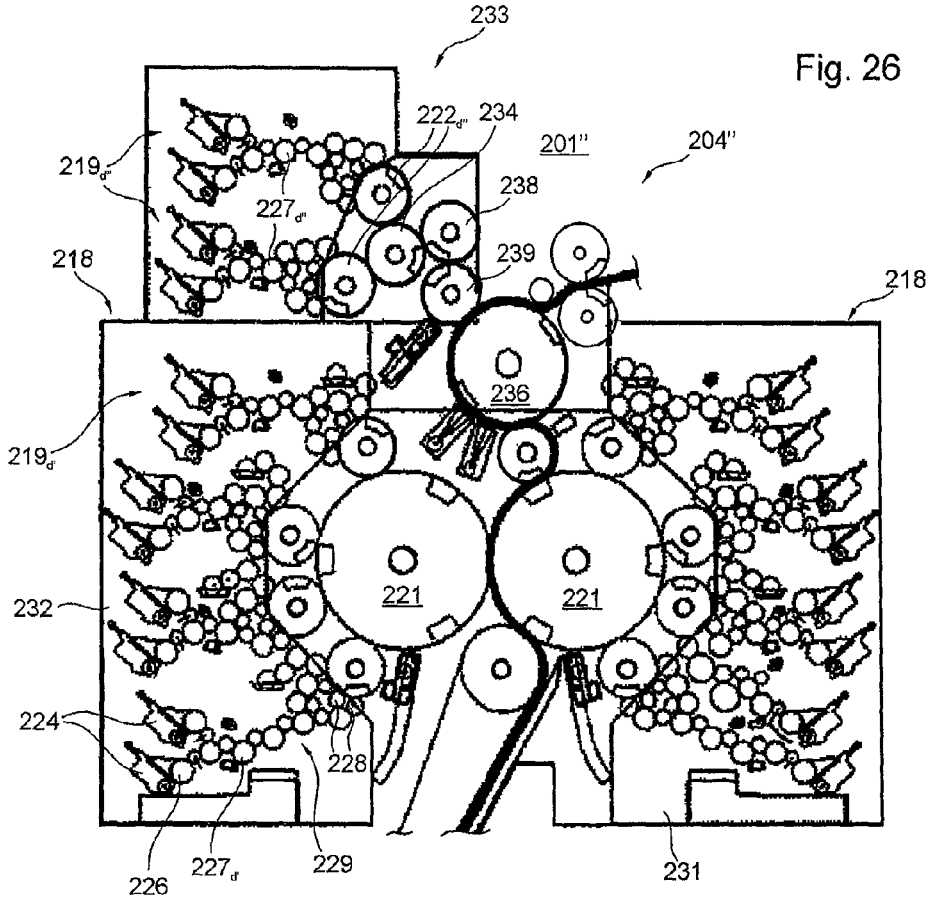
FIG. 26 a first example of the execution of temperature control of a modified printing unit of the second type having a modular temperature control assembly.
Figure 26:
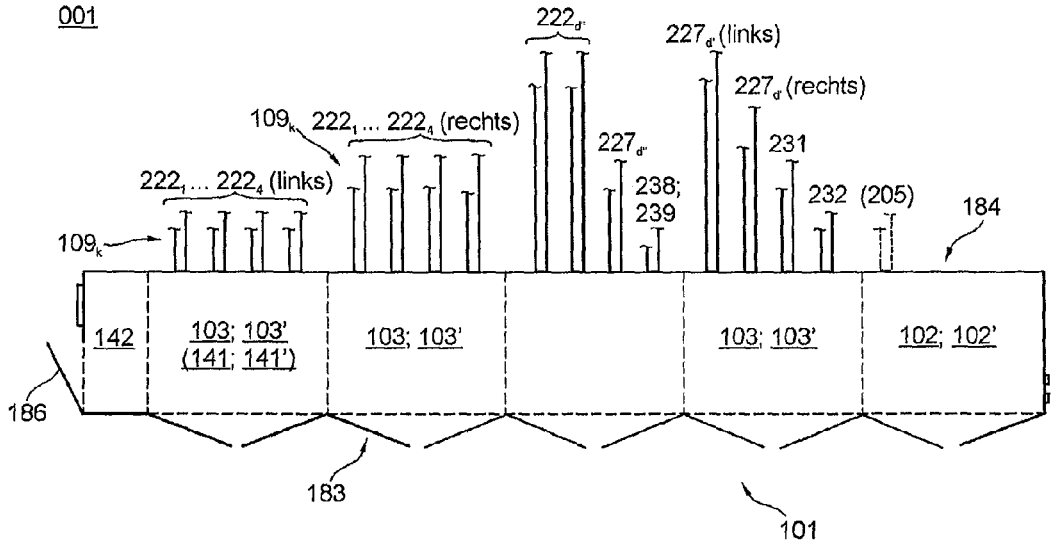
Figure 27:
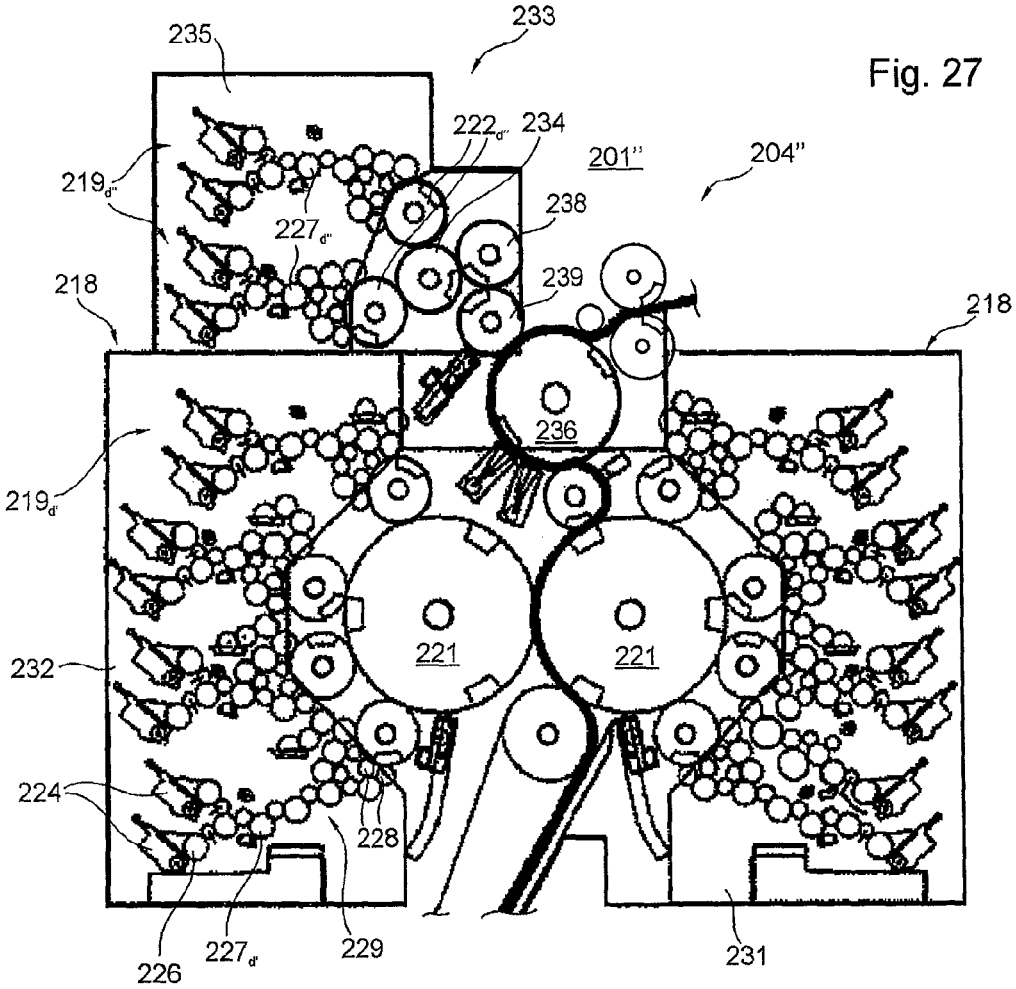
FIG. 27 a first example of the execution of temperature control of a modified printing unit of the second type having a multi-row temperature control assembly.
Figure 27:
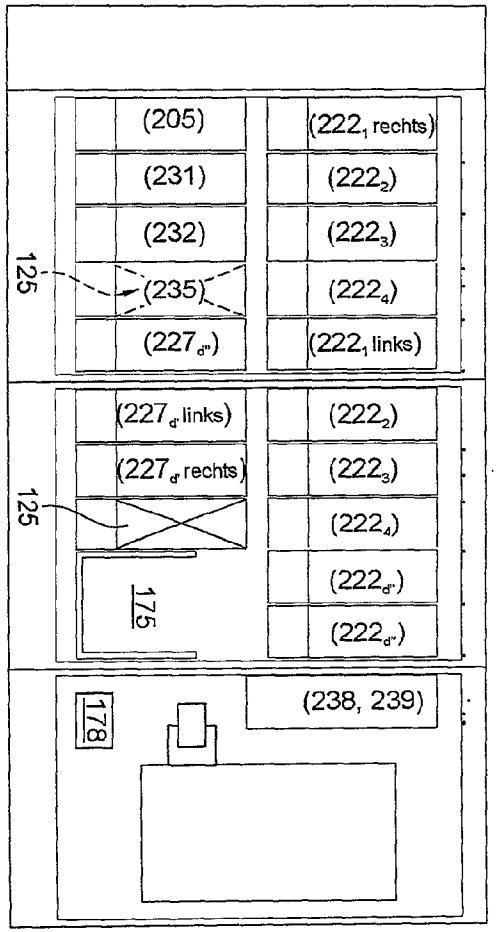

In addition to the use of the modular temperature control assembly 101 and/or the temperature control assembly that can be fitted with temperature control modules $\mathbf{112}_l$ for a printing machine 201 and/or a printing unit 204 of the same type and/or the same method in, e.g., different expansion stages, the temperature control assembly 101 that is designed in this manner is also particularly advantageous for use for and/or in other machines 201; 201', e.g. printing machines 201; 201' and/or printing units 204; 204'. The modular temperature control assembly 101 or the temperature control assembly that can be fitted with temperature control modules $\mathbf{112}_l$ can, e.g., alternatively be installed in a printing machine 201 of the aforementioned type in a printing system 001, described below, comprising (at least) one printing machine 201' and/or one printing unit 204' of a type and/or method that is different from the aforementioned type (see, e.g., FIG. 23 to FIG. 27). FIG. 24 shows, e.g., an enlarged representation of printing unit 204' of said printing machine 201' and of the temperature control assembly 101 assigned for controlling the temperature of printing machine 201' and/or of printing unit 204' thereof in a modular construction, and FIG. 25 shows a multi-row variant comprising temperature control units $\mathbf{112}_l$ embodied as temperature control modules $\mathbf{112}_l$. The example represented here involves a printing machine 201' and/or a printing unit 204', the printing process of which involves an offset printing process, for example, double-sided offset printing, in particular double-sided sheet-fed offset printing. This is the preferred process used in security printing, e.g. in the production of bank notes. For supplying printing substrate 203', e.g. printing substrate sheets 203', machine 201' has an infeed device 202', for example a sheet feeder 202', by which printing substrate 203' is fed to printing unit 204', and leaves said printing unit via a conveyor path 207' and is delivered to a product delivery unit 206', e.g. sheet delivery unit 206'. In the representations of FIG. 24 and FIG. 26, modules 102; 102'; 103; 103'; 141; 141'; 142 are represented merely schematically and without the module-side components. The description above relating to the configuration of said modules 102; 102'; 103; 103'; 141; 141'; 142 applies similarly here. In the representations of FIG. 25 and FIG. 27, temperature control modules $\mathbf{112}_l$ and coupling sites 125 are likewise represented merely schematically, and a representation of the routes has been dispensed with entirely.

Printing unit 204' comprises, at least on one side of the printing substrate path, an offset printing couple 218, preferably embodied as a multicolor printing couple 218 having a plurality of inking units $\mathbf{219}_{d'}$ (d', D∈ℕ, d'=1, 2, . . . D) for multicolor printing. Offset printing couple 218 comprises an ink-conducting cylinder 221, e.g. transfer cylinder 221, which forms the print position over printing substrate 203' in a nip point with an opposing cylinder. In principle, the opposing cylinder can be embodied simply as an impression cylinder that forms a counter bearing. The following description applies similarly to this single-sided embodiment of printing unit 204'.

Preferably, however, printing unit 204' comprises two offset printing couples 218, in particular, multicolor printing couples 218, which form a double-sided print position on the transfer cylinders 221 thereof, and which are embodied, e.g. as substantially identical, e.g. substantially in mirror symmetry to a plane that extends through the printing site. Transfer cylinder 221 of the one offset printing couple 218 serves as the opposing cylinder for the other offset printing couple 218 in the manner of a counter bearing, and vice versa.

Transfer cylinder 221 cooperates with a plurality d' of cylinders $\mathbf{222}_{d'}$, e.g. forme cylinders $\mathbf{222}_{d'}$, which comprise on their outer surface the printed image template, for example on a printing forme, and each of which is or can be inked with printing ink upstream by an inking unit $\mathbf{219}_{d'}$. Each inking unit $\mathbf{219}_{d'}$ comprises at least one ink source 224, e.g. an ink fountain 224 or a doctor blade device, from which printing ink can be applied to a (optionally temperature controllable) roller 226, e.g. a ductor roller 226 or ink fountain roller 226. The printing ink is conveyed downstream directly or preferably via a roller train 229 to additional rollers, which comprise, for example, at least one temperature controllable roller 227', e.g. a temperature controllable oscillating distribution roller 227', and to one or more rollers 228, e.g. forme rollers 228, which cooperate with the respective forme cylinder $\mathbf{222}_{d'}$. In one advantageous embodiment of inking units $\mathbf{219}_{d'}$, said units are embodied with two ink fountains 224 for so-called "iris printing", i.e., simultaneous printing using a plurality of inks supplied by the same inking unit $\mathbf{219}_{d'}$. Each of the inking units $\mathbf{219}_{d'}$ is mounted on both sides, e.g. on a right and on a left frame part 231; 232, e.g. side frame 231; 232.

Printing machine 201' and/or printing unit 204' is then assigned a temperature control assembly 101, by which a plurality of functional components are and/or can be temperature controlled in parallel with one another. These components may be a plurality of cylinders 221; $\mathbf{222}_d$ and/or rollers $\mathbf{227}_{d'}$; 226 of offset printing couple 218 and/or of offset printing couples 218 of printing unit 204', which are to be temperature controlled individually or in groups.

In one advantageous embodiment, e.g. illustrated in FIG. 24 and FIG. 25, for each of forme cylinders $\mathbf{222}_{d'}$, e.g. with D=4 printing couples $\mathbf{212}_d$, a separate temperature control circuit $\mathbf{109}_k$ is provided for each of the four left and the four right forme cylinders $\mathbf{222}_{d'}$, and in temperature control assembly 101, an individual temperature control unit $\mathbf{112}_l$ which can be controlled and/or adjusted independently of the other temperature control units $\mathbf{112}_l$ is provided. In a less costly variant in terms of rollers $\mathbf{227}_{d'}$ to be temperature controlled, a common temperature control circuit $\mathbf{127}_q$ can be provided for all the inking units $\mathbf{219}_{d'}$ in the same multicolor printing couple 218, in particular the right and left multicolor printing couples 218, and in temperature control assembly 101 for said group, an individual temperature control unit $\mathbf{112}_l$ which can be controlled and/or adjusted independently of other temperature control units $\mathbf{112}_l$ is provided. Finally, in a further development it can be provided that a temperature control circuit $\mathbf{127}_q$ is provided for each of the left and the right side frames 231; 232, and that in system 101 for said group, an individual temperature control unit $\mathbf{112}_l$ which can be controlled and/or adjusted independently of other temperature control units $\mathbf{112}_l$ is provided. In the modular variant, base module 102; 102' can be configured without a temperature control unit $\mathbf{112}_l$, or can comprise a temperature control unit $\mathbf{112}_l$ that is not assigned, for example, or a temperature control unit $\mathbf{112}_l$ that is connected to measuring system 205.

However, an assignment other than that represented here for the temperature control circuits $127_q$ and/or coupling sites 125 that are coupled and/or not coupled to temperature control assembly 101 may also be provided.

Temperature control assembly 101, which is modular and/or embodied with coupling sites 125 and temperature control modules $112_l$, then allows a machine 201'; 201", e.g. printing machine 201'; 201" and/or printing unit 204'; 204" that is obtainable or is expandable and/or expanded after-market, e.g. in various expansion stages, to be temperature controlled in a simple manner. For instance (see, e.g. FIG. 26 and FIG. 27), it is possible in a simple manner to provide at least additional temperature control modules $112_l$ (e.g.: FIG. 27) and/or an additional connecting module 103; 103' (e.g. FIG. 26) for a printing unit 204" that has been expanded—e.g. by two printing positions—in temperature control assembly 101. In this case, for example, at least one—single-part or multiple-part—module 233, e.g. printing couple module 233, having, e.g. one or more, e.g. two cylinders $222_{d''}$ and inking units $219_{d'}$ assigned thereto, for example with a dedicated side frame 235, e.g. two end-face frame parts 235, is provided and/or can be provided in printing unit 204". Cylinders $222_{d''}$, in particular forme cylinders $222_{d''}$, and inking unit $219_{d''}$ may be embodied as described above. Forme cylinders $222_{d''}$ cooperate with a cylinder 234, e.g. a transfer cylinder 234, which forms a printing position, directly or via additional cylinders 238; 239, with a cylinder 236, e.g. an impression cylinder 236. The temperature control assembly 101 that is assigned to the printing machine 201" and/or printing unit 204" embodied in this manner then comprises, for example, an additional temperature control module $112_l$ and/or an additional connecting module 103; 103' having, e.g., four additional connected or connectable temperature control circuits $109_k$. For example, one common temperature control circuit $109_k$ is provided for controlling the temperature of at least one temperature controllable roller $227_{d''}$ of each of the two additional inking units $219_{d''}$, and a separate temperature control circuit $109_k$ is provided for each forme cylinder $222_{d''}$. In addition—if transfer cylinder 234 does not interact directly with impression cylinder 236—a (common) temperature control circuit $109_k$ can be provided for one or more of the cylinders 238; 239 situated therebetween. In addition to the plurality of the aforementioned temperature control circuits $109_k$ and/or temperature control modules $112_l$, a temperature control circuit $109_k$ and/or temperature control module $112_l$ for controlling the temperature of side frame 235, as a functional part 235 of printing couple module 233, can be provided as represented by way of example in FIG. 27. In FIG. 25, an additional unoccupied coupling site 125 is represented, by way of example.

Figure 28:
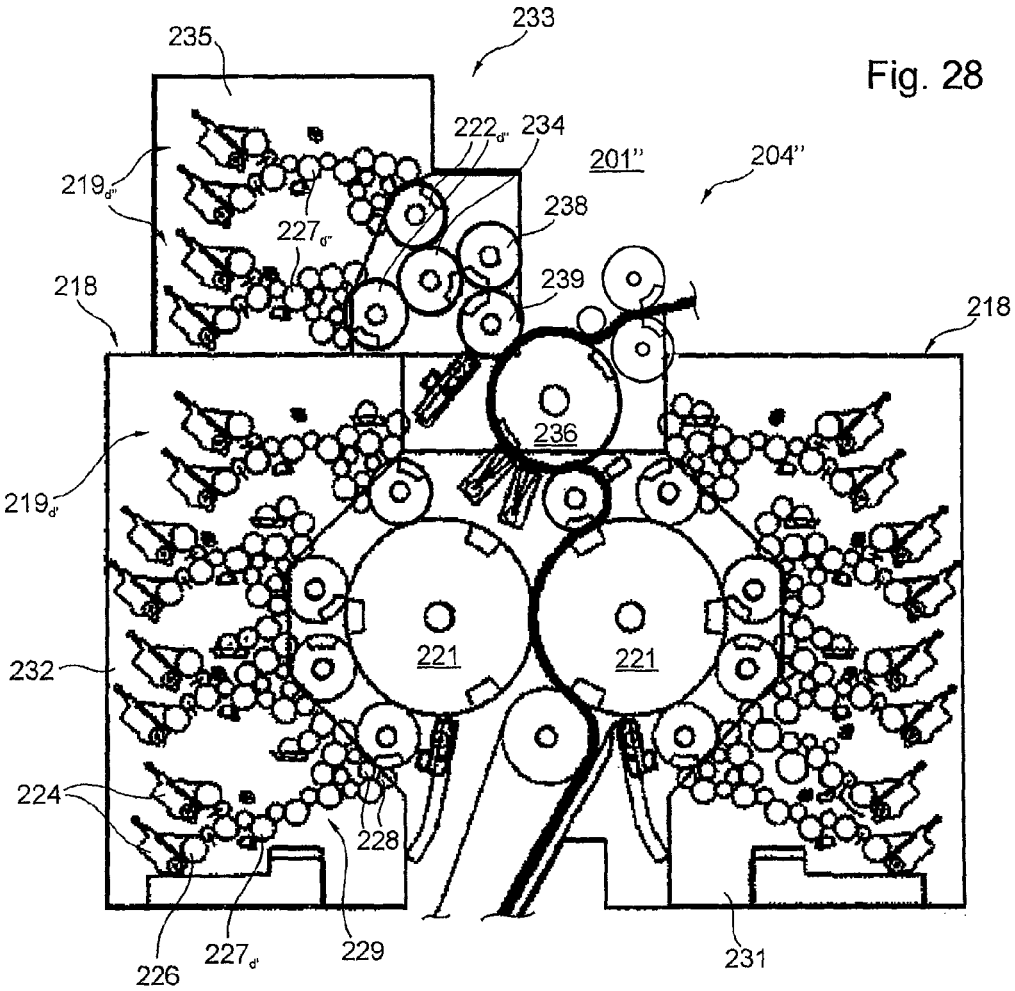
FIG. 28 a modification of the example of FIG. 27.
Figure 28:
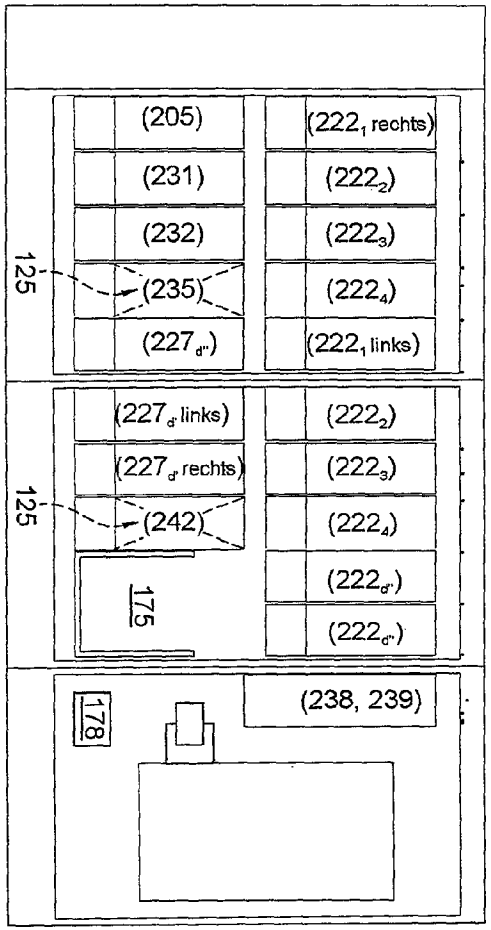

In a stage of expansion represented in FIG. 28, a temperature control circuit $109_k$ or temperature control module $112_l$ for controlling the temperature of an additional cylinder 242, e.g. printing couple cylinder 242, as a functional part 242 to be temperature controlled, is provided—e.g. in addition to temperature control circuit $109_k$ of a part thereof and/or temperature control module $112_l$ from the example presented in reference to FIG. 27. This cylinder 242 to be temperature controlled is preferably embodied as an Orlof plate cylinder 242, which is a printing unit, not explicitly described, for double-sided offset printing, wherein one of the two printing couples 218 is configured for printing using the Orlof process. In this case, in one of printing couples 218 in FIG. 25, 27 or 28, a collecting cylinder that cooperates with cylinders 222' is provided between transfer cylinder 221 and cylinders 222', and the Orlof plate cylinder (242) is provided between said collecting cylinder and transfer cylinder 221. In this case, cylinders 222' are embodied as screen cylinders.

Figure 29:
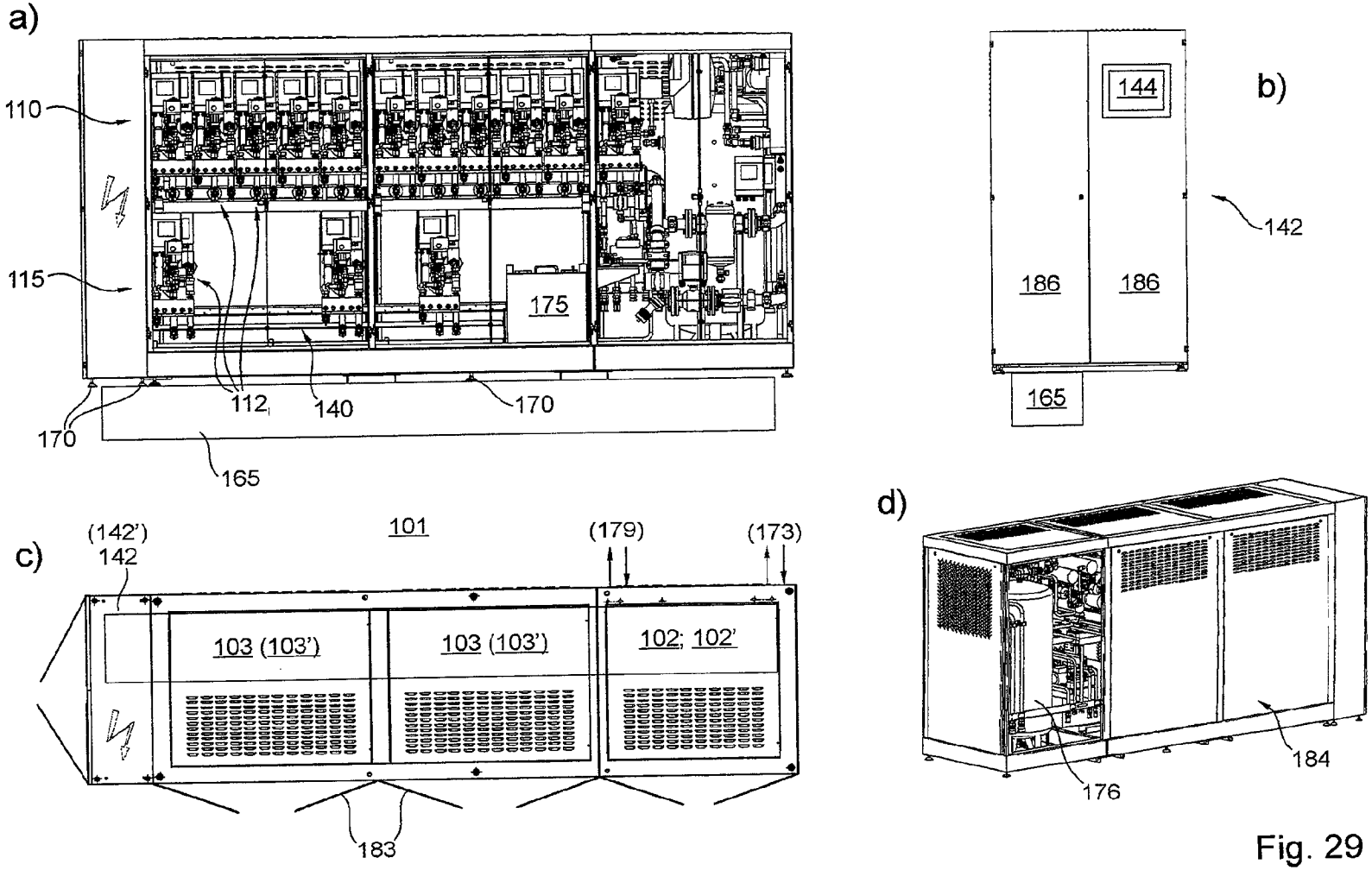
FIG. 29 an embodiment example of a multi-row embodiment of the temperature control assembly comprising a plurality of sections, a) in a front elevation view, b) in a side view from the standpoint of the section embodied as an equipment cabinet, c) in a plan view, and d) in a perspective rear view with an opened base section.

FIG. 29 shows, by way of example, a specific variant of a multi-row variant of temperature control assembly 101, which comprises a plurality of sections 102; 102'; 103 (103'); 142 (142'). In this case, the temperature control assembly can be embodied as modular to the extent that, e.g., an end module 142, e.g. embodied as an equipment cabinet 142—e.g. with a number of dedicated feet 170—can be joined to a single-part or multi-part cabinet comprising two connecting sections 103 and one base section, and likewise having feet 170. In this variant, base section 102; 102' can additionally be embodied as an attachable and/or detachable module 02; 02'. Below a rear region of temperature control assembly 101, in the base of system 001, a recess 165, e.g. a channel 165, is provided, in which lines, not shown, of the temperature control components $109_k$ to be connected extend. Temperature control assembly 101 in this case is embodied with a plurality of coupling sites 125, with some of the sites, in this case e.g. fourteen, being fitted with a temperature control module $112_l$. The temperature control assembly comprises, e.g., a tank 175, which can receive temperature control fluid to be refilled as needed into temperature control fluid store 176. This temperature control fluid, which is optionally mixed with inhibitor solution, can then be conveyed as needed via a line route, not shown in detail, into temperature control fluid store 176 and/or into the line route that comprises said store.

While preferred embodiments of a temperature control assembly for controlling the temperature of functional parts of a printing machine, a printing system comprising a printing machine and a temperature control assembly, and a set of modules for forming a temperature control assembly, all in accordance with the present invention, have been set forth fully and completely herein above, it will be apparent to one of skill in the art that various changes can be made, without departing from the true spirit and scope of the subject invention which is accordingly to be limited only by the appended claims.

What is claimed is:

1. A temperature control assembly for controlling the temperature of functional parts of a printing machine, wherein the temperature control assembly comprises a plurality of assembly-side temperature control sub-circuits arranged side by side, the temperature of which is to be individually controlled, and each of which comprises a temperature control fluid outlet and a temperature control fluid inlet, wherein an external temperature control sub-circuit which controls the temperature of one or more functional parts can be connected via releasable connections to each assembly-side sub-circuit in order to form a respective temperature control circuit, and the assembly-side sub-circuits one of can be coupled and are coupled, one of thermally and/or fluidically, to a common feed line for conducting temperature control fluid for controlling the temperature of said sub-circuits on the feed side, and to a common return line on the return side, and wherein the feed line is line-connected to a fluid store which holds temperature control fluid that is temperature controlled in reserve, to be fed to said feed line, characterized in that the common feed line, the fluid store and a temperature control device that controls the temperature of the temperature control fluid of the fluid store, as components of the temperature control assembly, are encompassed by the temperature control assembly, by a common single-part or multi-part frame thereof.

2. The temperature control assembly according to claim 1, characterized in that the temperature control assembly comprises at least two parallel rows, extending in the longitudinal direction of the feed line, each row containing a plurality of one of independently controllable and adjustable temperature control units for controlling the temperature of the temperature control circuits and/or a plurality of prepared coupling sites for receiving and for coupling, on the feed side and the return side, one of independently controllable and/or adjustable temperature control units, embodied as temperature control modules, for controlling the temperature of the temperature control circuits.

3. The temperature control assembly according to claim 2, characterized in that each of the temperature control units comprises at least one control element for controlling the temperature of the relevant temperature control circuit.

4. The temperature control assembly according to claim 2, characterized in that the temperature control module, on a supporting structure, comprises at least one of a control element, in particular a valve, for controlling a fluid flow and module-side parts of line sections that lead one of indirectly and directly to the control means, and/or at least one heating unit and at least one interface for receiving at least one heating unit, and one of a control and/or adjustment device, preferably embodied as one of a control and/or adjustment module, and/or a pump for pumping the temperature control fluid, and/or a connecting block, from which the line sections on the temperature control module side that are to be coupled, in particular at least one line section that leads to the control means and one that leads to the interface, proceed, and which can be coupled to a connecting plate, which is provided on the frame of the temperature control assembly and comprises a plurality of prepared line connections.

5. The temperature control assembly according to claim 1, characterized in that the temperature control assembly comprises at least two modules, specifically at least one base module, which comprises the fluid store and the temperature control device that controls the temperature of the fluid in the fluid store, and a connecting module, which is one of coupled and can be coupled to said base module and which comprises a plurality of one of independently controllable and adjustable temperature control units for controlling the temperature of the temperature control circuits, wherein line sections are assigned to the base module and the connecting module and are one of releasably connected and connectable to one another to form the feed line and the return line.

6. The temperature control assembly according to claim 5, characterized in that the connecting module comprises a plurality of prepared coupling sites for receiving and for coupling, on the feed side and the return side, the one of independently controllable and/or adjustable temperature control units, embodied as temperature control modules, for controlling the temperature of the temperature control circuits.

7. The temperature control assembly according to claim 5, characterized in that the connecting module comprises at least two parallel rows, extending in the longitudinal direction of the feed line, each row containing a plurality of one of independently controllable and adjustable temperature control units for one of controlling the temperature of the temperature control circuits, and containing a plurality of prepared coupling sites for receiving and for coupling, on the feed side and the return side, one of independently controllable and/or adjustable temperature control units, embodied as temperature control modules, for controlling the temperature of the temperature control circuits.

8. The temperature control assembly according to claim 5, characterized in that the line sections of the modules are arranged on a frame that is assigned to the respective module in such a way that the relevant connection between the line sections which are assigned to one another can be one of established and released without detaching the line sections ($\mathbf{123}_r$; $\mathbf{124}_r$) from the respective frame.

9. The temperature control assembly according to claim 8, characterized in that a plurality, in particular the same number, of outlets for delivering temperature control fluid to the connecting modules to be coupled, which comprise the respective temperature control component, are provided side by side and are connected to one another at least on the feed side and the return side, and one of indirectly and directly to the base module.

10. The temperature control assembly according to claim 9, characterized in that the base module and the at least one connecting module are each configured in the manner of a cabinet, each having one of at least one door and each having the same width in reference to the front side.

11. The temperature control assembly according to claim 10, characterized in that an end module having at least one control device is provided, which control device can be connected via a signal line section that is assigned to the end module and via an interface to a signal line section which is assigned to the connecting module and is signal-connected to the control elements of the connecting module, thereby forming a line system that spans all the modules.

12. The temperature control assembly according to claim 11, characterized in that, prior to being joined, the modules are configured such that feed lines and return lines that span all the modules can be formed by connecting the preassembled, module-side line sections, and a line system for transmitting signals that spans all the modules can be formed by connecting prepared signal line sections.

13. The temperature control assembly according to claim 1, characterized in that one of the temperature control device, which is part of the temperature control assembly and is provided for controlling the temperature of the temperature control fluid to be held in reserve in the fluid store, is embodied as a temperature control device based on thermal contact without fluid exchange, and/or in that the temperature control device, which is part of the temperature control assembly and is provided for controlling the temperature of the temperature control fluid to be held in reserve in the fluid store, is embodied as a heat exchanger, which, on its secondary side, conducts the temperature control fluid to be temperature controlled, and, on its primary side, conducts temperature control medium to be supplied externally by the temperature control assembly and fed to the temperature control assembly.

14. The temperature control assembly according to claim 1, characterized in that, to control the temperature of the temperature control fluid to be held in reserve in the fluid store, a bypass is provided, which has the temperature control device in its line system, and in which part of the flow of temperature control fluid to be held in reserve in the fluid store circulates and can be temperature controlled, one of continuously and discontinuously, by the temperature control device.

15. The temperature control assembly according to claim 1, characterized in that the temperature control assembly comprises a second feed line for conducting temperature control fluid at a temperature that is different from that of the first feed line, a second return line, and a second unit that controls the temperature of the temperature control fluid of the second feed line.

16. The temperature control assembly according to claim 15, characterized in that at least one temperature control circuit of the temperature control assembly can be one of coupled and is coupled to the second feed line and to the second return line for controlling the temperature of said circuit.

17. The temperature control assembly according to claim 1, characterized in that at least a number of one of adjustment and control devices, embodied as one of adjustment and control modules, that corresponds to the respective number of assembly-side temperature control sub-circuits, is provided in the temperature control assembly, and, in particular for at least one of two temperature control sub-circuits, two adjustment and control modules of the same embodiment are provided, which are configured for performing at least one of somewhat different control and adjustment tasks using a different assignment of respectively one of prepared input-side and/or output-side interfaces.

18. A printing system having at least one printing machine and a temperature control assembly for controlling the temperature of functional parts of said printing machine, characterized by the embodiment of the temperature control assembly according to claim 1.

19. The printing system according to claim 18, characterized in that one of an inspection system and a cylinder, embodied as a dampening cylinder, of a printing unit of the at least one printing machine is connected as a functional part to the temperature control assembly for controlling the temperature thereof.

20. The printing system according to claim 18, characterized in that, as functional parts, a plurality of cylinders of a printing unit of the at least one printing machine can be temperature controlled by means of temperature control components, which are temperature controlled independently of one another by means of the temperature control assembly.

21. The printing system according to claim 18, characterized in that a plurality of rollers of a printing unit of the at least one printing machine can be temperature controlled together by means of a temperature control component, which is temperature controlled by means of the temperature control assembly.

22. The printing system according to claim 18, characterized in that a plurality of rollers embodied as ductor rollers and/or a plurality of rollers embodied as screen rollers of a printing unit, configured particularly for intaglio printing, of the at least one printing machine, configured particularly for security printing, are connected to the temperature control assembly and can be temperature controlled by means of temperature control components, which are temperature controlled independently of one another by means of the temperature control assembly.

23. The printing system according to claim 18, characterized in that rollers of a plurality of inking units of a multicolor printing couple of a printing unit, configured particularly for double-sided offset printing, of the at least one printing machine, configured particularly for security printing, can be temperature controlled together by means of a temperature control component, which is temperature controlled by means of the temperature control assembly.

24. The temperature control assembly according to claim 1, characterized in that a component that limits flow to a predefined flow direction, in particular a flow check valve, is assigned to at least one, preferably to all, temperature control units in the temperature control assembly, in a fluid route between a fluid withdrawal point from the feed line and a return into the return line.

25. A set of modules for forming a temperature control assembly for controlling the temperature of functional parts of a printing machine, said set comprising modules, at least one of which is configured as a base module and one of which is configured as a connecting module, which can be combined with one another in order to form, in combination with one another on a common single-part or multi-part frame of the temperature control assembly, at least part of a temperature control assembly having a plurality of interface pairs which form outlets and inlets for coupling a plurality of temperature control circuits that are to be temperature controlled, wherein the base module and the connecting module each comprise a line section, assigned to the module, of a common feed line for conducting temperature control fluid to be formed in the temperature control assembly, and a line section, assigned to the module, of a common return line to be formed in the temperature control assembly, wherein the base module comprises at least one temperature control device for controlling the temperature of the temperature control fluid that will be fed into the feed line, and an outlet of the line section provided for conducting the temperature control fluid, which outlet is for supplying temperature control fluid that is temperature controlled, wherein the connecting module comprises an inlet of the line section which is provided for conducting the temperature control fluid, which inlet can be coupled to one of the outlet of the base module and to an outlet of another connecting module, and comprises one of a preassembled temperature control unit and a prepared coupling site for receiving a temperature control unit, embodied as a temperature control module, for each temperature control circuit that is to be temperature controlled and wherein the base module and the connecting module are embodied as preassembled modules, in that the base module and the connecting module, before being joined to one or more other modules, each comprise, on a frame to be assigned to the respective module, the preassembled line sections that relate to the feed line and the return line, with the connecting module also already comprising, on the relevant frame, one of preassembled temperature control units and a prepared coupling site, and the base module also already comprising, on the relevant frame, the preassembled temperature control device for controlling the temperature of the temperature control fluid.

26. The set of modules according to claim 25, characterized in that an end module having at least one control device is provided, which can be connected via a signal line section assigned to the end module and via an interface to a signal line section, which is assigned to the connecting module and is signal-connected to the control elements of the connecting module, in order to form a line system that spans all of the modules.

* * * * *